US008025451B2

(12) United States Patent
Yamaguchi et al.

(10) Patent No.: US 8,025,451 B2
(45) Date of Patent: Sep. 27, 2011

(54) TAPE PRINTER

(75) Inventors: Koshiro Yamaguchi, Kagamihara (JP); Akira Ito, Nagoya (JP); Yoshio Kunieda, Nagoya (JP); Takahiro Miwa, Konan (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 833 days.

(21) Appl. No.: 11/663,688

(22) PCT Filed: Sep. 22, 2005

(86) PCT No.: PCT/JP2005/017477

§ 371 (c)(1),
(2), (4) Date: Aug. 27, 2007

(87) PCT Pub. No.: WO2006/033389

PCT Pub. Date: Mar. 30, 2006

(65) Prior Publication Data

US 2008/0050160 A1 Feb. 28, 2008

(30) Foreign Application Priority Data

Sep. 24, 2004 (JP) ..... 2004-278359

(51) Int. Cl.
*B41J 2/315* (2006.01)
*B41J 11/70* (2006.01)
*B41J 29/38* (2006.01)

(52) U.S. Cl. ..... 400/613; 400/120.01; 400/621; 400/76

(58) Field of Classification Search ..... 400/120.01, 400/613
See application file for complete search history.

(56) References Cited

U.S. PATENT DOCUMENTS

| | | | | |
|---|---|---|---|---|
| 4,949,891 | A * | 8/1990 | Yamashita | 226/30 |
| 6,116,796 | A * | 9/2000 | Yamaguchi et al. | 400/615.2 |
| 6,123,796 | A * | 9/2000 | Kathmann et al. | 156/249 |
| 7,121,751 | B2 * | 10/2006 | Harada et al. | 400/615.2 |
| 2006/0165457 | A1 * | 7/2006 | Hasegawa et al. | 400/62 |
| 2006/0165461 | A1 * | 7/2006 | Vandermeulen et al. | 400/208 |
| 2007/0286660 | A1 * | 12/2007 | Maghakian | 400/207 |

FOREIGN PATENT DOCUMENTS

| | | | |
|---|---|---|---|
| JP | 09-300792 | | 11/1997 |
| JP | 09300793 | A * | 11/1997 |
| JP | 2000-006472 | | 1/2000 |
| JP | 2002008067 | A * | 1/2002 |
| JP | 2002-207984 | | 7/2002 |
| JP | 2003-123042 | | 4/2003 |
| JP | 2003132330 | | 5/2003 |
| JP | 2003168098 | A * | 6/2003 |
| JP | 2004082432 | | 3/2004 |
| JP | 2004-157588 | | 6/2004 |
| JP | 2004264375 | A * | 9/2004 |

* cited by examiner

*Primary Examiner* — Daniel J Colilla
*Assistant Examiner* — David Banh
(74) *Attorney, Agent, or Firm* — Day Pitney LLP

(57) ABSTRACT

An antenna 33 is located downstream of a tape transferring direction of a tape discharging port 27 through which a printed label tape 28 of a tape cassette 21 mounted to a cassette housing part 8 is discharged. A reflective sensor 35 that detects a sensor marks 65 provided on the back surface of the printed label tape 28 is arranged at the opposite side of the antenna 33 interposing the printed label tape 28. At the upstream of the antenna 33 and the reflective sensor 35 in the tape transferring direction, a cutter unit 30 for cutting the printed label tape 28 discharged through the tape discharging port 27 of the tape cassette 21 at a predetermined interval is arranged.

1 Claim, 59 Drawing Sheets

FIG. 20

131

| | | |
|---|---|---|
| MODEL A | DRY BATTERY | PARAMETER A1 |
| | AC ADAPTER | PARAMETER B1 |
| | AC POWER SUPPLY | PARAMETER C1 |
| MODEL B | DRY BATTERY | PARAMETER A2 |
| | AC ADAPTER | PARAMETER B2 |
| | AC POWER SUPPLY | PARAMETER C2 |
| MODEL C | DRY BATTERY | PARAMETER A3 |
| | AC ADAPTER | PARAMETER B3 |
| | AC POWER SUPPLY | PARAMETER C3 |

FIG. 21

132

| DATA FIELD | CONTENT OF FIELD |
|---|---|
| TAPE WIDTH | 6mm |
| TAPE TYPE | LAMINATE TAPE |
| TAPE LENGTH | 8m |
| PITCH LENGTH L OF IC CHIP | 50mm |
| INK RIBBON TYPE | FOR LAMINATION |
| INK RIBBON COLOR | BLACK |

FIG. 22

| MODEL NAME | HEAD RESOLUTION | HEAD SIZE |
|---|---|---|
| MODEL A | 360dpi | 256DOTS |
| MODEL B | 180dpi | 256DOTS |
| MODEL C | 270dpi | 128DOTS |

FIG. 51

135

| | |
|---|---|
| MODEL A | PARAMETER A10 |
| MODEL B | PARAMETER B10 |
| MODEL C | PARAMETER C10 |

FIG. 52

136

| DATA FIELD | CONTENT OF FIELD |
|---|---|
| TAPE WIDTH | 6mm |
| TAPE TYPE | LAMINATE TAPE |
| TAPE LENGTH | 8m |
| PITCH LENGTH L OF IC CHIP | 50mm |
| INK RIBBON TYPE | FOR LAMINATION |
| INK RIBBON COLOR | BLACK |

FIG. 72

181

| | | |
|---|---|---|
| MODEL A | DRY BATTERY | PROGRAM A21 |
| | AC ADAPTER | PROGRAM B21 |
| | AC POWER SUPPLY | PROGRAM C21 |
| MODEL B | DRY BATTERY | PROGRAM A22 |
| | AC ADAPTER | PROGRAM B22 |
| | AC POWER SUPPLY | PROGRAM C22 |
| MODEL C | DRY BATTERY | PROGRAM A23 |
| | AC ADAPTER | PROGRAM B23 |
| | AC POWER SUPPLY | PROGRAM C23 |

FIG. 74

182

| | |
|---|---|
| MODEL A | PROGRAM A31 |
| MODEL B | PROGRAM B31 |
| MODEL C | PROGRAM C31 |

TAPE PRINTER

TECHNICAL FIELD

The disclosure relates to a tape printer comprising a tape transfer means that transfers a long length of tape and a printing means that prints on the tape, the tape printer, to which a tape cassette accommodating the tape can be removably mounted. In particular, the disclosure relates to the tape printer that adheres a wireless information circuit element including an IC circuit part for storing the predetermined information and an IC circuit-side antenna connected to the IC circuit part to transmit and receive the information to a printed tape.

BACKGROUND ART

Conventionally, there have been proposed various devices, which, after printing characters on record media, adhere a wireless information circuit element including an IC circuit part for storing the predetermined information and an IC circuit side antenna connected to the IC circuit part to transmit and receive the information to and from the record media so as to read or write predetermined information from or into the wireless information circuit element.

For example, there is a manufacturing device of a sheet with an IC tag, the manufacturing device including an information printing device that prints input information on a sheet base, an antenna printing device that prints with a conductive ink an antenna capable of communicating with an external device on the sheet base printed by the information printing device, IC chip adhering device that adheres an IC chip on the antenna printed by the antenna printing device so as to form an IC tag, and summary information writing device that writes at least a part of the input information into the IC chip adhered by the IC chip adhering device (for example, see Patent Document 1).

In such a manufacturing device of a sheet with an IC tag, the IC tag is formed on the sheet base and summary information is written thereto, so that outline of data can be easily retrieved by looking over the summary information.

[Patent Document 1] Japanese patent application laid-open No. 2003-123042, Paragraph [0013] to [0027], FIGS. 1 to 6

DISCLOSURE OF INVENTION

Problems to be Solved by the Invention

However, in a technique of the conventional device for manufacturing a sheet with an IC tag described above, the antenna is printed directly on a predetermined sized sheet and then the IC tag is adhered and formed thereto. When the technique is applied for a tape printer which prints on a tape while drawing out the tape and transferring from a tape cassette accommodating a long length of tape, the IC tag has to be adhered after printing the antenna directly on the tape. This makes the tape cassette grow in size so that miniaturization of the tape printer becomes difficult. Further, when the device is arranged in such a manner that, after arranging the IC tag and the antenna therefor on the printed tape, cuts the tape into predetermined length and then writes summary information into the IC tag, a mechanism for transferring the printed tape from the cut portion to summary information writing means becomes necessary. Therefore, miniaturization of the tape printer becomes more difficult.

The disclosure has been made to solve the above problems and has a purpose to provide a tape printer capable of being miniaturized, which can read or write predetermined information from or into a wireless information circuit element provided on a printed tape, the wireless information circuit element including an IC circuit part for storing the predetermined information and an IC circuit side antenna connected to the IC circuit part to transmit and receive the information.

Means for Solving the Problems

In order to achieve the object above, there is provided a tape printer including a tape transfer means that transfers a long length of tape and a printing means that prints on the tape, the tape printer, to which a tape cassette accommodating the tape is mounted in a removable manner, comprising: a device side antenna; a read/write means that reads or writes predetermined information from or into a wireless information circuit element adhered to a printed tape printed by the printing means via the device side antenna by wireless communication, the wireless information circuit including an IC circuit part for storing the predetermined information and an IC circuit-side antenna connected to the IC circuit part to transmit and receive information, and wherein the tape cassette comprises a tape discharging port through which the printed tape is discharged, and the device side antenna is located downstream of the tape discharging port in a tape transferring direction.

The tape printer of the disclosure preferably comprises a cutting device that cuts the printed tape discharged through the tape discharging port, and wherein the device side antenna is located downstream of the cutting device in the tape discharging direction.

In the tape printer of the disclosure, preferably, the printed tape is provided with sensor marks arranged at a predetermined pitch on a back surface of the printed tape so as to have a predetermined relative positional relationship to the wireless information circuit element, and a detector sensor that is arranged downstream of the tape discharging port in the tape transferring direction and detects the sensor mark.

In the tape printer of the disclosure, preferably, the detector sensor is arranged so as to be opposed to the device side antenna interposing the printed tape.

The tape printer of the disclosure preferably comprises a first drive control device that carries out drive control of the transfer device and the read/write device in response to a detection information that the sensor mark has been detected by the detector sensor, and the first drive control device carries out drive control after input of the information of detecting the sensor mark so that the printed tape is transferred by a predetermined length and the read/write device reads or writes predetermined information from or into the wireless information circuit element.

The tape printer of the disclosure preferably comprises a second drive control device that carries out drive control of the printing device in response to the detection information that the sensor mark has been detected by the detector sensor, and the second drive control device carries out drive control after input of the detection information that the sensor mark has been detected so that the printing is executed by the printing device.

Effects of the Invention

In the tape printer of the disclosure, the device side antenna is located downstream of the tape transferring direction of the tape discharging port through which the printed tape of the tape cassette mounted to the tape printer is discharged. Further, it is possible to read predetermined information from the wireless information circuit element adhered to the printed tape via the device side antenna and the read/write device by wireless communication and the predetermined information can be also written into the wireless information circuit element.

Accordingly, when the tape printer is structured in a manner that the device side antenna is provided downstream of the tape transferring direction of the tape discharging port through which the printed tape of the tape cassette is discharged, it is possible to achieve miniaturization of the tape cassette and eventually miniaturization of the tape printer merely by structuring the tape cassette so that the wireless information circuit element is adhered to the printed tape. Further, predetermined information can be directly read or written via the device side antenna from or into the wireless information circuit element on the printed tape discharged through the tape discharging port of the tape cassette. Thus, a mechanism for transferring the printed tape to the device side antenna after cutting it in a predetermined length is not required, so that miniaturization of the tape printer can be easily achieved.

In the tape printer of the disclosure, when the device side antenna is located downstream of the tape transferring direction of the cutting device that cuts the printed tape discharged through the tape discharging port, it is possible to transfer the printed tape by a predetermined length and cut it after reading or writing predetermined information via the device side antenna from or into the wireless information circuit element adhered to the printed tape. Thus, the margin of the printed tape can be adequately cut, so that users do not need to cut the margin of the printed tape provided with the wireless information circuit element after creating, thereby achieving improvement in work efficiency.

In the tape printer of the disclosure, when the printed tape is provided with the sensor marks on the back surface at a predetermined pitch in a manner that the sensor mark and the wireless information circuit element are in a predetermined relative position in the tape transferring direction, or the detector sensor for detecting the sensor mark is located downstream of the tape discharging port of the tape cassette in the tape transferring direction, it is possible to detect the relative position of the wireless information circuit element adhered to the printed tape with respect to the detector sensor accurately, by detecting the sensor mark on the printed tape discharged through the tape discharging port by the detector sensor. Thus, it also becomes possible to detect the relative position of the wireless information circuit element and the device side antenna in the tape transferring direction.

In the tape printer, when the detector sensor is located so as to be opposed to the device side antenna interposing the printed tape, the distance between the detector sensor and the device side antenna in the tape transferring direction can be minimized. Thus, space for arranging the detector sensor and the device side antenna can be easily saved, so that further miniaturization of the tape printer can be achieved.

In the tape printer of the disclosure, the sensor marks are arranged on the back surface of the printed tape at a predetermined pitch so as to have a predetermined relative positional relationship with respect to the wireless information circuit element in the tape transferring direction. Thus, when the first drive control device carries out drive control after input of the detection information that the sensor mark has been detected so that the printed tape is transferred by a predetermined length and the read/write device reads or writes predetermined information from or into the wireless information circuit element, then it is possible to transfer the wireless information circuit element so as to be opposed to the device side antenna accurately, by transferring the printed tape by a predetermined length after detecting the sensor mark. Thus reliability of data transmission and reception can be improved. At the same time, an output power of the read/write device of the tape printer can be made small, thereby achieving lower power consumption of the read/write device.

In the tape printer of the disclosure, the sensor marks are arranged on the back surface of the printed tape at a predetermined pitch so as to have a predetermined relative positional relationship with respect to the wireless information circuit element in the tape transferring direction. Thus, when the second drive control device carries out drive control after input of the detection information that the sensor mark has been detected so as to print on the tape, it is possible to detect the relative positional relationship between the wireless information circuit element and the start position of printing can be known accurately by printing on the tape after detecting the sensor mark.

BRIEF DESCRIPTION OF DRAWINGS

FIG. 20 is a view showing one example of a parameter table, in which print control information as to each of models of tape printers stored in a memory part of the wireless tag circuit element of the tape cassette according to Embodiment 1;

FIG. 21 is a view showing one example of a cassette information table, in which information on tape cassettes stored in the memory part of the wireless tag circuit element of the tape cassette according to Embodiment 1;

FIG. 22 is an explanatory view of one example of performance of a thermal head mounted to each model of the tape printer according to Embodiment 1;

FIG. 23 is a flowchart of a control processing for setting print control parameters executed at the time when the tape printer according to Embodiment 1 is turned on;

FIG. 51 is a view showing one example of a parameter table, in which print control information as to each of models of tape printers stored in a memory part of a wireless tag circuit element of a tape cassette according to Embodiment 3;

FIG. 52 is a view showing one example of a cassette information table, in which information on tape cassettes stored in the memory part of the wireless tag circuit element of the tape cassette according to Embodiment 3;

FIG. 53 is a flowchart of a control processing for setting print control parameters executed at the time when the tape printer according to Embodiment 3 is turned on;

FIG. 72 is a view showing one example of a program table, in which print control information as to each of models of tape printers stored in a memory part of a wireless tag circuit element of a cassette according to Embodiment 12;

FIG. 73 is a flowchart of a control processing for setting print control programs executed at the time when the tape printer according to Embodiment 12 is turned on;

FIG. 74 is a view showing one example of a program table, in which print control information as to each of models of tape printers stored in a memory part of a wireless tag circuit element of a cassette according to Embodiment 13;

FIG. 75 is a flowchart of a control processing for setting print control programs executed at the time when a tape printer according to Embodiment 13 is turned on;

EXPLANATION OF REFERENCES

Figure 1:
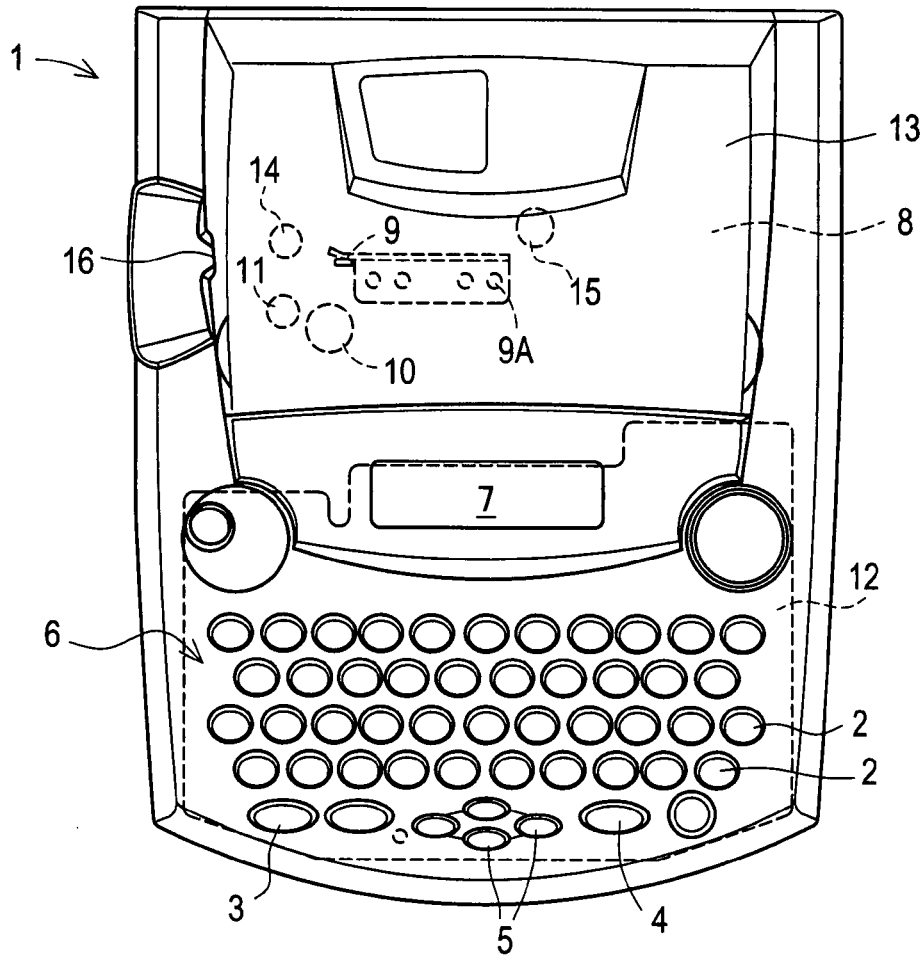
FIG. 1 is a schematic external view of a tape printer according to Embodiment 1 seen from above.

1 tape printer
6 keyboard
7 liquid crystal display
8 cassette housing part
8A side wall part
9 thermal head
10 platen roller
11 tape sub roller
14 tape driving roller shaft
15 ribbon take-up shaft
16 label discharging port
21, 141, 151, 195 tape cassette
24 outer peripheral wall surface
25, 32 wireless tag circuit element
26, 33, 68 antenna
28 printed label tape

27, 153 tape discharging port
30 cutter unit
35 reflective sensor
45, 46 location pin
47, 48 hole
49 space
51 film tape
52 ink ribbon
53 double-sided adhesive tape
63, 161, 162, 165, 167, 170, 175 tape feed roller
65 sensor mark
67 IC circuit part
71, 163, 171 stepwise part
71A, 163A tapered part
72, 176 cylindrical part
74, 172, 178 covering part
76, 155, 156 recess part
80 control circuit
81 CPU
83 ROM
85 RAM
84 flash memory
92 tape feed motor
93 read/write module
125 memory part
131, 135 parameter table
132, 136 cassette information table
141A, 195A bottom surface
145, 146, 196, 197 location hole
152 heat-sensitive tape
181, 182 program table

BEST MODE FOR CARRYING OUT THE INVENTION

Hereinafter, a tape cassette and a tape printer according to the disclosure will now be described in detail with reference to the drawings based on Embodiments 1 to 15.

Embodiment 1

First of all, a schematic structure of a tape printer according to Embodiment 1 will be described based on FIGS. 1 to 8.

Figure 2:
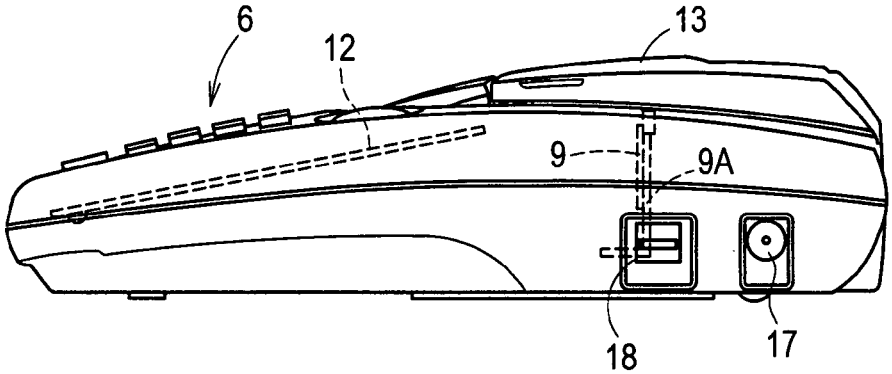
FIG. 2 is a schematic external view of the tape printer according to Embodiment 1 seen from the right side.
Figure 3:
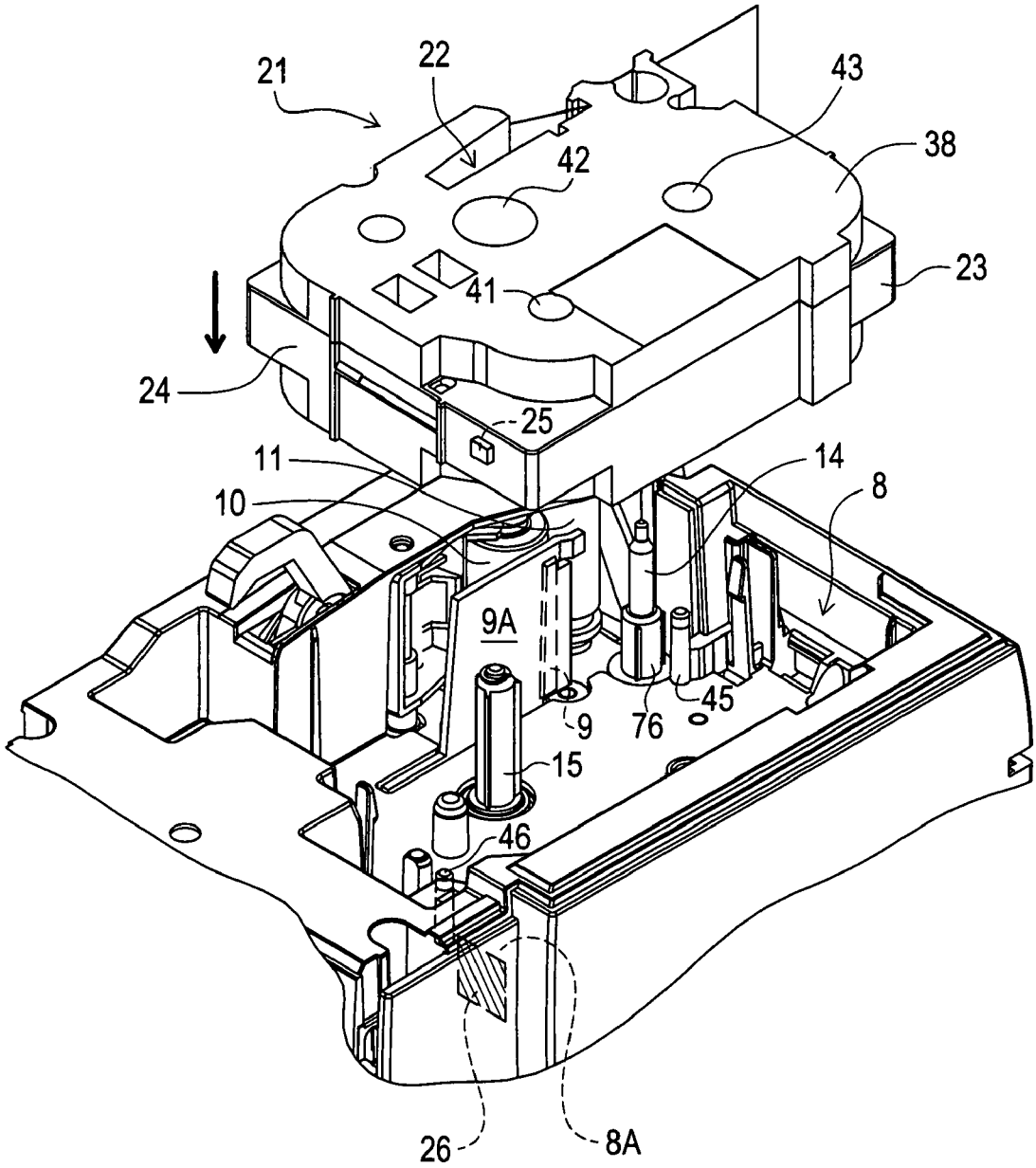
FIG. 3 is a partial enlarged perspective view of the tape printer according to Embodiment 1 and a tape cassette, which is being mounted to a cassette housing part of the tape printer.

As shown in FIGS. 1 to 3, a tape printer 1 according to Embodiment 1 is formed with a keyboard 6 including character input keys 2 for creating a text consisting of document data, a print key 3 for instructing to print texts and the like, a return key 4 for instructing to execute and select a line feed command and various kinds of processing, and cursor keys 5 for moving a cursor vertically and horizontally on a liquid crystal display (LCD) 7 that displays characters such as letters over plural lines, and the like. The tape printer 1 is also formed with a cassette housing part 8 for housing a tape cassette 21 therein and covered with a housing cover 13. Under the keyboard 6, a control board 12 on which a control circuit is constituted is provided. Further, on the left side surface of the cassette housing part 8, a label discharging port 16 for discharging a printed tape is formed. On the right side surface of the cassette housing part 8, an adaptor inserting opening 17 to which a power supply adaptor is attached, and a connector 18 to which a USB cable for connection with an unillustrated personal computer are formed.

The cassette housing part 8 further includes a thermal head 9, a platen roller 10 opposed to the thermal head 9, a tape sub-roller 11 located downstream of the platen roller 10, and a metallic tape driving roller shaft 14 opposed to the tape sub-roller 11. The cassette housing part 8 also includes a ribbon take-up shaft 15 for feeding an ink ribbon housed in the tape cassette 21.

The thermal head 9 is in the shape of a substantially longitudinally rectangular flat plate when viewed from its front. At the left edge portion on the front surface of the thermal head 9, a predetermined number of heating elements R1 to Rn (n is 128 or 256, for example) are formed in a state of being arranged into one line along the side of the left edge portion. The thermal head 9 is firmly bonded by a bonding agent to the left edge portion on the front surface of a radiator plate 9A made of a plated steel plate or a stainless steel plate and the like in the shape of substantially rectangle when viewed from its front in such a manner that the heating elements R1 to Rn are arranged in the direction parallel to the side of the left edge portion of the radiator plate 9A. The radiator plate 9A is attached to the lower side of the cassette housing part 8 by fixation with screws in such a manner that the heating elements R1 to Rn are arranged in the direction substantially orthogonal to the direction of transferring the film tape 51 (see FIG. 4) at an opening 22 of the tape cassette 21.

The ribbon take-up shaft 15 is rotated via a proper driving mechanism by the tape feed motor 92 (see FIG. 17) constituted by a later-described stepping motor and the like. A tape driving roller shaft 14 is rotated via a proper transmission mechanism by the tape feed motor 92, so as to drive a later-described conductive resin tape feed roller 63 (see FIG. 4) to rotate.

Figure 4:
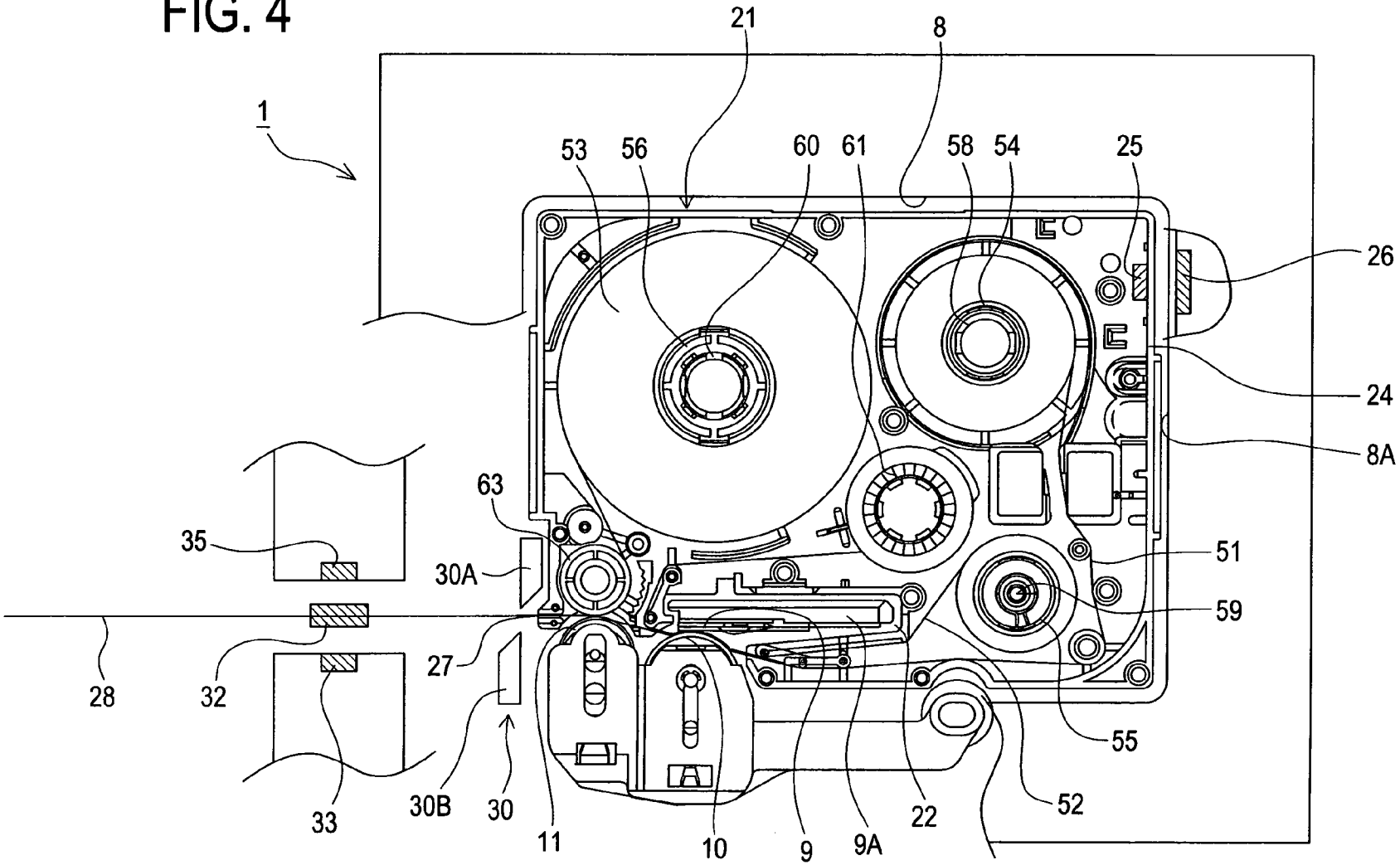
FIG. 4 is a partial enlarged plain view of the tape printer according to Embodiment 1 and the tape cassette mounted to the cassette housing part in the case where an upper case of the tape cassette is removed.

Further, as shown in FIGS. 3 and 4, on an outer peripheral side wall surface 24 of a lower case 23 of the tape cassette 21 mounted to the cassette housing part 8 from above, at a center position in the height direction of the tape cassette 21 of the outer peripheral side wall surface 24, a wireless tag circuit element 25 that stores information about the tape cassette 21 is provided. On a side wall part 8A of the cassette housing part 8 opposed to the wireless tag circuit element 25, an antenna 26 for transmitting and receiving signals to and from the wireless tag circuit element 25 by wireless communication using high frequencies such as UHF bands is provided.

Further, as shown in FIG. 4, in the vicinity of the tape discharging port 27 of the tape cassette 21, there is provided a scissors-type cutter unit 30 for cutting a printed label tape 28 into predetermined length at a predetermined timing as will be described later to create a wireless tag label in the shape of an ordinary label (the details thereof will be described later). The cutter unit 30 includes a fixed blade 30A, and a movable blade 30B moved against the fixed blade 30A by a later-described cutting motor 96 to cut the printed label tape 28.

Further, at the downstream of the tape discharging direction of the cutter unit 30, there is provided an antenna 33 for transmitting and receiving signals to and from the wireless tag circuit element 32 provided at the printed label tape 28 by wireless communication using high frequencies such as UHF bands. At the opposite side of the antenna 33 interposing the printed label tape 28, there is provided a reflective sensor 35 for optically detecting sensor marks 65 (see FIG. 9) printed on the back surface of the printed label tape 28 as will be described later.

Further, as shown in FIGS. 3 and 4, the tape cassette 21 includes an upper case 38 and the lower case 23. The tape cassette 21 is formed with a supporting hole 41 for rotatably supporting a tape spool 54 winding the film tape 51 as a printing tape therearound, a supporting hole 42 for supporting an ink ribbon take-up spool 61 which draws an ink ribbon 52 from a ribbon spool 55 and winds it up therearound at the time when the thermal head 9 prints letters and the like onto the film tape 51, and a supporting hole 43 for rotatably supporting a tape spool 56 which winds up a release paper 53D (see FIG. 11) of a double-sided adhesive tape 53 facing outward, the double-sided adhesive tape 53 including the release paper printed with the sensor marks 65 at a predetermined pitch on its back surface and a base member tape previously provided with a wireless tag circuit element 32 as will be described later.

Although FIG. 3 illustrates only the supporting holes 41, 42, and 43 formed on the upper case 38, the lower case 23 is similarly formed with supporting holes 41, 42, and 43 opposed to the supporting holes 41, 42, and 43 of the upper case 38.

Figure 6:
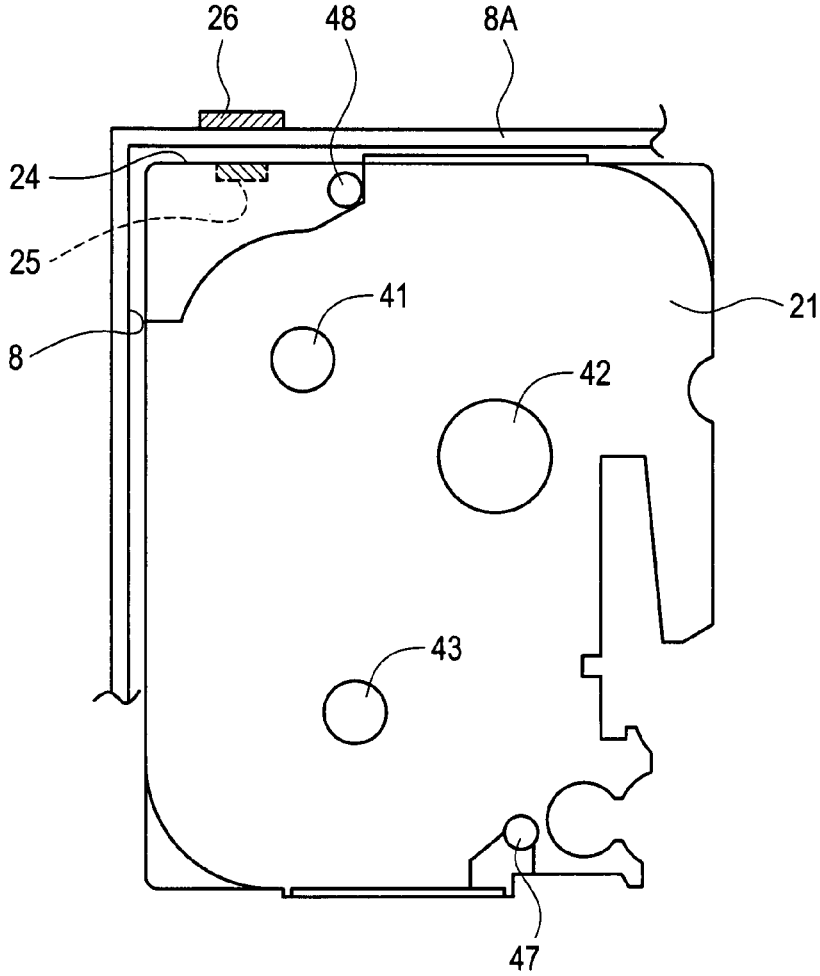
FIG. 6 is a plain view showing relative positional relationship between the wireless tag circuit element and the antenna when the tape cassette is mounted to the cassette housing part of the tape printer according to Embodiment 1.
Figure 7:
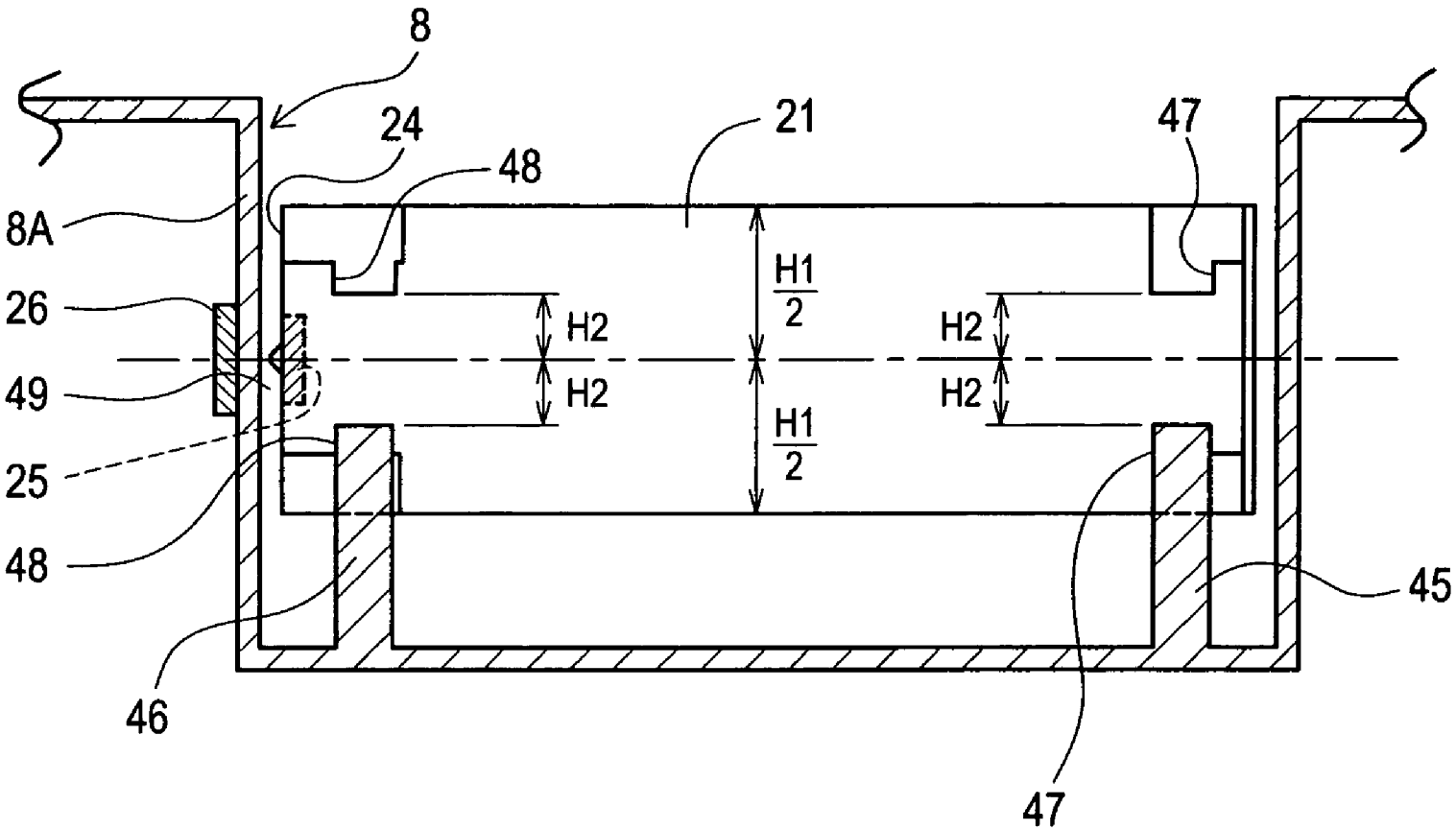
FIG. 7 is a sectional side view showing relative positional relationship between the wireless tag circuit element and the antenna when the tape cassette is mounted to the cassette housing part of the tape printer according to Embodiment 1.

As shown in FIGS. 6 and 7, on the opposed surfaces of the tape cassette 21, holes 47, 48 are respectively formed to be symmetric in a vertical direction. When the tape cassette 21 is mounted to the cassette housing part 8, two location pins 45, 46 disposed at the same height with each other in an upright posture on the bottom surface of the cassette housing part 8 are inserted and fitted into the holes 47, 48, so that the top end portions of the location pins 45, 46 are brought into contact with the bottom surface of the holes 47, 48. In this manner, the tape cassette 21 can be properly positioned within the cassette housing part 8 via the location pins 45, 46 and the holes 47, 48 in any cases of front loading and bottom loading.

Further, as shown in FIG. 4, within the tape cassette 21, there are provided a film tape 51 which is a printing tape made of a transparent tape and the like, an ink ribbon 52 for printing on the film tape 51, and a double-sided adhesive tape 53 attached to the back surface of the printed film tape 51 in the state where these tapes are respectively wound around a tape spool 54, a ribbon spool 55, and a tape spool 56, and these spools are respectively rotatably fitted and inserted into a cassette boss 58, a reel boss 59, and a cassette boss 60 disposed on the bottom surface of the lower case 23 in an upright posture. The tape cassette 21 also includes the ink ribbon take-up spool 61 for taking up the ink ribbon 52 after use.

The ink ribbon 52 before use wound around the ribbon spool 55 is drawn out from the ribbon spool 55 and is overlapped with the film tape 51, and enters the opening 22 together with the film tape 51, and then, passes between the thermal head 9 and the platen roller 10. After that, the ink ribbon 52 is peeled off from the film tape 51, and reaches the ink ribbon take-up spool 61 which is driven to rotate by the ribbon take-up shaft 15, and the ink ribbon 52 is taken up around the ink ribbon take-up spool 61.

Further, the double-sided adhesive tape 53 is housed in a state of being wound around the tape spool 56 with the release paper 53D overlapped on one side and facing outward. The double-sided adhesive tape 53 drawn out from the tape spool 56 passes between the tape feed roller 63 and the tape sub-roller 11 where the adhesive surface having no release paper 53D is pressed against the film tape 51.

In this manner, the film tape 51 wound around the tape spool 54 and drawn out from the tape spool 54 passes through the opening 22 into which the thermal head 9 of the tape cassette 21 is inserted. After that, the printed film tape 51 passes between the tape feed roller 63 which is rotatably provided to the lower part at one side of the tape cassette 21 (lower-left part in FIG. 4) and is driven to rotate by the tape feed motor 92, and the tape sub-roller 11 disposed to be opposed to the tape feed roller 63. Then, the printed film tape 51 is sent out of the tape cassette 21 through the tape discharging port 27, and is discharged via the cutter unit 30, the antenna 33 and the reflective sensor 35 from the label discharging port 16 of the tape printer 1. In this case, the double-sided adhesive tape 53 is pressed against the film tape 51 by the tape feed roller 63 and the tape-sub roller 11.

Next, a relative positional relationship between the wireless tag circuit element 25 and the antenna 26 when the tape cassette 21 is mounted to the cassette housing part 8 will be described based on FIGS. 5 to 8.

Figure 5:
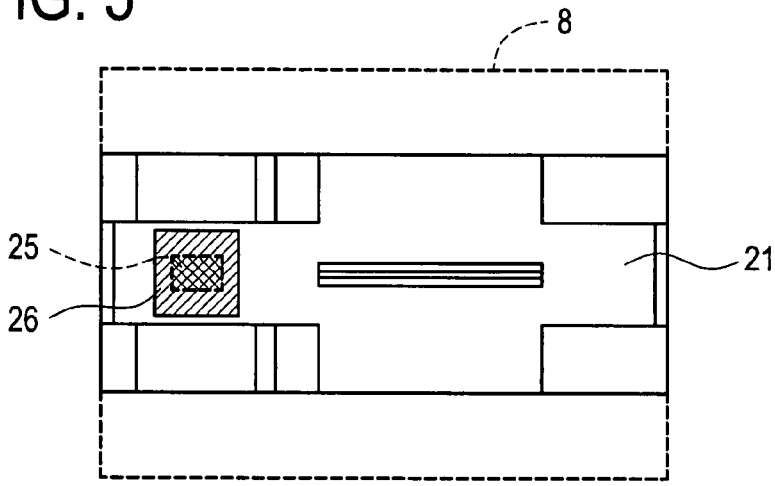
FIG. 5 is a side view showing relative positional relationship between a wireless tag circuit element and an antenna when the tape cassette is mounted to the cassette housing part of the tape printer according to Embodiment 1.

As shown in FIGS. 5 to 7, the holes 47, 48 are formed on opposite surfaces of the tape cassette 21 so as to be symmetric to each other in a vertical direction. When the tape cassette 21 is mounted to the cassette housing part 8, the location pins 45, 46 disposed at the same height with each other in an upright posture on the bottom surface of the cassette housing part 8 are inserted and fitted into holes 47, 48, so that the top end portions of the location pins 45, 46 are brought into contact with the bottom surface of the holes 47, 48. The bottom surfaces of the individual holes 47, 48 are situated at positions distanced by H2 from the center position in the height direction of the tape cassette 21. The wireless tag circuit element 25 is disposed to locate at a center position in the height direction of the tape cassette 21 of the outer peripheral wall surface 24 of the tape cassette 21. On the other hand, the antenna 26 provided on the side wall part 8A of the cassette housing part 8 is disposed at a position distanced by H2 in the height direction from the top end portions of the location pins 45, 46 and opposed to the wireless tag circuit element 25. When the tape cassette 21 is mounted to the cassette housing part 8, a space 49 having a narrow gap (for example, a gap of about 0.3 to 3 mm) is created between the outer peripheral side wall surface 24 of the tape cassette 21 and the side wall part 8A of the cassette housing part 8. In this gap, there is no conductive plate member and the like which will obstruct signal transmission and reception between the antenna 26 and the wireless tag circuit element 25 disposed to oppose to each other. In this manner, excellent signal transmission and reception can be achieved between the antenna 26 and the wireless tag circuit element 25.

Figure 8:
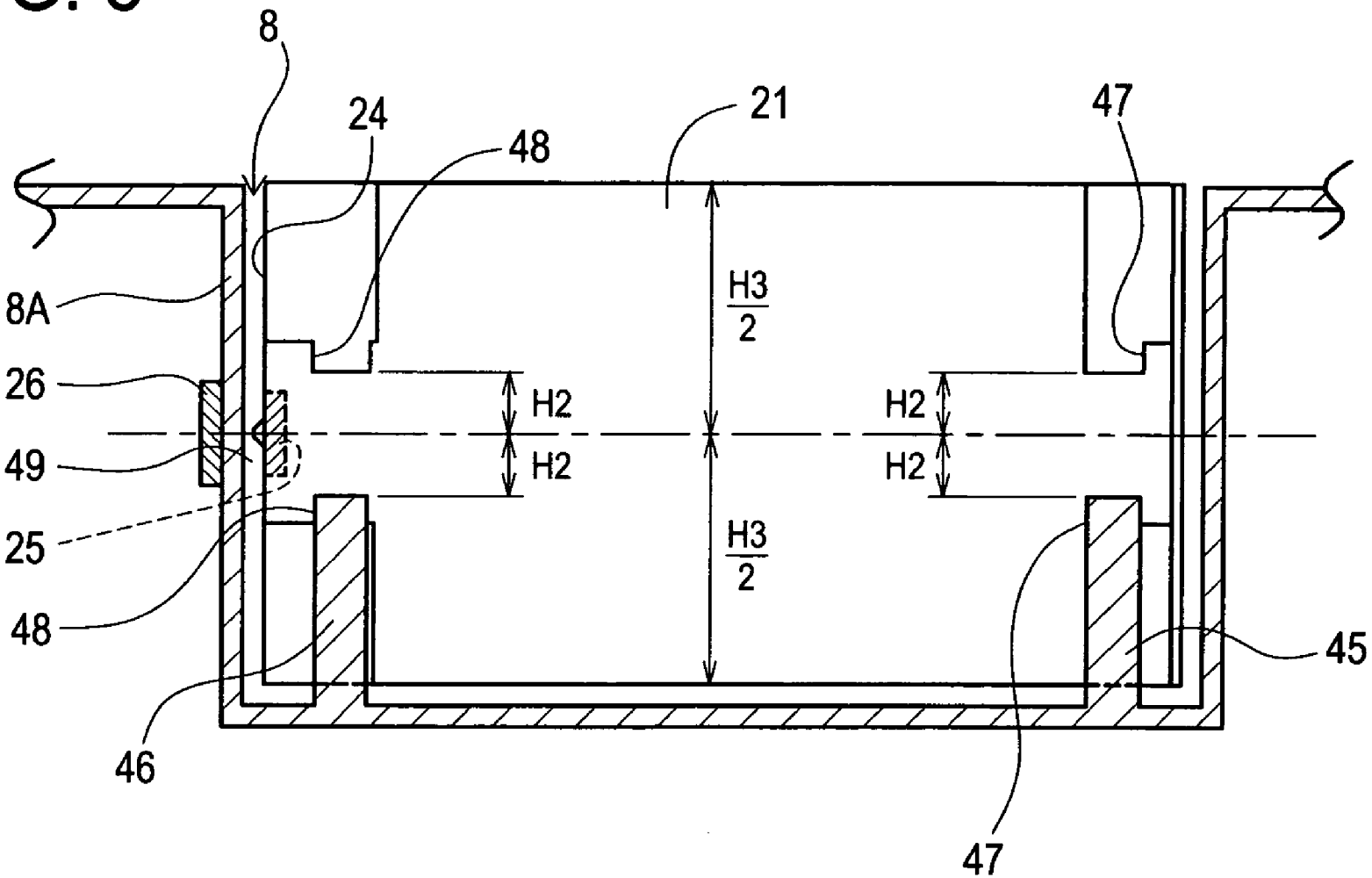
FIG. 8 is a sectional side view showing relative positional relationship between the wireless tag circuit element and the antenna when another tape cassette having a wider tape width is mounted to the cassette housing part of the tape printer according to Embodiment 1.

Further, as shown in FIG. 8, also in the case of the tape cassette 21 having a different tape width (for example a tape width of 24 mm), the holes 47, 48 having bottom surfaces to which the top end portions of the location pins 45, 46 are brought into contact are formed, as is the case of the tape cassette 21 shown in FIG. 7 (for example, a tape width of 12 mm). The bottom surfaces of the holes 47, 48 are formed at position distanced by H2 from the center position in the height direction of the tape cassette 21. Then, the wireless tag circuit element 25 is located at a center position in the height direction of the tape cassette 21 on the outer peripheral side wall surface 24 of the tape cassette 21 and opposed to the antenna 26. In this manner, even if the tape cassette 21 having a different tape width (for example, a tape width of 24 mm) is mounted to the cassette housing part 8, a space 49 having a narrow gap (for example, a gap of about 0.3 mm to 3 mm) is created between the outer peripheral wall surface 24 of the tape cassette 21 and the side wall part 8A of the cassette housing part 8. In this gap, there is no conductive plate member and the like which will obstruct signal transmission and reception between the antenna 26 and the wireless tag circuit element 25 disposed to oppose to each other. In this manner, excellent signal transmission and reception can be achieved between the antenna 26 and the wireless tag circuit element 25.

In the case where the holes 47, 48 are formed on either one of the lower case 23 and the upper case 38 of the tape cassette 21, the wireless tag circuit element 25 is disposed at a position offset by a predetermined distance from the center position in the height direction of the tape cassette 21, and the antenna 26 is disposed at a position also offset by a predetermined distance from the center position in the height direction of the tape cassette 21, so as to be opposed to the wireless tag circuit element 26. In this manner, even if the tape cassette 21 is mounted to the cassette housing part 8, a space 49 having a narrow gap (for example, a gap of about 0.3 mm to 3 mm) is created between the outer peripheral wall surface 24 of the tape cassette 21 and the side wall part 8A of the cassette housing part 8. In this gap, there is no conductive plate member and the like which will obstruct signal transmission and reception between the antenna 26 and the wireless tag circuit element 25 disposed to oppose to each other. In this manner, excellent signal transmission and reception can be achieved between the antenna 26 and the wireless tag circuit element 25.

Next, a positional relationship between the sensor marks printed on a back surface of a release paper of the double-sided adhesive tape 53 and the wireless tag circuit element 32 will be described based on FIGS. 9 and 10.

Figure 9:
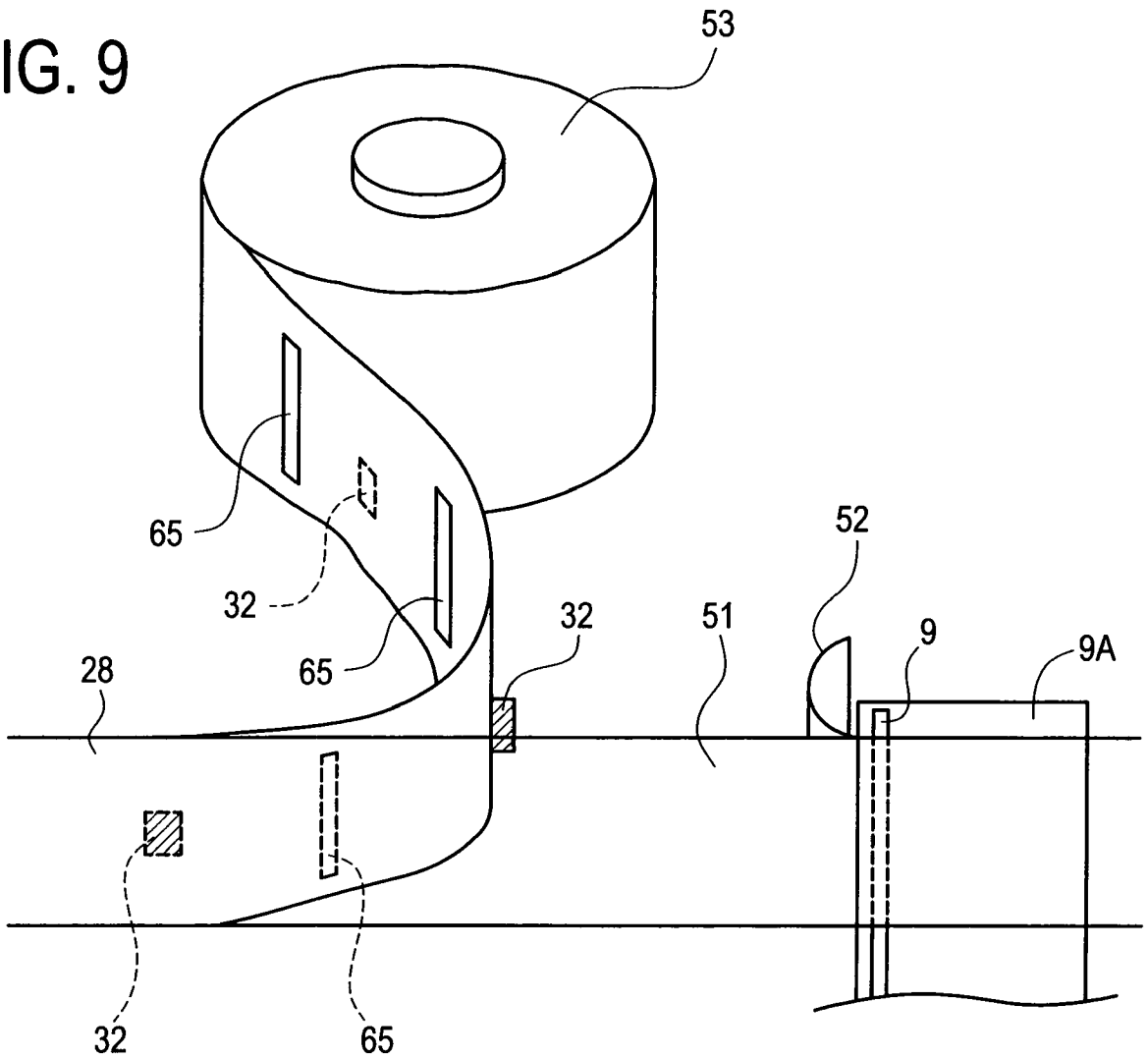
FIG. 9 is a schematic diagram showing a state where a double-sided adhesive tape is pressed and adhered to a printed film tape of the tape cassette according to Embodiment 1.
Figure 10:
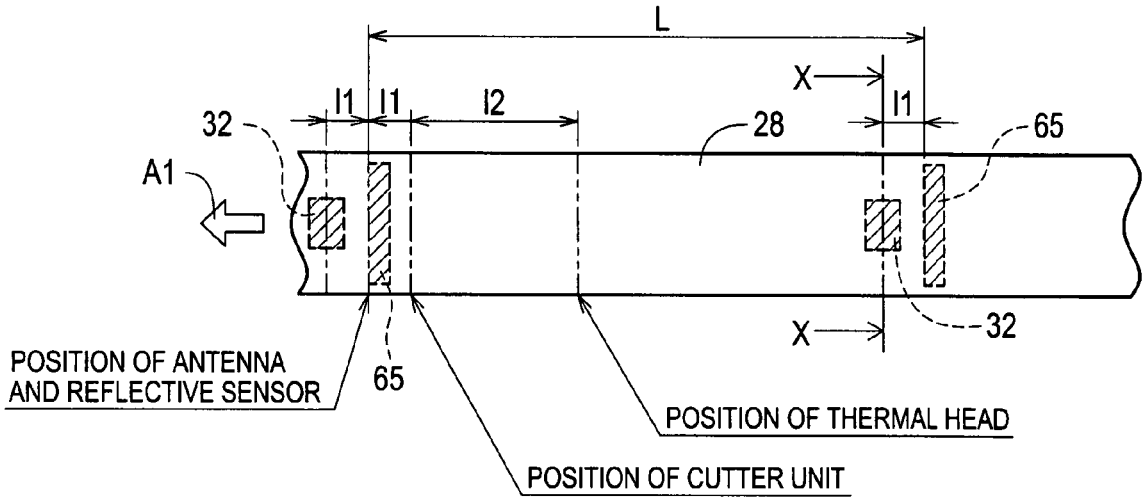
FIG. 10 is a schematic diagram showing relative positional relationship between a sensor mark, which is printed on the back surface of a base member tape of the double-sided adhesive tape of the tape cassette according to Embodiment 1, and a wireless tag circuit, which is contained in the base member tape.

As shown in FIGS. 9 and 10, on the back surface of the release paper of the double-sided adhesive tape 53, sensor marks 65 each in a rectangular shape elongated in the tape width direction when viewed from its front are printed beforehand at a predetermined pitch L along the tape transferring direction to be vertical and symmetric with each other with respect to the center line in the tape width direction. Further, on the double-sided adhesive tape 53, wireless tag circuit elements 32 are provided. Each wireless tag circuit element 32 is located between adjacent sensor marks 65 on the center line in the tape width direction and at a position equal to the distance l1 from each sensor mark 65 in the tape discharging direction (a direction shown by an arrow A1). In this manner, on the double-sided adhesive tape 53, the wireless tag circuits 32 are mounted beforehand at a predetermined pitch L on the center line in the tape width direction and along the tape transferring direction. Even if the tape width differs, the wireless tag circuit elements 32 are still located on the center line of the tape width direction.

On the other hand, the antenna 33, the reflective sensor 35 and the cutter unit 30 are distanced from each other by a distance l1 in the tape transferring direction. The cutter unit 30 and the thermal head 9 are distanced from each other by a distance l2 in the tape transferring direction.

Therefore, when the sensor mark 65 of the printed label tape 28 has reached the position opposed to the antenna 33 and the reflective sensor 35, the cutter unit 30 will oppose to the position at the side of the tape cassette 21 from the sensor mark 65, that is, at the position of the tape length l1 upstream from the sensor mark 65 in the transferring direction. Further, the thermal head 9 is located at a position of the tape length (l1+l2) upstream from the sensor mark 65 in the transferring direction, and will oppose to the film tape 51 overlapped with the ink ribbon 52. When the wireless tag circuit element 32 of the printed label tape 28 has reached the position opposed to the antenna 33 and the reflective sensor 35, the side edge portion of the sensor mark 65 in the tape discharging direction (in a direction along an arrow A1) will oppose to the cutter unit 30.

Here, a schematic structure of the printed label tape 28 will be described based on FIG. 11.

Figure 11:
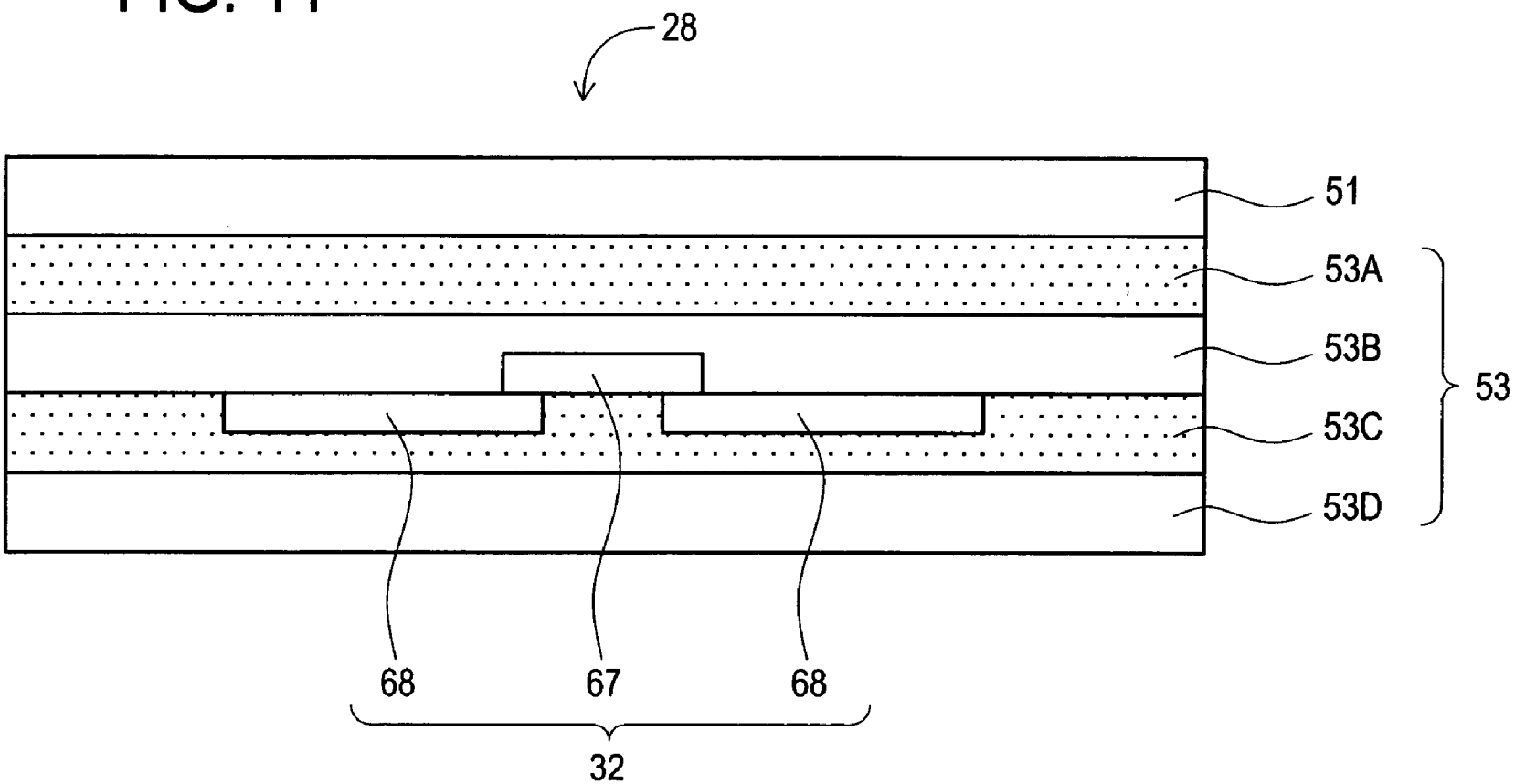
FIG. 11 is a cross-sectional view of FIG. 10 taken along the line X-X.

As shown in FIG. 11, the printed label tape 28 includes a four-layered double-sided adhesive tape 53 and a film tape 51 adhered to each other.

On the back surface of the film tape 51, predetermined characters such as predetermined letters, marks, bar codes and the like are printed (since these characters are printed from the back surface, they are printed in the state of being mirror-symmetric when viewed from the printing side).

Further, the layers of the double-sided adhesive tape 53 are an adhesive layer 53A, a colored base film 53B made of polyethylene terephthalate (PET) and the like, an adhesive layer 53C including an adhesive member for adhering the wireless tag circuit element 32 to the target to which the wireless tag circuit member 32 is to be adhered, and a release paper 53D that covers the adhesion side of the adhesive layer 53C. These layers are laminated on one after another in this order from the upper side toward the lower side in FIG. 11.

Further, on the back side (lower side in FIG. 11) of the base film 53B, IC circuit parts 67 for storing information are integrally incorporated at a predetermined pitch L as described above. On the back surface of the base film 53B, there is provided an antenna (IC circuit-side antenna) 68 connected to the IC circuit part 67 for transmitting and receiving information from and to the IC circuit part 67. The IC circuit part 67 and the antenna 68 together constitute the wireless tag circuit element 32 (the wireless tag circuit element 25 is similarly constituted).

Further, on the front side (upper side in FIG. 11) of the base film 53B, there is formed an adhesive layer 53A to which the film tape 51 is adhered. On the back side of the base film 53B, a release paper 53D is adhered to the base film 53B by the adhesive layer 53C.

Further, the release paper 53D is structured in such a manner that, when the printed label tape 28 is finally finished into a label state and is adhered onto a predetermined article and the like, the release paper 53D is peeled off to adhere the printed label tape 28 to the article by the adhesive layer 53C. On the back surface of the release paper 53D, the sensor marks 65 are printed at a predetermined pitch L beforehand as described above.

Next, a schematic structure of the tape feed roller 63 will be described based on FIGS. 12 to 14.

Figure 12:
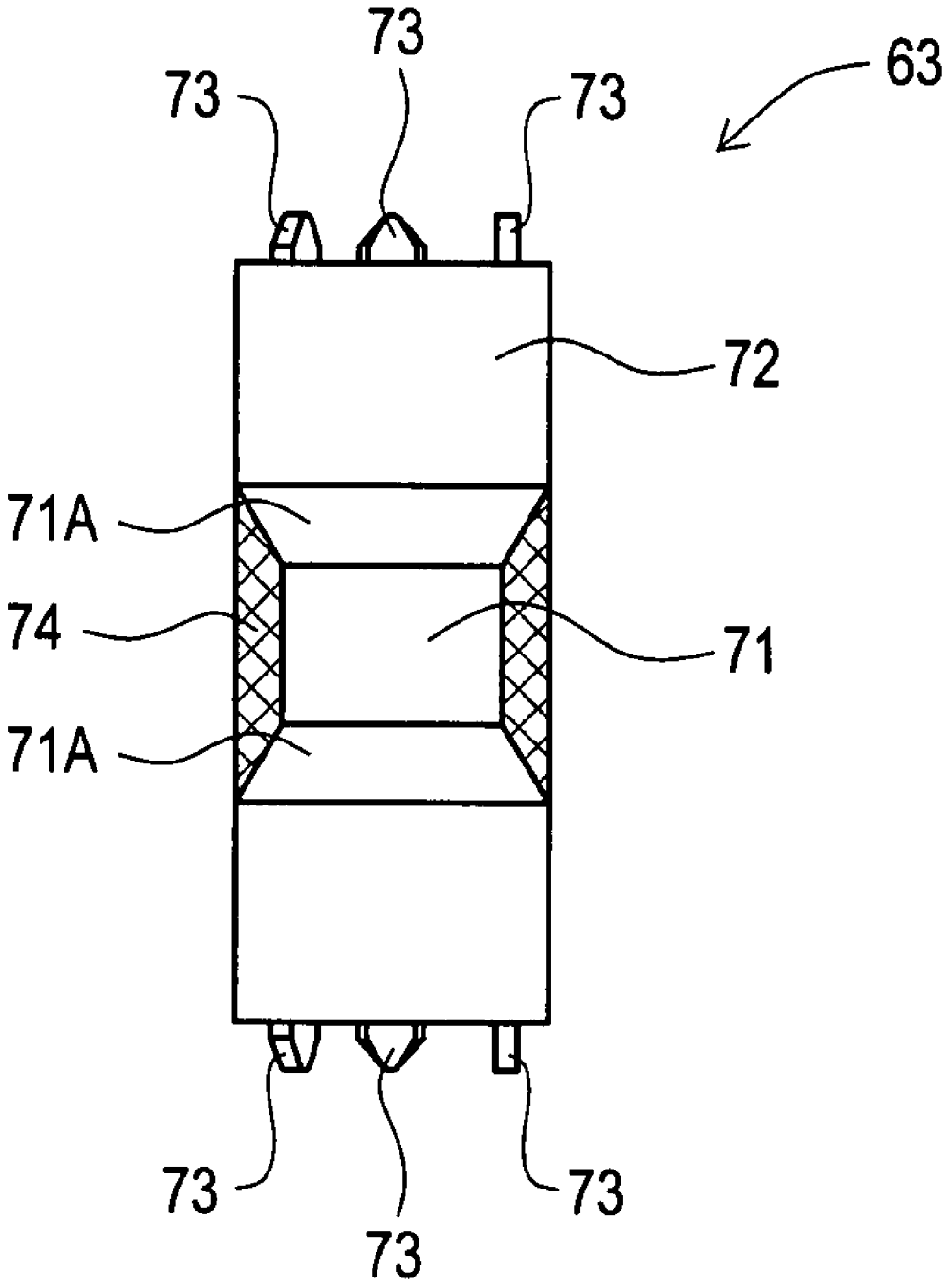
FIG. 12 is a partial cutaway front view of a tape feed roller of the tape cassette according to Embodiment 1.
Figure 13:
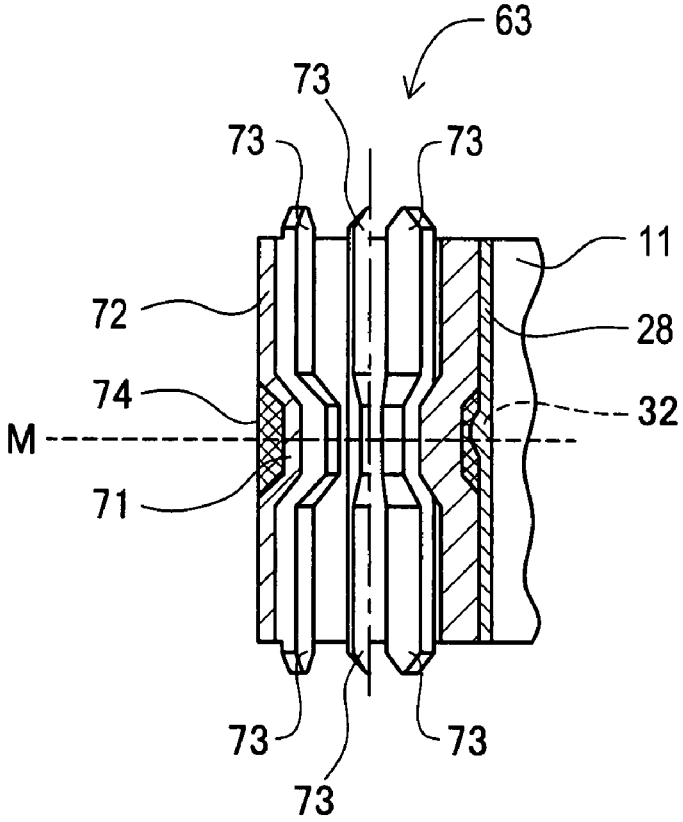
FIG. 13 is a cross-sectional view of the tape feed roller of the tape cassette according to Embodiment 1 when a tape sub roller is pressed thereto.
Figure 14:
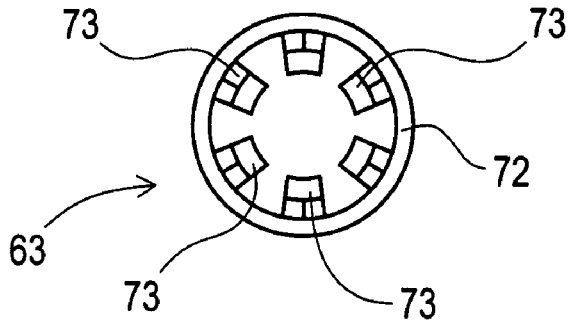
FIG. 14 is a plain view of the tape feed roller of the tape cassette according to Embodiment 1.

As shown in FIGS. 12 to 14, the tape feed roller 63 made of a conductive plastic material is formed with a stepwise part 71 narrowed by a predetermined width dimension toward its center in the axial direction. The tape feed roller 63 also includes a cylindrical part 72 in a substantially cylindrical shape formed with a tapered part 71A in a tapered shape at the opposite edge portions in the axial direction of the stepwise part 71, a plurality of drive ribs 73 formed radially from the inner wall of the cylindrical part 72 toward the center thereof, and a covering part 74 made of substantially ring-shaped conductive elastic member such as conductive sponge or conductive rubber and wound around the outer peripheral portion of the stepwise part 71 and the opposite tapered parts 71A and having an outer peripheral diameter substantially equal to the outer peripheral diameter of the cylindrical part 72.

Here, the drive ribs 73 are formed into plural pieces on the respective opposite sides of the center position M in such a manner that they are symmetric to each other vertically with respect to the center position of the cylindrical part 72 in the vertical direction (illustrated by a broken line M in FIG. 13). Further, each drive rib 73 is engaged with a cam member 76 (see FIG. 3) of the tape driving roller shaft 14 provided in the cassette housing part 8 of the tape printer 1. The tape feed roller 63 is rotated in cooperation between the cam member 76 and each drive rib 73 as the tape driving roller shaft 14 spins. Each drive rib 73 is in contact with a metallic tape driving roller shaft 14 at the center position M in the axial direction. The tape driving roller shaft 14 is connected to a metallic or conductive resin frame (not shown) that constitutes a mechanical part, and has the same potential as the tape feed roller 63. The frame is connected to the ground of the power supply circuit part, and thus, is protected from static electricity. In this manner, damage of the wireless tag circuit element 32 due to static electricity can be prevented.

In the manner as described above, in cooperation with the tape sub-roller 11, the tape feed roller 63 adheres the double-sided adhesive tape 53 to the printed film tape 51 to create the printed label tape 28, and at the same time, feeds the printed label tape 28 out of the tape cassette 21 from the tape discharging port 27. Further, the tape feed roller 63 is formed with, at its center in the axial direction, the stepwise part 71 formed with the tapered parts 71A at the opposite edge parts in the axial direction, and the covering part 74 made of an elastic member is wound around the stepwise part 71. When the portion of the printed label tape 28 where the wireless tag circuit element 32 is formed is brought into contact with the tape sub-roller 11, the outer peripheral portion of the tape feed roller 63 at the covering part 74 to which the portion of the wireless tag circuit element 32 is brought into contact recesses inwardly to prevent the wireless tag circuit element 32 from damage. At the same time, due to the cooperation between the cylindrical part 72, the covering part 74, and the tape sub-roller 11 the entire surface of the printed label tape 28 can be pressed and adhered assuredly.

Further, since the drive ribs 73 are provided to be vertically symmetric to each other on the opposite sides of the center position M, in both of the cases of the front loading where the tape driving roller shaft 14 is inserted from bottom of the tape feed roller 63 and the bottom loading where the tape driving roller shaft 14 is inserted from above of the tape feed roller 63, the cam member 76 of the tape driving roller shaft 14 can be engaged with the drive ribs 73.

Figure 15:
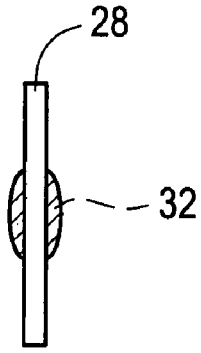
FIG. 15 is a side view of the printed label tape created by the tape printer according to Embodiment 1.

Next, a structure of the tape discharging port 27 of the tape cassette 21 will be described based on FIGS. 15 and 16.

Figure 16:
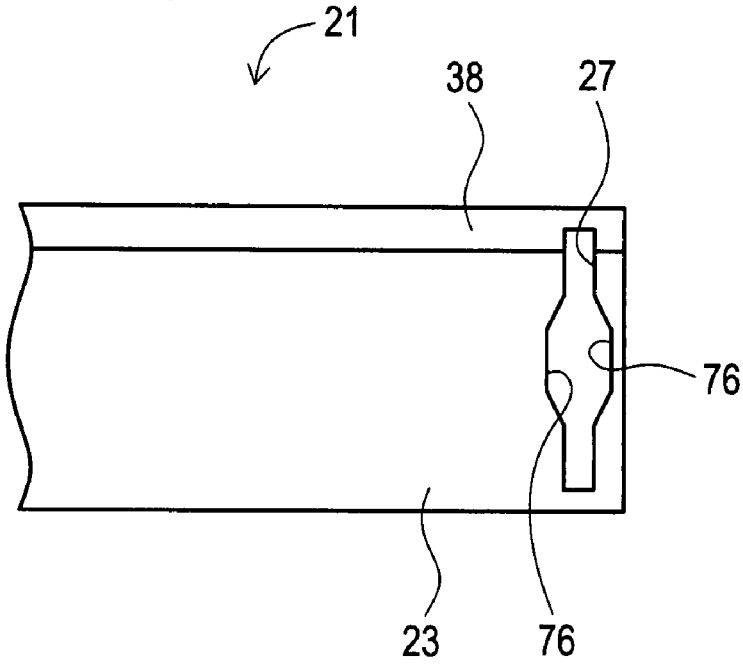
FIG. 16 is a partial enlarged front view of a tape discharging port of the tape cassette according to Embodiment 1.

As shown in FIG. 16, the tape discharging port 27 through which the printed label tape 28 is discharged out of the tape cassette 21 is formed into a vertically elongated slit shape when seen from the front through which the printed label tape 28 passes. At the same time, its opposite edge portions opposing to the center in the tape width direction are cut away outwardly into a predetermined width dimension in the height direction (vertically in FIG. 13) to form recessed parts 76, 76. In this manner, as shown in FIG. 15, even if the portion of the printed label tape 28 where the wireless tag circuit element 32 is to be disposed projects outwardly, the printed label tape 28 is never caught with the tape discharging port 27 when the printed label tape 28 is discharged out of the tape cassette 21. Thus, the slit width can be easily narrowed and the printed label tape 28 can be discharged smoothly.

Next, a circuit configuration of the tape printer 1 will be described based on FIG. 17.

Figure 17:
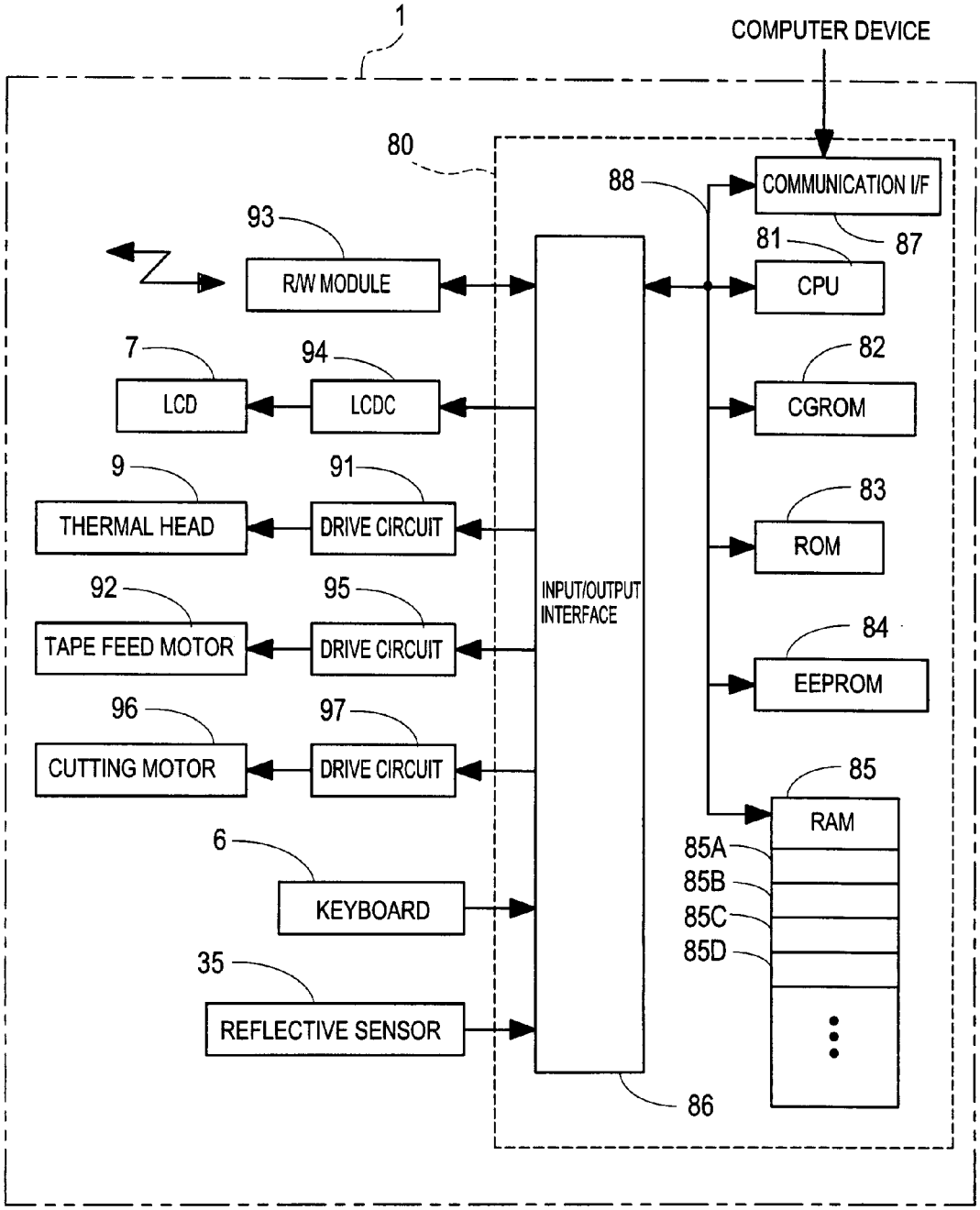
FIG. 17 is a block diagram showing a control configuration of the tape printer according to Embodiment 1.

As shown in FIG. 17, a control circuit 80 formed on a control board 12 of the tape printer 1 includes a CPU 81, a character generator (CG) ROM 82, a ROM 83, a flash memory (EEPROM) 84, a RAM 85, an input/output interface (I/F) 86, a communication interface (I/F) 87 and the like. Further, the CPU 81, the CGROM 82, the ROM 83, the flash memory 84, the RAM 85, the input/output interface (I/F) 86 and the communication interface (I/F) 87 are connected to each other by bus lines 88 to exchange data.

Here, the CGROM 82 stores dot pattern data corresponding to each character. The dot pattern data is read from the CGROM 82, and a dot pattern is displayed on a liquid crystal display (LCD) 7 based on the dot pattern data.

Further, the ROM 83 is to store various programs. As will be described later, the ROM 83 stores beforehand a processing program for reading information related to the tape cassette 21 from the wireless tag circuit element 25 of the tape cassette 21 and setting the printing conditions, a processing program for writing predetermined information into the wireless tag circuit element 32 of the printed label tape 28 and then, cutting the printed label tape 28, and the like.

Then, the CPU 81 executes various calculations based on the various programs stored in the ROM 83. Further, the ROM 83 stores printing dot pattern data as to each of a large number of characters for printing characters such as alphabets, numbers, marks and the like in the state where the printing dot pattern data are classified into each of typefaces (Gothic typeface, Mincho typeface, or the like) in the number of plural kinds of printed letter sizes (dot sizes of 16, 24, 32, 48, or the like) for each type face in correspondence with code data. The ROM 83 also stores graphics pattern data for printing graphics images including gradient representations. Further, the ROM 83 also stores a display drive control program for controlling a liquid crystal display controller (LCDC) 94 in correspondence with the code data of the character such as a letter, number, and the like inputted from the keyboard 6, a printing drive control program for reading data of a printing buffer 85A to drive the thermal head 9 and the tape feed motor 92, and other various programs necessary for controlling the tape printer 1.

Further, the flash memory 84 stores information data read from the wireless tag circuit element 25 of the tape cassette 21 via a read/write module 93, print data received from an external computer via a connector 18, and dot pattern data of various design data by assigning registration numbers to these data. The flash memory 84 holds these stored contents even after the tape printer 1 is turned off.

Further, the RAM 85 is to temporarily store the results of various calculations made by the CPU 81. Further, the RAM 85 includes various memory areas such as a print buffer 85A, an editing input area 85B, a display image buffer 85C, a work area 85D and the like. The print buffer 85A stores a plurality of dot patterns for printing characters and symbols as dot pattern data. The print buffer 85A also stores applied pulse counts representing energy amounts for forming individual costs. The thermal head 9 performs dot printing in accordance with the dot pattern data stored in thus-structured print buffer 85A. Further, the editing input area 85B stores editing text as label data such as text data inputted from the keyboard 6. Further, the display image buffer 85C stores graphic data to be displayed on the liquid crystal display 7.

Further, to the input/output I/F 86, the keyboard 6, the reflective sensor 35, a read/write module (R/W module) 93 for reading and writing information of the individual wireless tag circuit elements 25, 32, a display controller (LCDC) 94 including a video RAM for outputting display data to the liquid crystal display (LCD) 7, a drive circuit 91 for driving the thermal head 9, a drive circuit 95 for driving the tape feed motor 92, and a drive circuit 97 for driving the cutting motor 96 are connected.

Further, the communication I/F 87 is constituted by a universal serial bus (USB) and the like, and is connected with an external computer by a USB cable so that bidirectional communication is enabled.

Therefore, when characters and the like are inputted through the character keys on the keyboard 6, the text (document data) thereof is sequentially stored in the editing input area 85B. At the same time, the dot pattern corresponding to the character inputted with the keyboard 6 based on the dot-pattern generation control program and the display drive control program is displayed on the liquid crystal display (LCD) 7. The thermal head 9 is driven via the drive circuit 91 to print the dot pattern data stored in the print buffer area 85A. In synchronization with this printing operation, the tape feed motor 92 is driven via the drive circuit 95 to feed the tape. Further, the editing input area 85B sequentially stores the print data inputted from the external computer via the communication I/F 87. Thus-inputted print data is stored into the print buffer area 85A based on the dot pattern generation control program as dot pattern data, and is printed onto the film tape 51 with the thermal head 9.

Next, a function structure of the read/write module (R/W module) 93 will be described based on FIG. 18.

Figure 18:
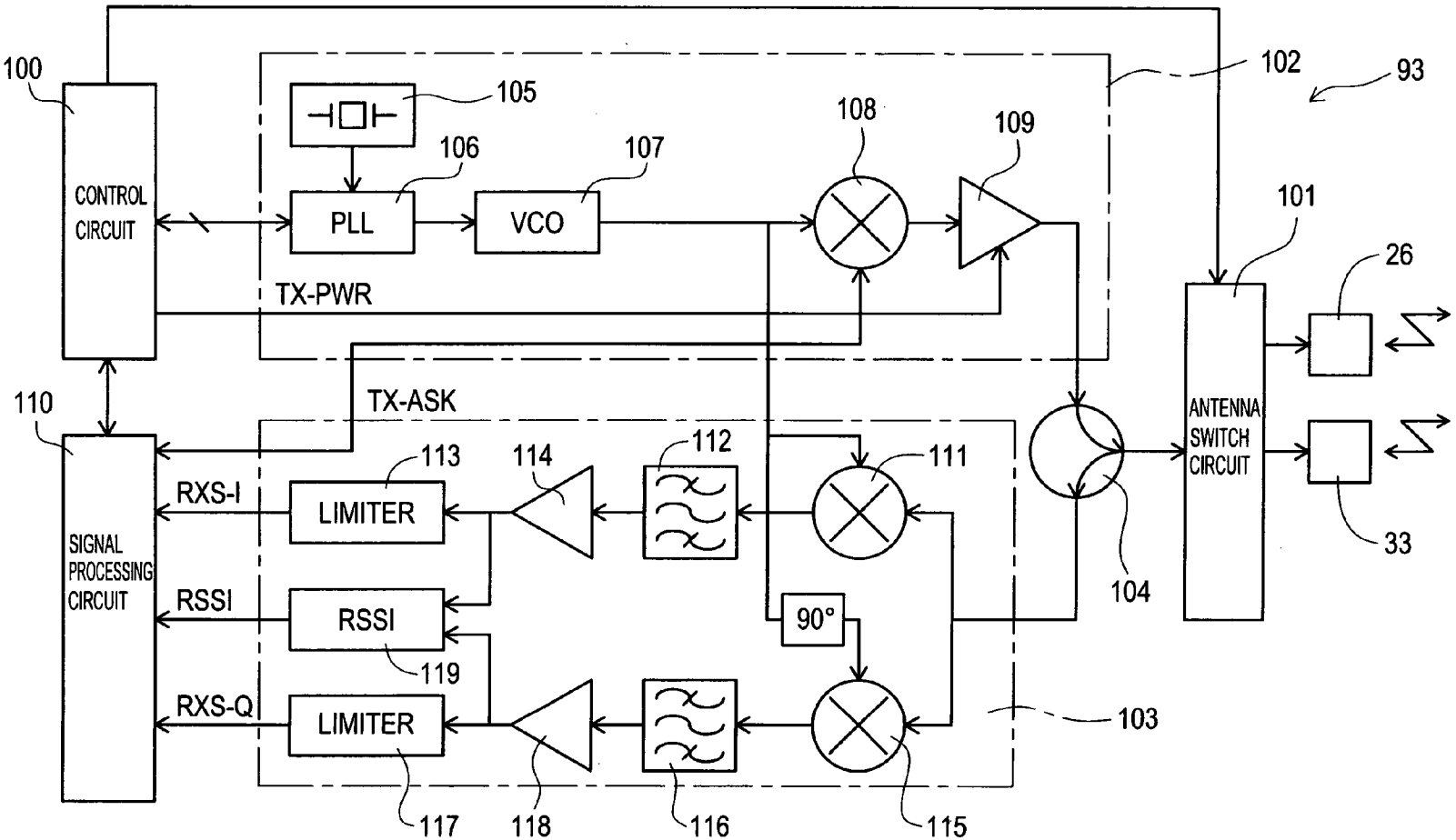
FIG. 18 is a functional block diagram showing detailed function of a read/write module (R/W module) of the tape printer according to Embodiment 1.

As shown in FIG. 18, the read/write module 93 includes an antenna switch circuit 101 switched by a control circuit 100, a transmission part 102 for transmitting signals to the individual wireless tag circuit elements 25, 32 through the antenna switch circuit 101 via individual antennas 26, 33, a reception part 103 for inputting reflected waves sent from the individual wireless tag circuit elements 25, 32 and received by the individual antennas 26, 33, and a transmission/reception separator 104.

The antenna switch circuit 101 is a switch circuit using a known high-frequency FET and a diode, and connects either one of the antennas 26, 33 to the transmission/reception separator 104 in response to the selection signal from the control circuit 100.

Further, the transmission part 102 includes a quartz oscillator 105 for generating carrier wave for access to (read/write) the wireless tag information of the IC circuit part 67 of the individual wireless tag circuit elements 25, 32, a PLL (a phase locked loop) 106, a VCO (a voltage controlled oscillator) 107, a transmission multiply circuit 108 for modulating the foregoing generated carrier waves based on the signal supplied from a signal processing circuit 111 for processing the signal read from the individual wireless tag circuit elements 25, 32 (in this embodiment, amplitude modulation based on "TX_ASK" signal from the signal processing circuit 110) (however, in the case of the amplitude modulation, an amplification rate variable amplifier may be used), and a transmission amplifier 109 for amplifying the wave modulated by the transmission multiply circuit 108 (in this example, amplification having an amplification rate determined by a "TX_PWR" signal supplied from the control circuit 100). The foregoing generated carrier wave preferably uses a frequency at UHF band. The output of the transmission amplifier 109 is transferred to either one of the antennas 26, 33 via the transmission/reception separator 104 and then is supplied to the IC circuit 67 of the wireless tag circuit elements 25, 32.

The reception part 103 includes a reception first multiply circuit 111 for multiplying the reflected waves from the wireless tag circuit elements 25, 32 received by the antennas 26, 32 with the foregoing generated carrier wave, a first bandpass filter 112 for taking out only a signal at a necessary bandwidth from the output of the reception first multiply circuit 111, a reception first amplifier 114 for amplifying the output of the first bandpass filter 112 and supplying it to a first limiter 113, a reception second multiply circuit 115 for multiplying the reflected wave from the wireless tag circuit elements 25, 32 received by the antennas 26, 33 with a carrier wave generated as described above and then phase-shifted by 90°, a second bandpass filter 116 for taking out only a signal at a necessary bandwidth from the output of the reception second multiply circuit 115, and a reception second amplifier 118 to which the output of the second bandpass filter 116 is inputted for amplifying it and supplying the amplified signal to a second limiter 117. The signal "RXS-I" outputted from the first limiter 113 and the signal "RXS-Q" outputted from the second limiter 117 are inputted into the signal processing circuit 110 and are processed therein.

Further, the outputs of the reception first amplifier 114 and the reception second amplifier 118 are also inputted to a received signal strength indicator circuit (RSSI) 119, and the signal "RSSI" indicative of the strength of these signals are inputted into the signal processing circuit 110. In this manner, the read/write module 93 of Embodiment 1 demodulates the reflected waves from the wireless tag circuit elements 25, 32 by I-Q quadrature demodulation.

Next, a function structure of the wireless tag circuit elements 25, 32 will be described based on FIG. 19. Since the function structure of the wireless tag circuit element 25 and the wireless tag circuit element 32 are almost equal to each other, a function structure of the wireless tag circuit element 32 will be described.

Figure 19:
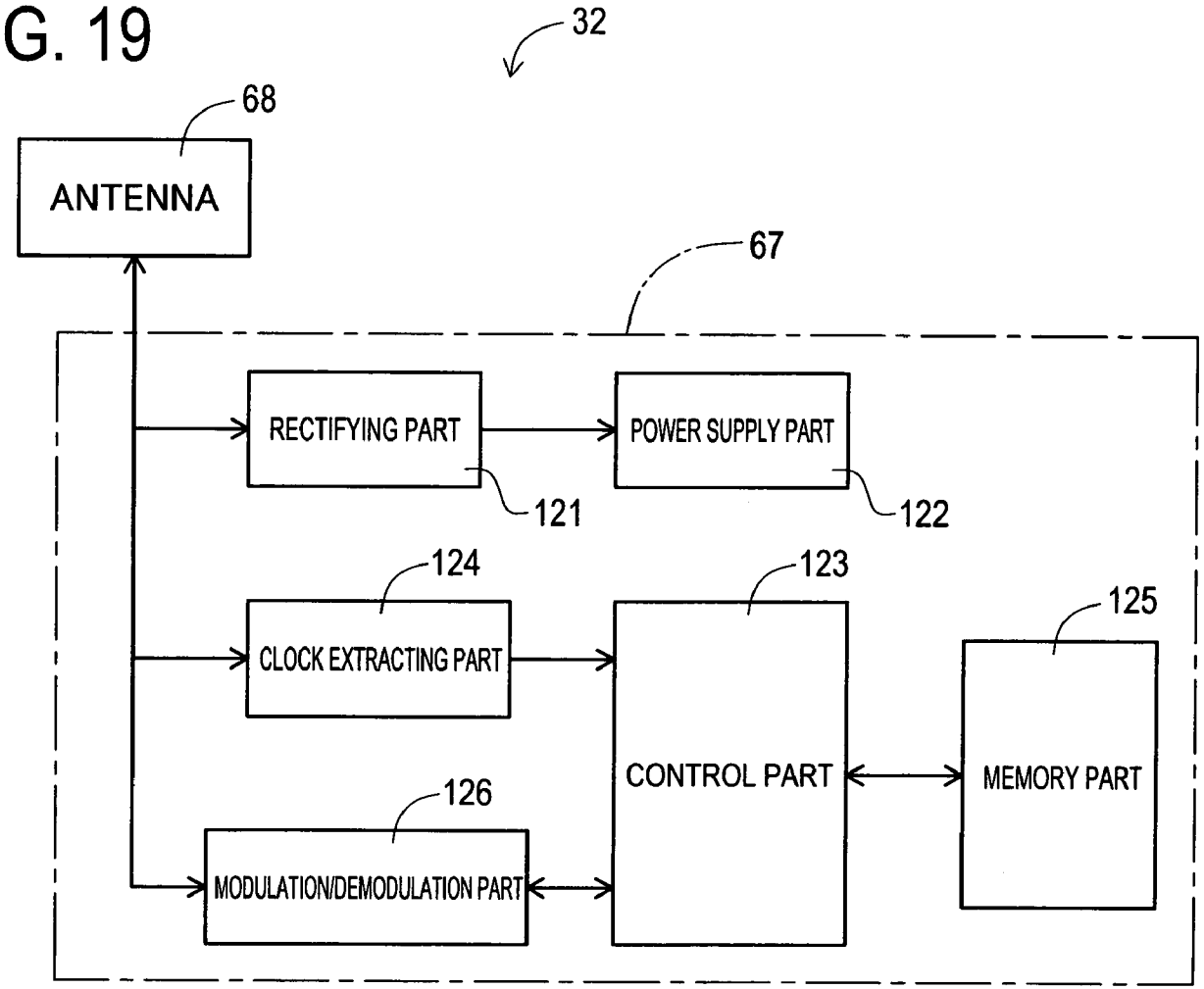
FIG. 19 is a functional block diagram showing a function structure of the tape printer according to Embodiment 1.

As shown in FIG. 19, the wireless tag circuit element 32 includes the foregoing antenna (IC circuit-side antenna) 68 for establishing non-contact signal transmission/reception with the antenna 33 of the read/write module 93 by use of high-frequency such as UHF band and the like, and the foregoing IC circuit part 67 connected to the antenna 68.

The IC circuit part 67 includes a rectifying part 121 for rectifying the carrier wave received by the antenna 68, a power supply part 122 for storing the energy of the carrier wave rectified by the rectifying part 121 and using the energy as a drive power supply, a clock extracting part 124 for extracting a clock signal from the carrier wave received by the antenna 68 and supplying it to the control part 123, a memory part 125 capable of storing a predetermined information signal, a modulation/demodulation part 126 connected to the antenna 68, and the foregoing control part 123 for controlling the operation of the wireless tag circuit element 32 via the rectifying part 121, the clock extracting part 124 and the modulation/demodulation part 126.

The modulation/demodulation part 126 demodulates the wireless communication signal from the antenna 33 of the read/write module 93 received by the antenna 68. The modulation/demodulation part 126 also modulates and reflects the carrier wave received by the antenna 68, based on the response signal from the control part 123.

The control part 123 interprets the reception signal demodulated by the modulation/demodulation part 126.

Then, the control part 123 generates a return signal based on the information signal stored in the memory part 125, and executes basic control such as controlling the modulation/demodulation part 126 to response, and the like.

Although detailed illustration is omitted, the wireless tag circuit element 25 provided in the tape cassette 21 is in the same structure as the wireless tag circuit element 32, and includes the IC circuit part 67 (not shown) and the antenna 68 (not shown).

Next, an example of information stored in the memory part 125 of the wireless tag circuit element 25 provided in the tape cassette 21 will be described based on FIGS. 20 to 22.

As shown in FIG. 20, the memory part 125 of the wireless tag circuit element 25 provided in the tape cassette 21 stores a parameter table 131 that stores print control information for performing printing onto the film tape 51 accommodated in the tape cassette 21 as to each of the models A to C of the tape printer 1.

The parameter table 131 includes "model names" indicative of individual models of the tape printer 1, "drive power supplies" corresponding to individual "model names", and "print control parameters" corresponding to individual "drive power supplies".

The "model names" respectively include "Model A", "Model B", and "Model C". The "drive power supplies" of "Model A", "Model B" and "Model C" respectively store "dry battery", "AC adaptor", and "AC power supply".

As print control parameters for "dry battery", "AC adaptor" and "AC power supply" of "Model A", "Parameter A1", "Parameter B1" and "Parameter C1" are stored, respectively. As print control parameters for "dry battery", "AC adaptor" and "AC power supply" of "Model B", "Parameter A2", "Parameter B2" and "Parameter C2" are stored, respectively. As print control parameters for "dry battery", "AC adaptor" and "AC power supply" of "Model C", "Parameter A3", "Parameter B3" and "Parameter C3" are stored, respectively.

The performance of the thermal head 9 and the like mounted to each of Models A to C of the tape printer 1 differs from each other. For example, as shown in FIG. 22, the "head resolution" of the thermal head 9 mounted to "Model A" is "360 dpi", and the "head size" thereof is "256 dots". The "head resolution" of the thermal head 9 mounted to "Model B" is "180 dpi", and the "head size" thereof is "256 dots". The "head resolution" of the thermal head 9 mounted to "Model C" is "270 dpi", and the "head size" thereof is "128 dots".

Further, the print control parameters include print control information for controlling electric conduction to the individual heating elements of the thermal head 9 corresponding to the "dry battery", "AC adaptor", and "AC power supply" of the "drive power supply", in order to perform printing onto the film tape 51 accommodated in the tape cassette 21.

Further, as shown in FIG. 21, the memory part 125 of the wireless tag circuit element 25 provided in the tape cassette 21 stores a cassette information table 132 that stores cassette information related to the kind of the film tape 51 accommodated in the tape cassette 21 and the like.

The cassette information table 132 includes a "tape width" indicative of the tape widths of the film tape 51 and the double-sided adhesive tapes 53, a "tape type" indicative of the tape type of the film tape 51, a "tape length" indicative of the whole length of the film tape 51, a "pitch length L of IC chip" indicative of a predetermined pitch length of the wireless tag circuit element 32 mounted to the double-sided adhesive tape 53, an "ink ribbon type" indicative of the type of the ink ribbon 52, and an "ink ribbon color" indicative of the color of the ink ribbon 52.

Further, as an example, the "tape width" stores "6 mm", "tape type" stores "laminate tape", "tape length" stores "8 m", "pitch length L of IC chip" stores "50 mm", "ink ribbon type" stores "for lamination", and "ink ribbon color" stores "black".

In Embodiment 1, the "tape width" of the film tape 51 accommodated in the tape cassette 21 is in 8 types including 3.5 m, 6 mm, 9 mm, 12 mm, 18 mm, 24 mm, 36 mm and 48 mm. The "tape type" of the film tape 51 accommodated in the tape cassette 21 is in 6 types including a laminate tape, a lettering tape, a receptor tape, a heat-sensitive tape, a cloth tape and an iron transfer tape. The "tape length" of the film tape 51 accommodated in the tape cassette 21 is in 3 types including 5 m, 8 m and 16 m. The "pitch length L of IC chip" is in 4 types including 30 mm, 50 mm, 80 mm and 100 mm. The "ink ribbon type" indicative of the type of the ink ribbon accommodated in the tape cassette 21 is in 7 types including for lamination, for lettering, for receptor, for cloth tape, for cloth transfer, for high-speed printing and for high-accuracy printing. The "ink ribbon color" indicative of the color of the ink ribbon 52 accommodated in the tape cassette 21 is in 6 types including black, red, blue, green, and 3 colors for color printing including yellow, magenta and cyan and 4 colors for color printing including yellow, magenta, cyan and black.

Next, a control processing for setting print control parameters executed at the time when thus-structured tape printer 1 is turned on will be described based on FIGS. 23 to 25.

Figure 23:
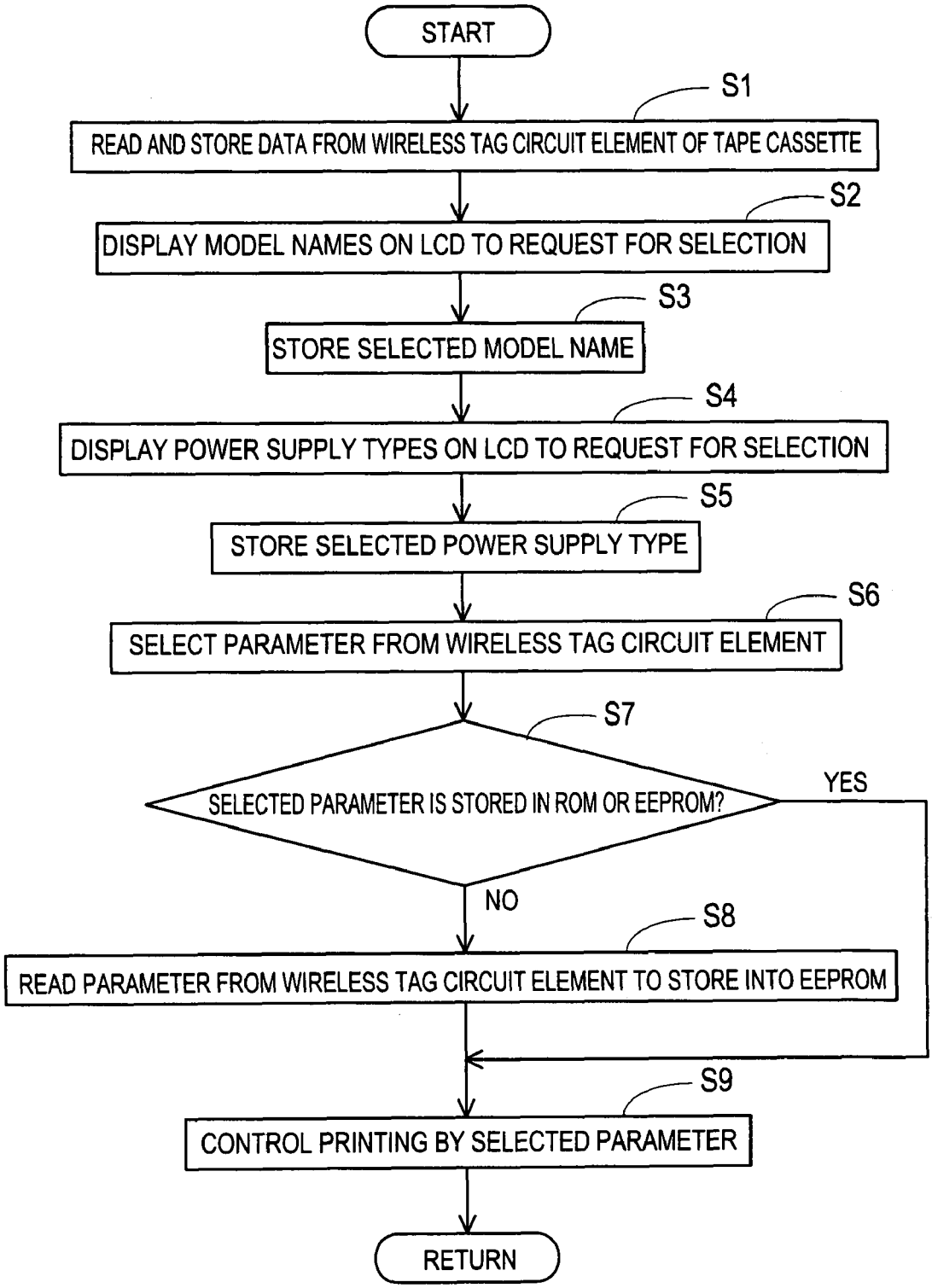

As shown in FIG. 23, first of all, in Step (hereinafter, abbreviated in S) 1, when the tape printer 1 is turned on, the CPU 81 of the tape printer 1 reads the "model name" and the power supply type of "drive power supply" corresponding to each "model name" of the parameter table 131 stored in the memory part 125 of the wireless tag circuit element 25 from the wireless tag circuit element 25 provided in the tape cassette 21 via the read/write module 93, and stores the read model names and the power supply type into the RAM 85.

Then, in S2, the CPU 81 controls the liquid crystal display 7 to display a request for selecting the model name of this tape printer 1. At the same time, the CPU 81 reads out the "model name" from the print control information on the parameter table 131 stored in the RAM 85 and displays the model name on the liquid crystal display 7, and then waits until the model name is selected.

Figure 24:
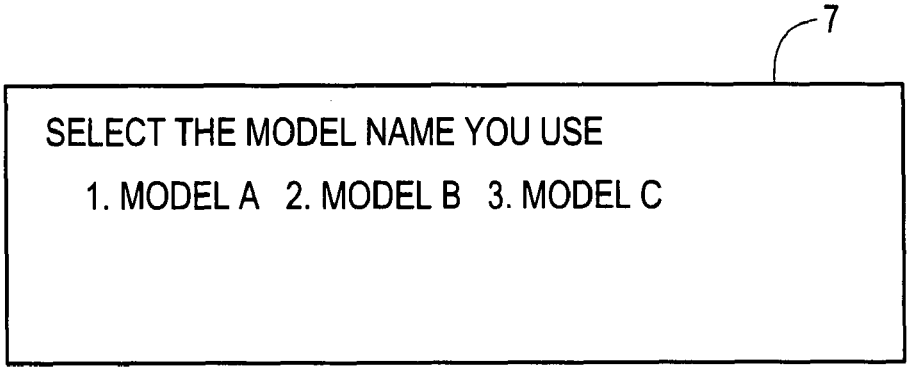
FIG. 24 is a view showing one example of a screen of a liquid crystal display 7, which is displayed at the time when the tape printer according to Embodiment 1 is turned on, the view of a screen display for selection of a model.

For example, as shown in FIG. 24, the CPU 81 controls the liquid crystal display 7 to display "select the model name you use" in its upper portion, whereas to display the number "1." followed by "Model A", the number "2." followed by "Model B", and the number "3." followed by "Model C" in its lower portion. Then, the CPU 81 waits until any one of the number keys 1 to 3 is pressed on the keyboard 6.

Subsequently, in S3, when the model name is selected with the keyboard 6, the CPU 81 stores the selected model name into the RAM 85.

Then, in S4, the CPU 81 controls the liquid crystal display 7 to display a request for selecting the type of drive power supply of this tape printer 1. At the same time, the CPU 81 again reads the model name stored in S3 from the RAM 85, and then, reads the type of the "drive power supply" corresponding to the "model name" from the RAM 85. Then, the CPU 81 controls the liquid crystal display 7 to display the read drive power supply type and waits until the drive power supply is selected.

Figure 25:
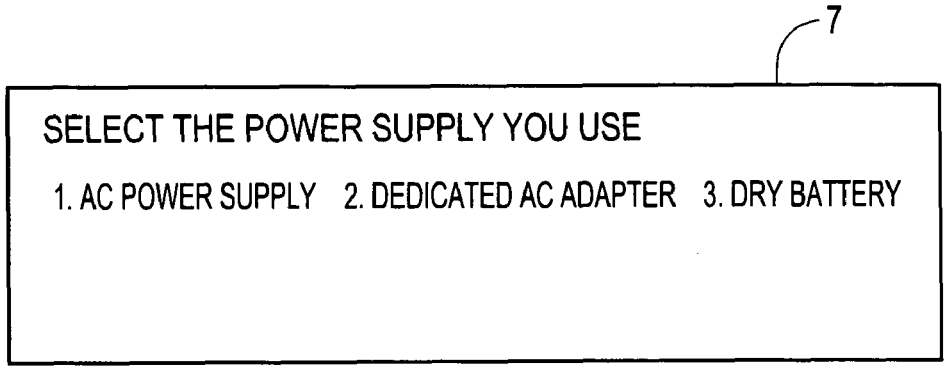
FIG. 25 is a view showing one example of a screen of the liquid crystal display 7, which is displayed at the time when the tape printer according to Embodiment 1 is turned on, the view of a screen display for selection of a power supply.

For example, as shown in FIG. 25, when "Model A" is selected, the CPU 81 controls the liquid crystal display 7 to display "select the power supply you use" in its upper portion. At the same time, the CPU 81 controls the liquid crystal display 7 to display the number "1." followed by "AC power supply", the number "2." followed by "dedicated AC adaptor", and the number "3." followed by "dry battery" in its lower portion. Then, the CPU 81 waits until any one of the number keys 1 to 3 is pressed on the keyboard 6.

Then, in S5, when the drive power supply is selected with the keyboard 6, the CPU 81 controls the RAM 85 to store the selected power supply.

Subsequently, in S6, the CPU 81 reads the model name and the kind of drive power supply stored in the RAM 85. Then, the CPU 81 reads a print control parameter corresponding to the model name and the kind of drive power supply from the print control information on the parameter table 131 stored in the memory part 125 of the wireless tag circuit element 25 via the read/write module 93. Then, the CPU 81 controls the RAM 85 to store the read parameter as a print control parameter of the tape cassette 21 corresponding to the drive conditions.

For example, when the model name and the kind of drive power supply stored in the RAM 85 are "Model A" and "dry battery", the CPU 81 reads "Parameter A1" from the print control information on the parameter table 131 stored in the memory part 125 of the wireless tag circuit element 25, and controls the RAM 85 to store it as a print control parameter of the tape cassette 21. When the model name and the kind of drive power supply stored in the RAM 85 are "Model B" and "AC adaptor", the CPU 81 read "Parameter B2" from the print control information on the parameter table 131 stored in the memory part 125 of the wireless tag circuit element 25, and controls the RAM 85 to store it as a print control parameter of the tape cassette 21.

Then, in S7, the CPU 81 reads a print control parameter of the tape cassette 21 corresponding to the drive conditions from the RAM 85, and executes determination processing for determining whether or not this print control parameter is stored in the ROM 83 or the flash memory 84.

If the print control parameter of the tape cassette 21 read from the RAM 85 is stored neither ROM 83 nor flash memory 84 (S7: No), in S8, the CPU 81 reads the parameter data of the print control parameter from the parameter table 131 stored in the memory part 125 of the wireless tag circuit element 25 via the read/write module 93, and controls the flash memory 84 to store it as parameter data of the print control parameter of the tape cassette 21.

After that, in S9, the CPU 81 read parameter data of the print control parameter of the tape cassette 21 from the ROM 83 or the flash memory 84, and executes printing control. After the execution, the CPU 81 terminates the processing.

On the other hand, if the print control parameter of the tape cassette 21 read from the RAM 85 is stored in the ROM 83 or the flash memory 84 (S7: Yes), in S9, the CPU 81 reads parameter data of the print control parameter of the tape cassette 21 from the ROM 83 or the flash memory 84, and executes printing control. After the execution, the CPU 81 terminates the processing.

Next, a printing control processing for creating the printed label tape 28 will be described based on FIGS. 26 to 39.

Figure 26:
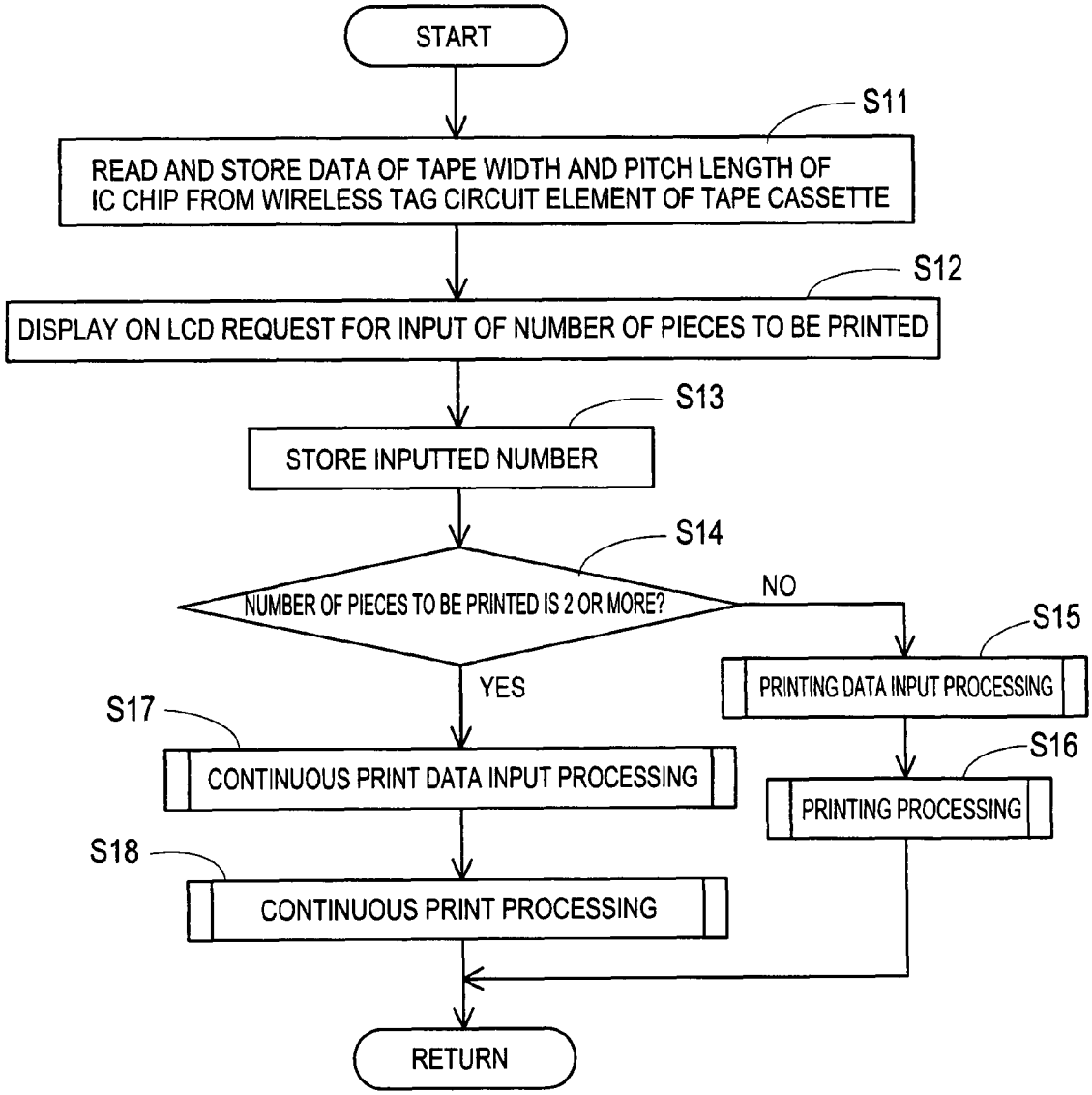
FIG. 26 is a main flowchart of a printing control processing for creating the printed label tape of the tape printer according to Embodiment 1.

As shown in FIG. 26, first of all, in S11, the CPU 81 of the tape printer 1 reads the cassette information related to the kind of film tape 51 and the like accommodated in the tape cassette 21 stored on the cassette information table 132 stored in the memory part 125 of the wireless tag circuit element 25 of the tape cassette 21 via the read/write module 93, and controls the RAM 85 to store the read cassette information.

For example, the CPU 81 reads from the wireless tag circuit element 25 via the read/write module 93, "6 mm" as data of "tape width", "laminate tape" as data of "tape kind", "8 m" as data of "tape length", "50 mm" as data of "pitch length L of IC chip", "for lamination" as data of "ink ribbon type", and "black" as data of "ink ribbon color", and controls the RAM 85 to store the read data.

Then, in S12, the CPU 81 controls the liquid crystal display 7 to display a request for inputting the required number of pieces of printed label tape 28, that is, the required number of pieces of printed label tape 28 provided with the wireless tag circuit elements 32. Then, the CPU 81 waits until the required print number is inputted with the keyboard 6.

For example, the CPU 81 controls the liquid crystal display 7 to display "input the number of pieces to be printed" in its upper portion, whereas to display "how many pieces?" in the lower portion thereof. Then, the CPU 81 waits until the number is inputted with the keyboard 6.

Subsequently, in S13, if the required print number is inputted with the keyboard 6, the CPU 81 controls the liquid crystal display 7 to display the input required print number, and the RAM 85 to store it.

Then, in S14, the CPU 81 reads again the required print number from the RAM 85 and executes determination processing for determining whether the number is 2 or more. If the required print number read from the RAM 85 is "1" (S14: No), in S15, the CPU 81 executes a sub-processing of "printing data input processing". Then, in S16, the CPU 81 executes a sub-processing of "printing processing". After the execution, the CPU 81 terminates the processing.

On the other hand, if the required print number read from the RAM 85 is "2 or more" (S14: Yes), in S17, the CPU 81 executes a sub-processing of "continuous print data input processing". Then, in S18, the CPU 81 executes a sub-processing of "continuous print processing". After the execution, the CPU 81 terminates the processing.

Next, the sub-processing of "print data input processing" in S15 will be described based on FIG. 27.

Figure 27:
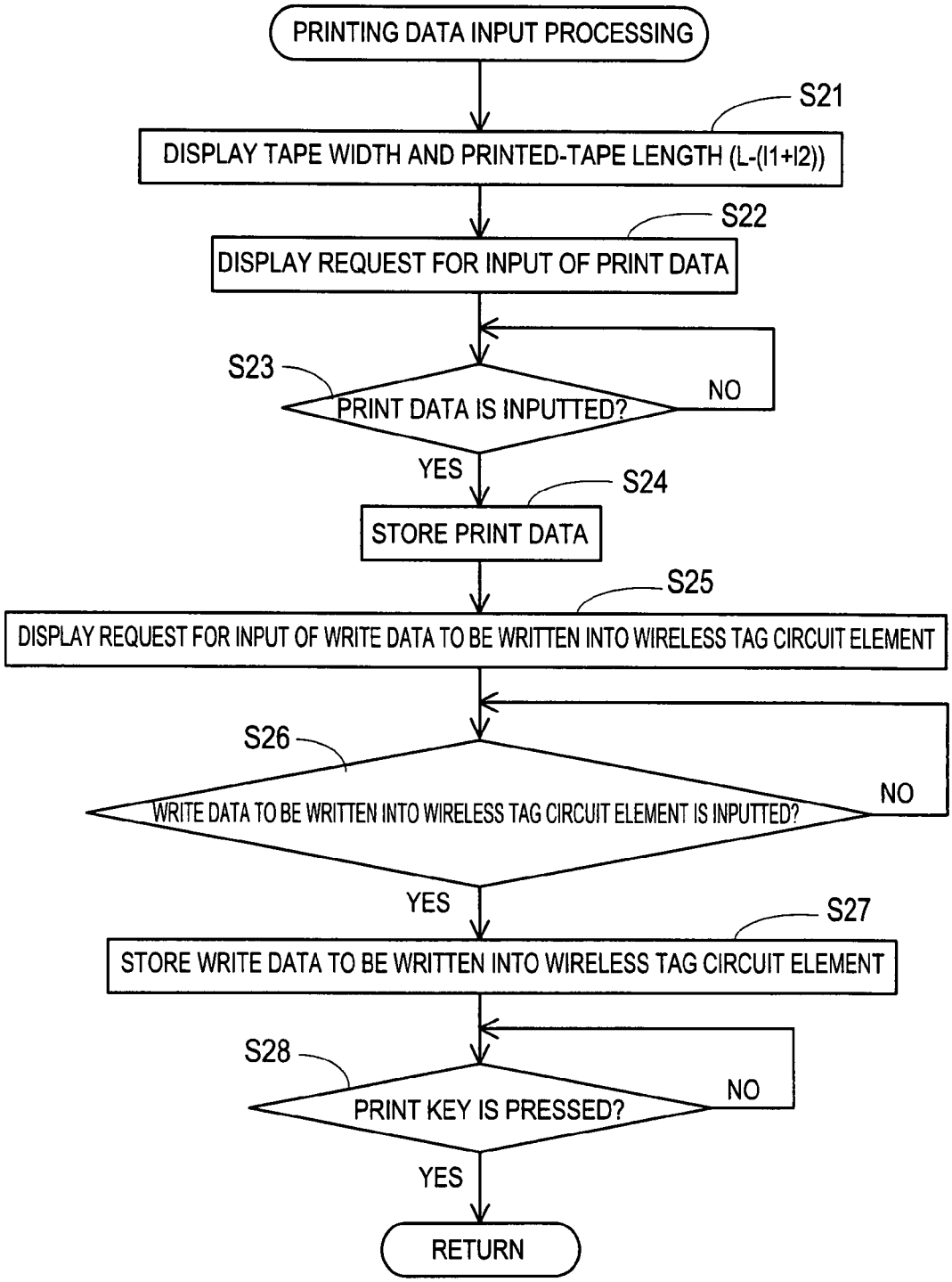
FIG. 27 is a sub flowchart explaining a print data input processing executed at the time when creating one sheet of printed label tape of the tape printer according to Embodiment 1.

As shown in FIG. 27, in S21, first of all, the CPU 81 reads from the ROM 83 the distance l1 in the transfer direction extending from the antenna 33 and the reflective sensor 35 to the cutter unit 30, and the distance l2 in the transfer direction extending from the cutter unit 30 to the thermal head 9. Then, the CPU 81 controls the RAM 85 to store the sum of the distance l1 in the transfer direction and the distance l2 in the transfer direction (l1+l2). Then, the CPU 81 reads the data of "pitch length L of IC chip" from the cassette information related to the tape cassette 21 stored in the RAM 85. Then, the CPU 81 controls the RAM 85 to store the value obtained by deducting the sum (l1+l2) from the pitch length L as a printed-tape length (L−(l1+l2)). Subsequently, the CPU 81 reads from the RAM 85 the printed tape length (L−(l1+l2)) and the data of "tape width" of the film tape 51 from the cassette information related to the tape cassette 21, and controls the liquid crystal display 7 to display the read data.

Subsequently, in S22, the CPU 81 controls the liquid crystal display 7 to display a request for inputting print data.

Then, in S23, the CPU 81 waits until print data is inputted with the keyboard 6 (S23: No). If print data is inputted with the keyboard 6 (S23: Yes), in S24, the CPU 81 stores the print data into the editing input area 85B as print data for label tape.

Subsequently, in S25, the CPU 81 controls the liquid crystal display 7 to display a request for inputting write data to be written into the wireless tag circuit element 32. Examples of the write data include data such as price, consume-by date, produced date, name of manufacturing plant of an article which the user directly inputs with the keyboard 6, file data related to article information which is inputted from an external computer via the communication interface 87 and is stored in the RAM 85 beforehand, and the like.

Then, in S26, the CPU 81 waits until the write data to be written into the wireless tag circuit element 32 is inputted (S26: No). If data such as a price of an article, and a file name related to article information are inputted with the keyboard 6 (S26: Yes), in S27, the CPU 81 controls the RAM 85 to store the data such as a price of the article inputted with the keyboard 6, and the file data related to the article information as write data to be stored in the memory part 125 of the wireless tag circuit element 32.

After that, in S28, the CPU 81 waits until the print key 3 is pressed (S28: No). If the print key 3 is pressed (S28: Yes), the CPU 81 terminates this sub-processing and returns to the main flow chart.

Next, the sub-processing of "print processing" in S16 will be described based on FIGS. 28 and 32 to 36.

Figure 28:
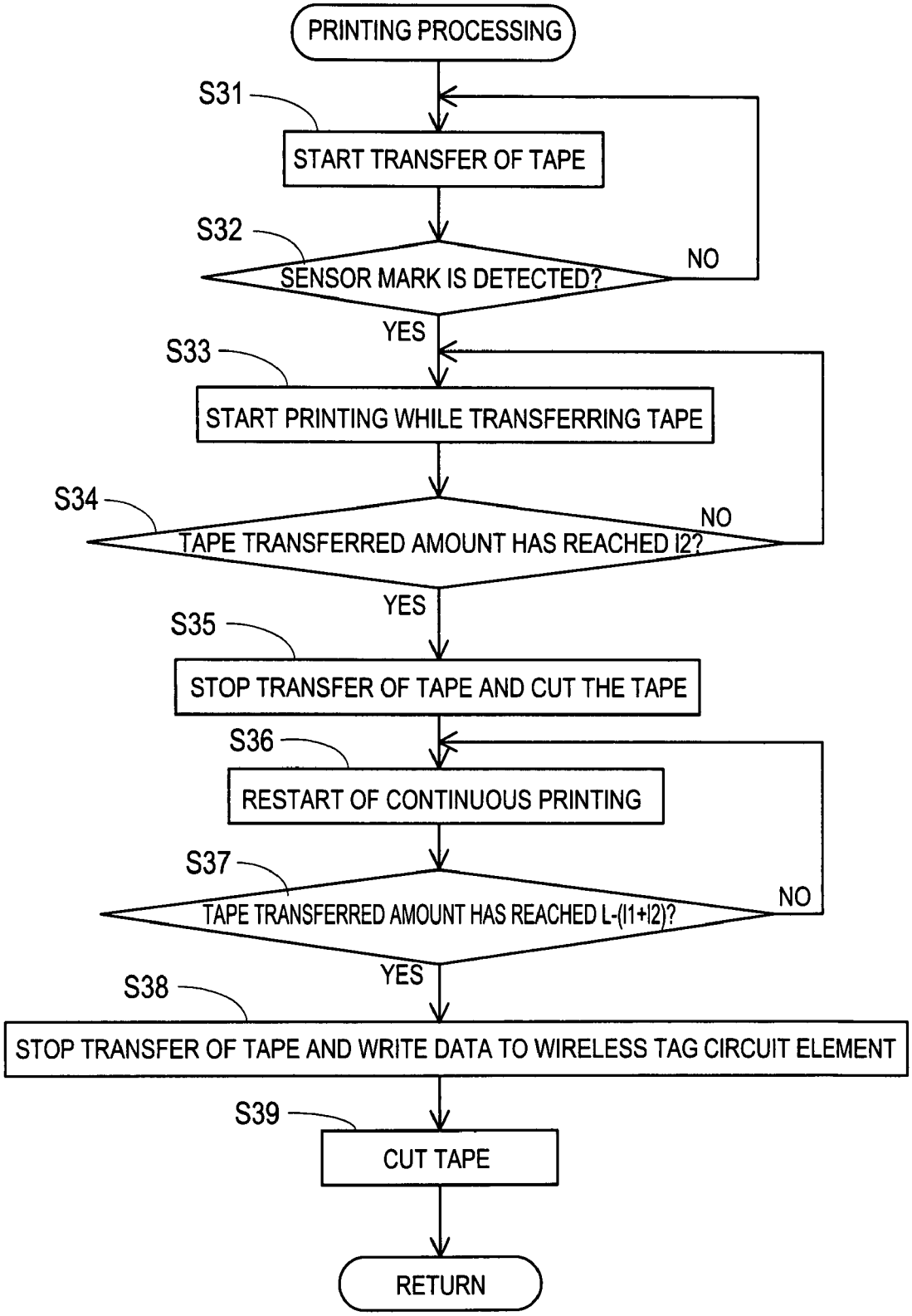
FIG. 28 is a sub flowchart explaining a printing processing executed at the time when creating one sheet of printed label tape of the tape printer according to Embodiment 1.

As shown in FIG. 28, in S31, first of all, the CPU 81 drives the tape feed motor 92 to rotate the tape feed roller 63, so as to start the transfer of the printed label tape 28 by the tape feed roller 63 and the tape sub-roller 11.

Then, in S32, the CPU 81 executes determination processing for determining whether or not the sensor mark 65 printed on the back surface of the printed label tape 28 has been detected via the reflective sensor 35. If no sensor mark 65 is detected via the reflective sensor 35 (S32: No), the CPU 81 again executes the processing of S31 and thereafter. On the other hand, if the top end portion in the transfer direction of the sensor mark 65 is detected via the reflective sensor 35 (S32: Yes), in S33, the CPU 81 continues to drive the tape feed motor 92 to transfer the film tape 51 while the CPU 81 starts to print printing data with the thermal head 9.

Figure 33:
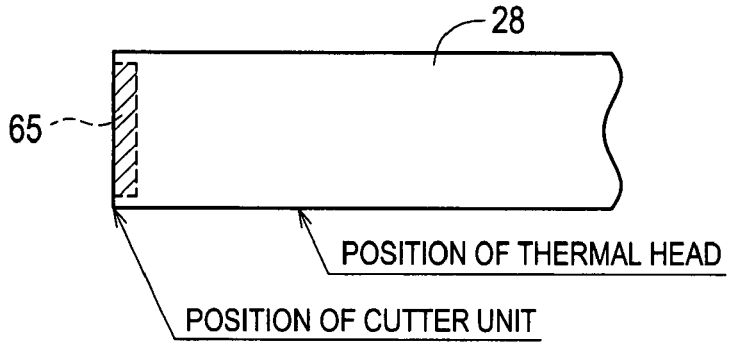
FIG. 33 is a schematic explanatory view of one example of creating one sheet of printed label tape of the tape printer according to Embodiment 1, the view showing a state of the printed label tape in a stand-by state.
Figure 34:
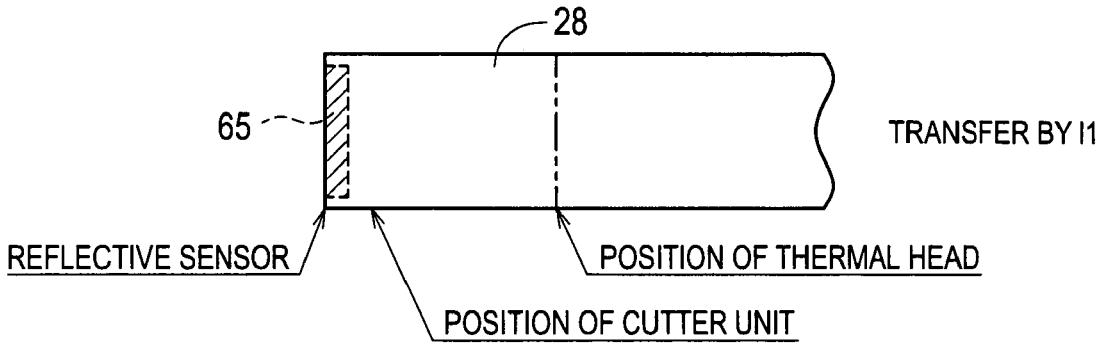
FIG. 34 is a view showing a state of the printed label tape at the start of printing, following the state in FIG. 33 and after the tape is transferred.

For example, as shown in FIGS. 33 to 34, when the print key 3 is pressed, if the top end portion in the transfer direction of the sensor mark 65 is opposed to the cutter unit 30, the CPU 81 drives the tape feed motor 92 to rotate the tape feed roller 63, so as to start the transfer of the printed label tape 28 by the tape feed roller 63 and the tape sub-roller 11. At the time when the transferred amount of the printed label tape 28 has reached the distance l1 in the transfer direction from the antenna 33 and the reflective sensor 35 to the cutter unit 30, the top end portion in the transfer direction of the sensor mark 65 is detected by the reflective sensor 35, and printing of print data is started with the thermal head 9.

Subsequently, in S34, the CPU 81 reads the distance l2 in the transfer direction from the cutter unit 30 to the thermal head 9 from the RAM 85, and executes a determination processing for determining whether or not the tape transferred amount achieved since the top end portion in the transfer direction of the sensor mark 65 has been detected has been detected via the reflective sensor 35 has reached the distance l2 in the transfer direction. If the tape transferred amount achieved since the top end portion in the transfer direction of the sensor mark 65 has not reached the distance l2 in the transfer direction (S34: No), the CPU 81 again executes the processing of S33 and thereafter.

On the other hand, if the tape transferred amount achieved since the top end portion in the transfer direction of the sensor mark 65 has been detected has reached the distance l2 in the transfer direction (S34: Yes), in S35, the CPU 81 stops the tape feed motor 92 to stop the transfer of the printed label tape 28, and at the same time, stops the thermal head 9. After that, the CPU 81 drives the cutting motor 96 to cut the top end side in the transfer direction of the printed label tape 28. As a result, the margin at the top end portion in the transfer direction of the printed label tape 28 which corresponds to the distance in the transfer direction (l1+l2) from the antenna 33 and the reflective sensor 35 to the thermal head 9 can be automatically cut. Thus, after the creation of the printed label tape 28, there is no need for the user to cut the margin at the top end portion in the transfer direction. As a result, the operation efficiency can be enhanced.

Figure 35:
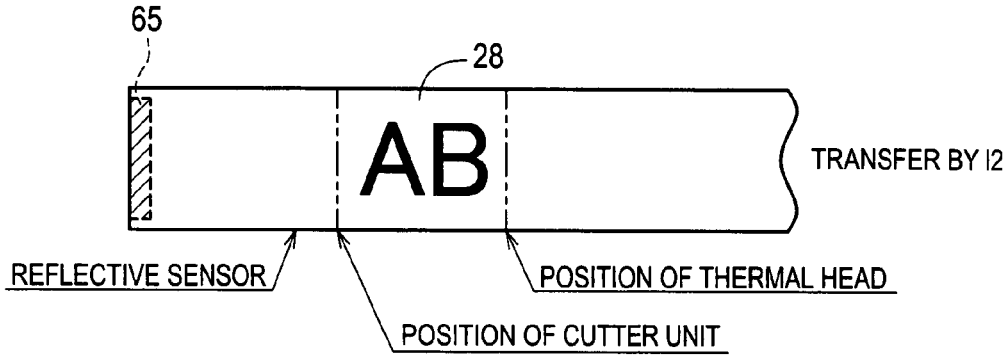
FIG. 35 is a view showing a state of the printed label tape in cutting the top end portion thereof, following the state in FIG. 34 and after the tape is transferred by the distance l2 from the printing start position.

For example, as shown in FIG. 35, in the case where the printing is started to print letters "AB" onto the film tape 51 with the thermal head 9 and the transferred amount of the film tape 51, that is, the transferred amount of the printed label tape 28 has reached the distance l2 between the cutter unit 30 and the thermal head 9 from the printing start position, the CPU 81 stops the tape feed motor 92 and then stops the thermal head 9. After that, the CPU 81 drives the cutting motor 96 to cut the margin at the top end portion in the transfer direction of the printed label tape 28.

Further, in S36, after cutting the top end side in the transfer direction of the printed label tape 28, the CPU 81 again starts to drive the tape feed motor 92 and also continues printing with the thermal head 9.

Then, in S37, the CPU 81 reads the distance l1 in the transfer direction from the RAM 85. Then, the CPU 81 executes determination processing for determining whether or not the tape transferred amount achieved since the top end portion in the transfer direction of the sensor mark 65 has been detected by the reflective sensor 35 has reached the value obtained by deducting the distance l1 in the transfer direction from the data value of "the pitch length L of IC chip" stored in the RAM 85 (for example, "50 mmm"), that is, whether or not the tape transferred amount achieved since the margin of the top end portion in the transfer direction in the printed label tape 28 has been cut has reached (L−(l1+l2)). If the tape transferred amount achieved since the top end portion in the transfer direction of the sensor mark 65 has been detected via the reflective sensor 35 has not reached the value obtained by deducting the distance l1 in the transfer direction from the data value of "the pitch length L of IC chip" (S37: No), the CPU 81 again executes the processing of S36 and thereafter.

On the other hand, if the tape transferred amount achieved since the top end portion in the transfer direction of the sensor mark 65 has been detected via the reflective sensor 35 has reached the value obtained by deducting the distance l1 in the transfer direction from the data value of "the pitch length L of IC chip" (S37: Yes), in S38, the CPU 81 stops the tape feed motor 92 to stop the transfer of the printed label tape 28. After that, the CPU 81 reads the write data from the RAM 85, and controls the memory part 125 of the wireless tag circuit element 32 to store this write data via the read/write module 93.

After that, in S39, the CPU 81 drives the cutting motor 96 to cut the rear end side in the transfer direction of the printed label tape 28. After the cutting operation, the CPU 81 terminates this sub-processing and returns to the main flow chart. In this manner, one piece of label tape 28 storing data such as a price of an article and the like in the wireless tag circuit element 32 is created.

Figure 36:
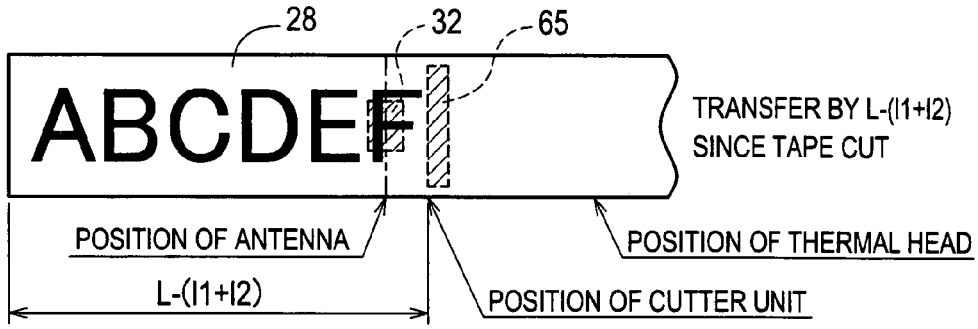
FIG. 36 is a view showing a state of the printed label tape in cutting the rear end side thereof, following the state in FIG. 35 and after the data is stored in the memory part of the wireless tag circuit element.

For example, as shown in FIG. 36, if the tape transferred amount achieved since the top end portion in the transfer direction of the sensor mark 65 has been detected via the reflective sensor 35 has reached the value obtained by deducting the distance l1 in the transfer direction from the data value of the "the pitch length L of IC chip" (for example, as shown in FIG. 21, "the pitch length L of IC chip" is 50 mm), that is, the tape transferred amount achieved since the margin at the top end portion in the transfer direction of the printed label tape 28 has been cut has reached (L−(l1+l2)), the CPU 81 stops the tape feed motor 92. Then, the CPU 81 reads the write data from the RAM 85, and controls the memory part 125 of the wireless tag circuit element 32 to store this write data via the read/write module 93. In this case, the antenna 33 and the wireless tag circuit element 32 are opposed to each other via the space 49. After that, the CPU 81 drives the cutting motor 96 to cut the rear end side in the transfer direction of the printed label tape 28, that is, along the top edge portion in the transfer direction of the sensor mark 65. Then, the printed label tape 28 is discharged from the label discharging port 16.

Next, a sub-processing of "continuous print data input processing" in S17 will be described based on FIG. 29.

Figure 29:
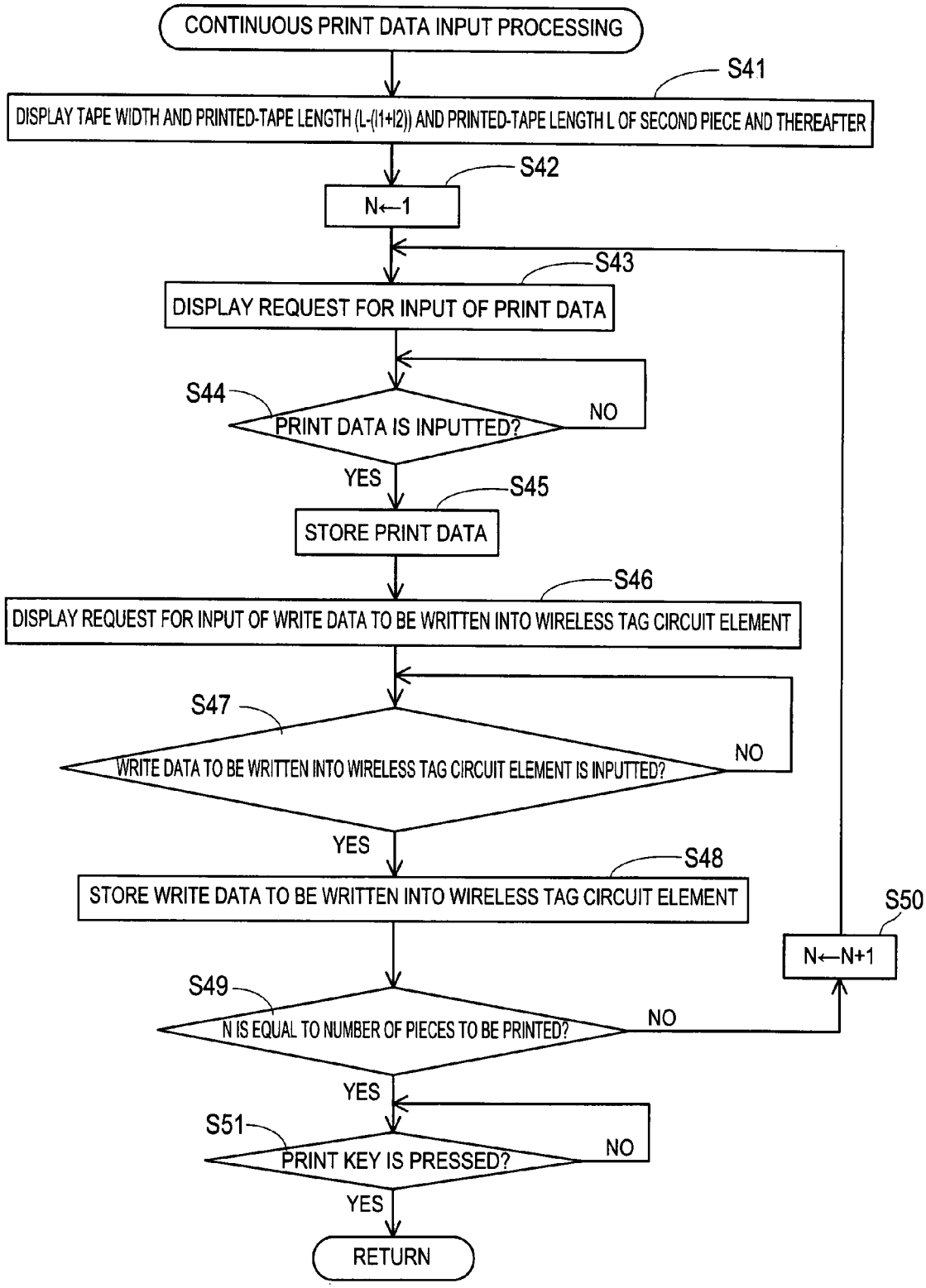
FIG. 29 is a sub flowchart explaining a continuous print data input processing executed at the time when continuously creating plural sheets of printed label tape of the tape printer according to Embodiment 1.

As shown in FIG. 29, in S41, first of all, the CPU 81 reads from the ROM 83 the distance l1 in the transfer direction extending from the antenna 33 and the reflective sensor 35 to the cutter unit 30, and the distance l2 in the transfer direction extending from the cutter unit 30 to the thermal head 9, and controls the RAM 85 to store the sum (l1+l2) of the distance l1 in the transfer direction and the distance l2 in the transfer direction. Then, the CPU 81 reads the data of "pitch length L of IC chip" from the cassette information related to the tape cassette 21 that stored in the RAM 85, and controls the RAM 85 to store the value obtained by deducting the sum (l1+l2) from this pitch length L as a length of the first piece (L−(l1+l2)). Further, the CPU 81 reads the data of "the pitch length L of IC chip" from the cassette information related from this tape cassette 21 stored in the RAM 85, and controls the RAM 85 to store this pitch length L as a length of the printed tape of the second piece and thereafter. Subsequently, the CPU 81 reads the printed tape length of the first piece (L−(l1+l2)), the printed tape length L of the second piece and thereafter, and the data of "tape width" of the film tape 51 from the cassette information related to this tape cassette 21 from the RAM 85, and controls the liquid crystal display 7 to display them.

Then, in S42, the CPU 81 reads an algebra N denoting the number of pieces of print data from the RAM 85. The CPU 81 substitutes "1" into this algebra N, and again controls the RAM 85 to store the resultant value.

Further, in S43, the CPU 81 controls the liquid crystal display 7 to display a request for inputting the print data of the first piece.

Subsequently, in S44, the CPU 81 waits until the print data is inputted with the keyboard 6 (S44: No). If the print data is inputted with the keyboard 6 (S44: Yes), in S45, the CPU 81 stores this print data into the editing input area 85B as the print data of the first label tape.

Then, in S46, the CPU 81 controls the liquid crystal display 7 to display a request for inputting write data to be written into the wireless tag circuit element 32 on the first label tape. Examples of the write data include data such as price, consume-by date, produced date, name of manufacturing plant of an article which the user directly inputs with the keyboard 6, file data related to article information which is inputted from an external computer via the communication interface 87 and is stored in the RAM 85 beforehand, and the like.

Then, in S47, the CPU 81 waits until the write data to be written into the wireless tag circuit element 32 is inputted (S47: No). If data such as a price of an article, and a file name related to article information are inputted with the keyboard 6 (S47: Yes), in S48, the CPU 81 controls the RAM 85 to store the data such as a price of the article inputted with the keyboard 6, and the file data related to the article information as write data to be stored in the memory part 125 of the wireless tag circuit element 32 on the first label tape.

Subsequently, in S49, the CPU 81 reads the algebra N from the RAM 85, and executes a determination processing for determining whether or not the algebra N is equal to the number of pieces to be printed. If the CPU 81 determines that the algebra N is smaller than the number of pieces to be printed (S49: No), in S50, the CPU 81 adds "1" to the algebra N, and controls the RAM 85 to store this resultant value. Then, the CPU 81 again executes the processing of S43 and thereafter.

On the other hand, if the algebra N is equal to the number of pieces to be printed (S49: Yes), in S51, the CPU 81 waits until the print key 3 is pressed (S51: No). If the print key 3 is pressed (S51: Yes), the CPU 81 terminates this sub-processing, and returns to the main flow chart.

Figure 30:
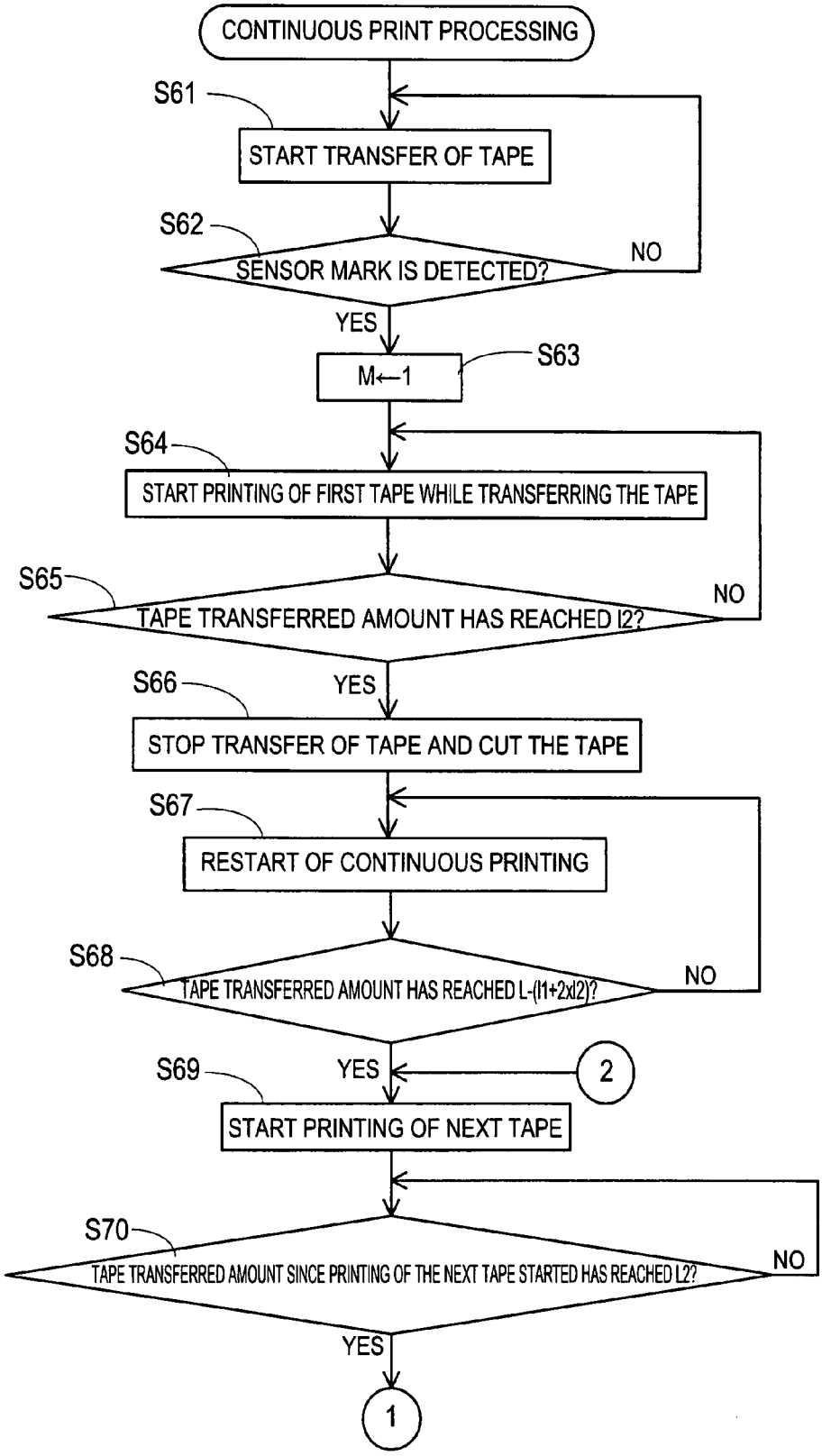
FIG. 30 is a sub flowchart explaining a continuous printing processing executed at the time when continuously creating plural sheets of printed label tape of the tape printer according to Embodiment 1.
Figure 31:
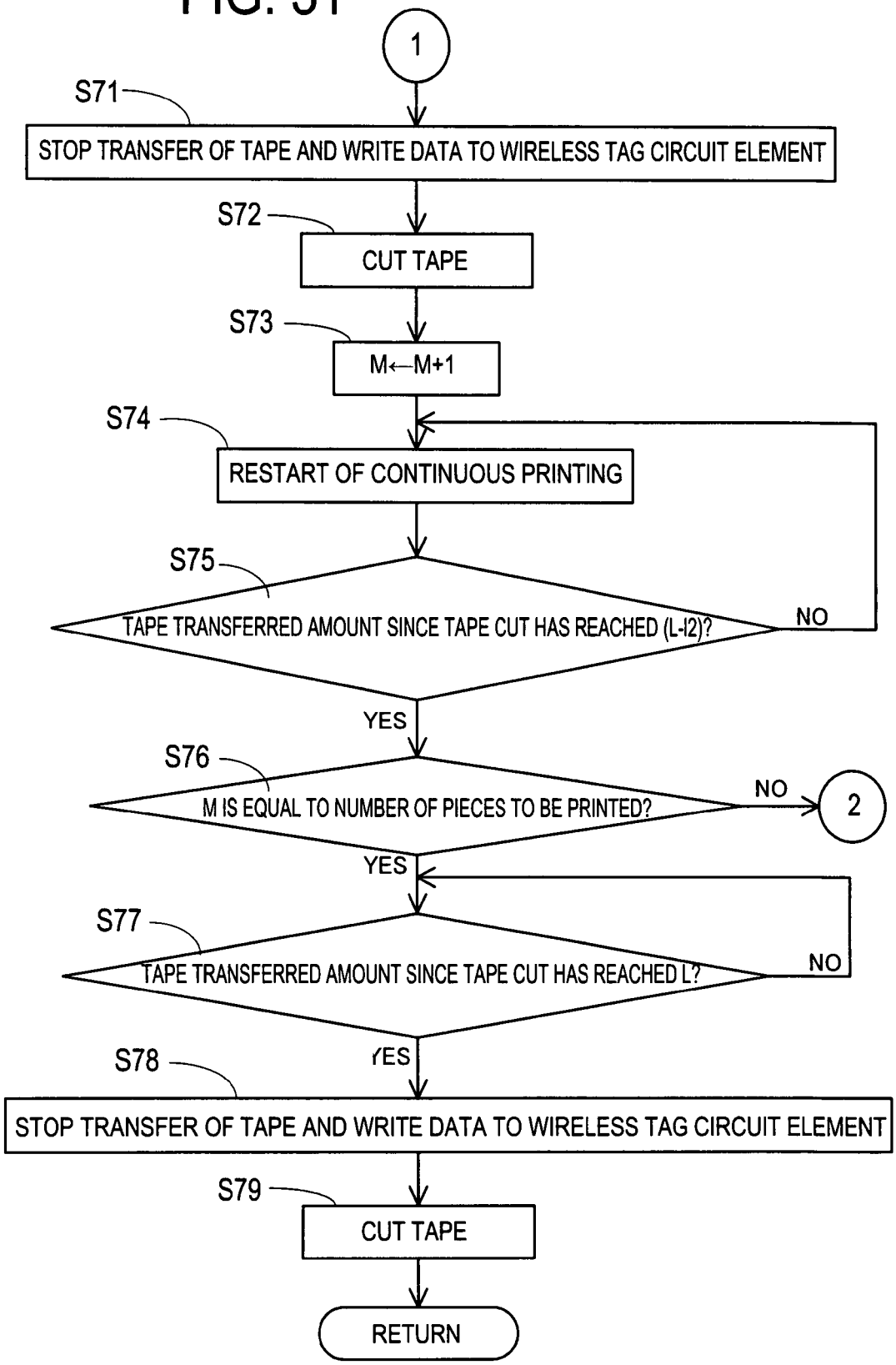
FIG. 31 is a sub flowchart explaining the continuous printing processing executed at the time when continuously creating plural sheets of printed label tape of the tape printer according to Embodiment 1.
Figure 32:
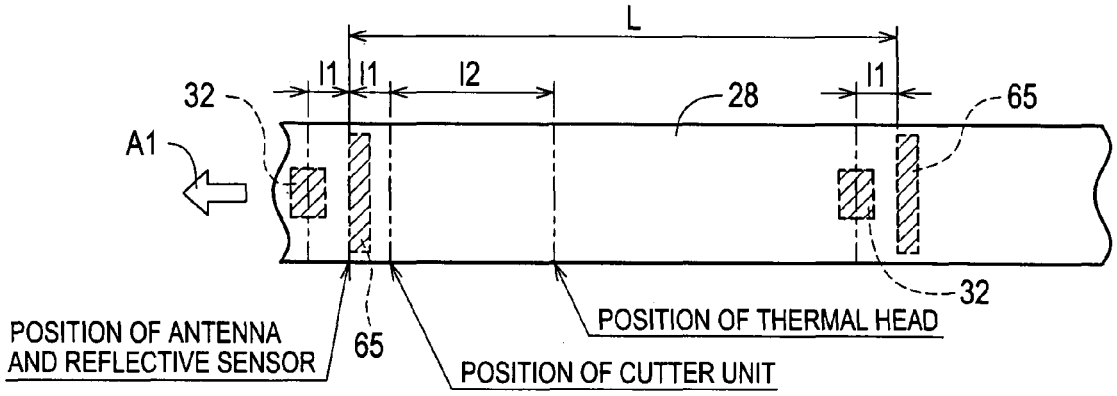
FIG. 32 is a schematic explanatory view of one example of the printed label tape of the tape printer according to Embodiment 1, the view schematically showing relative positional relationship between the sensor mark and the wireless tag circuit element.

Next, a sub-processing of the "continuous print processing" in S18 will be described based on FIGS. 30 to 39. As shown in FIGS. 30 and 31, in S61, first of all, the CPU 81 drives the tape feed motor 92 to rotate the tape feed roller 63, so as to start the transfer of the printed label tape 28 by this tape feed roller 63 and the tape sub-roller 11.

Then, in S62, the CPU 81 executes a determination processing for determining whether or not the sensor mark 65 printed on the back surface of the printed label tape 28 has been detected via the reflective sensor 35. If no sensor mark 65 has been detected by the reflective sensor 35 (S62: No), the CPU 81 again executes the processing of S61 and thereafter.

On the other hand, if the CPU 81 has detected the top end portion in the transfer direction of the sensor mark 65 with the reflective sensor 35 (S62: Yes), in S63, the CPU 81 reads an algebra M denoting the number of pieces of the printed label tapes 28 from the RAM 85, and substitutes "1" into this algebra M and controls the RAM 85 to again store the resultant value.

Subsequently, in S64, the CPU 81 again drives the tape feed motor 92 to feed the film tape 51 while starts to print the print data of Mth piece of the tape, that is, the first piece of the tape with the thermal head 9.

For example, as shown in FIGS. 33 to 34, when the print key 3 is pressed, if the top end portion in the transfer direction of the sensor mark 65 is opposed to the cutter unit 30, the CPU 81 drives the tape feed motor 92 to rotate the tape feed roller 63, and starts to feed the printed label tape 28 by this tape feed roller 63 and the tape sub-roller 11. If the transferred amount of the printed label tape 28 has reached the distance l1 in the transfer direction extending from the antenna 33 and the reflective sensor 35 to the cutter unit 30, the top end portion in the transfer direction of the sensor mark 65 is detected by the reflective sensor 35. Then, printing of print data is started with the thermal head 9.

Then, in S65, the CPU 81 reads from the RAM 85 the distance l2 in the transfer direction, and executes a determination processing for determining whether or not the tape transferred amount achieved since the top end portion in the transfer direction of the sensor mark 65 has been detected has been detected via the reflective sensor 35 has reached the distance l2 in the transfer direction. If the tape transferred amount achieved since the top end portion in the transfer direction of the sensor mark 65 has not reached the distance l2 in the transfer direction (S65: No), the CPU 81 again executes the processing of S64 and thereafter.

On the other hand, if the tape transferred amount achieved since the top end portion in the transfer direction of the sensor mark 65 has been detected has reached the distance l2 in the transfer direction (S65: Yes), in S66, the CPU 81 stops the tape feed motor 92 to stop the transfer of the printed label tape 28, and at the same time, stops the thermal head 9. After that, the CPU 81 drives the cutting motor 96 to cut the top end side in the transfer direction of the printed label tape 28. As a result, the margin at the top end portion in the transfer direction of the printed label tape 28 which corresponds to the distance in the transfer direction (l1+l2) from the antenna 33 and the reflective sensor 35 to the thermal head 9 can be automatically cut. Thus, after the creation of the printed label tape 28, there is no need for the user to cut the margin at the top end portion in the transfer direction. As a result, the operation efficiency can be enhanced.

For example, as shown in FIG. 35, in the case where the printing is started to print letters "AB" onto the film tape 51 with the thermal head 9 and when the transferred amount of the film tape 51, that is, the transferred amount of the printed label tape 28 has reached the distance l2 between the cutter unit 30 and the thermal head 9 from the printing start position, the CPU 81 stops the tape feed motor 92 and then stops the thermal head 9. After that, the CPU 81 drives the cutting motor 96 to cut the margin at the top end portion in the transfer direction of the printed label tape 28.

Subsequently, in S67, after cutting the top end side in the transfer direction of the printed label tape 28, the CPU 81 again starts to drive the tape feed motor 92 and also continues to print the print data with the thermal head 9.

Further, in S68, the CPU 81 executes a determination processing for determining whether or not the tape transferred amount achieved since the margin at the top end portion in the transfer direction of the printed label tape 28 has been cut has reached (L−(11+2×12)). If the tape transferred amount achieved since the margin at the top end portion in the transfer direction of the printed label tape 28 has been cut has not reached (L−(11+2×12)) (S68: No), the CPU 81 again executes the processing of S67 and thereafter.

On the other hand, If the tape transferred amount achieved since the margin at the top end portion in the transfer direction of the printed label tape 28 has been cut has reached (L−(11+2×12)) (S68: Yes), in S69, the CPU 81 starts to print the print data for the next label tape.

Further, in S70, the CPU 81 waits until the tape transferred amount achieved since the printing of the print data for the next label tape has been started reaches l2 (S70: No). If the tape transferred amount achieved since the printing of the print data for the next label tape has been started has reached l2 (S70: Yes), in S71, the CPU 81 stops the tape feed motor 92 to stop the transfer of the printed label tape 28. Then, the CPU 81 reads the write data from the RAM 85, and controls the memory part 125 of the wireless tag circuit element 32 to store this write data via the read/write module 93.

After that, in S72, the CPU 81 drives the cutting motor 96 to cut the rear end side in the transfer direction of the printed label tape 28, so as to create the first piece of printed label tape 28. Further, in S73, the CPU 81 reads the algebra M from the RAM 85, and adds "1" to this algebra M and controls the RAM 85 to again store the resultant value.

Figure 37:
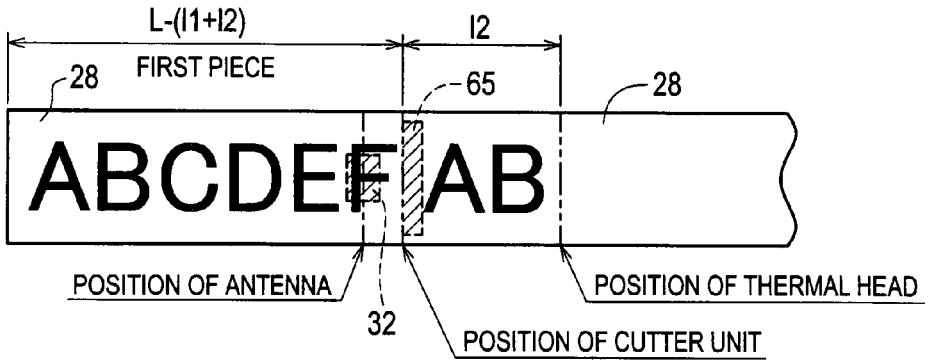
FIG. 37 is a schematic explanatory view of one example of three sheets of printed label tape of the tape printer according to Embodiment 1, the view showing a state of the printed label tape at the time of cutting the rear end side of the first sheet of the tape in continuous printing of second sheet.

For example, as shown in FIG. 37, if the tape transferred amount achieved since the printing of print data for the next label tape has been started has reached l2, that is, if the tape transferred amount achieved since the margin at the top end portion in the transfer direction of the first piece of printed label tape 28 has been cut has reached (L−(l1+l2)), the CPU 81 stops the tape feed motor 92. Then, the CPU 81 reads the write data from the RAM 85, and controls the memory part 125 of the wireless tag circuit element 32 to store this write data via the read/write module 93. In this case, the antenna 33 and the wireless tag circuit element 32 are opposed to each other. After that, the CPU 81 drives the cutting motor 96 to cut the rear end side in the transfer direction of the first piece of the printed label tape 28, that is, along the top edge portion in the transfer direction of the sensor mark 65. Then, the first piece of the printed label tape 28 is discharged from the label discharging port 16. Since the second piece of the printed label tape 28 and thereafter is printed starting from their top end portions, no margin to be cut is generated at their top end portions in the transfer direction, and printing is possible over the entire length of the "pitch length L of IC chip".

Subsequently, in S74, the CPU 81 again starts to drive the tape feed motor 92, and continues to print the print data with the thermal head 9.

Then, in S75, the CPU 81 executes a determination processing for determining whether or not the tape transferred amount achieved since the rear end side in the transfer direction of the printed label tape 28 has been cut has reached (L−l2). If the tape transferred amount achieved since the rear end side in the transfer direction of the printed label tape 28 has been cut has not reached (L−l2) (S75: No), the CPU 81 again executes the processing of S74 and thereafter.

On the other hand, if the tape transferred amount achieved since the rear end side in the transfer direction of the printed label tape 28 has been cut has reached (L−l2) (S75: Yes), in S76, the CPU 81 reads the algebra M from the RAM 85, and executes a determination processing for determining whether or not this algebra M is equal to the number of pieces to be printed.

If the CPU 81 determines that this algebra M is smaller than the number of pieces to be printed (S75: No), the CPU 81 again executes the processing of S69 and thereafter.

Figure 38:
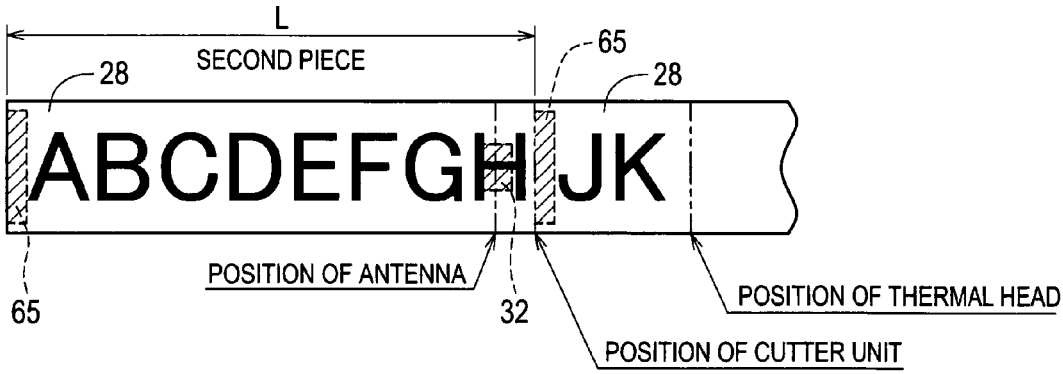
FIG. 38 is a view showing a state of the printed label tape at the time of cutting the rear end side of the second sheet of the tape in continuous printing of the third sheet, following the state in FIG. 37.

For example, as shown in FIG. 38, if the tape transferred amount achieved since the rear end side in the transfer direction of the first piece of the printed label tape 28 has been cut has reached (L−l2), the print data for the second piece is printed on the second piece of the label tape 28 as "ABCDEFGH". After that, the print data for the third piece is continuously printed onto the third piece of the label tape 28 as "JK" while the label tape 28 is transferred. Then, if the tape transferred amount achieved since the rear end side in the transfer direction of the first sheet of the printed label tape 28 has been cut has reached the length L of the "pitch length L of IC chip", the tape feed motor 92 is stopped, the wireless tag circuit element 32 of the second piece of printed label tape 28 opposes the antenna 33, and predetermined article information such as the price of article is written into this wireless tag circuit element 32 via the read/write module 93. Then, the cutting motor 96 is driven to cut the rear end side in the transfer direction of the second piece of the printed label tape 28, that is, along the top edge portion in the transfer direction of the sensor mark 65. Then, the second piece of the printed label tape 28 is discharged form the label discharging port 16.

On the other hand, if the CPU 81 determines that this algebra M is equal to the number of pieces to be printed (S76: Yes), in S77, the CPU 81 waits until the tape transferred amount achieved since the rear end side in the transfer direction of the printed label tape 28 has been cut reaches the length L of the "pitch length L of IC chip" (S77: No).

If the tape transferred amount achieved since the rear end side in the transfer direction of the printed label tape 28 has been cut has reached the length L of the "pitch length L of IC chip" (S77: Yes), in S78, the CPU 81 stops the tape feed motor 92 to stop the transfer of the printed label tape 28. After that, the CPU 81 reads the write data from the RAM 85, and controls the memory part 125 of the wireless tag circuit element 32 to store this write data via the read/write module 93.

After that, in S79, the CPU 81 drives the cutting motor 96 to cut the rear end side in the transfer direction of the printed label tape 28, so as to create the last piece of the printed label tape 28. Then, the CPU 81 terminates this sub-processing and returns to the main flow chart. In this manner, label tapes 28 each storing data such as a price of article in its wireless tag circuit element 32 are created in the number of print pieces inputted in the processing of S13.

Figure 39:
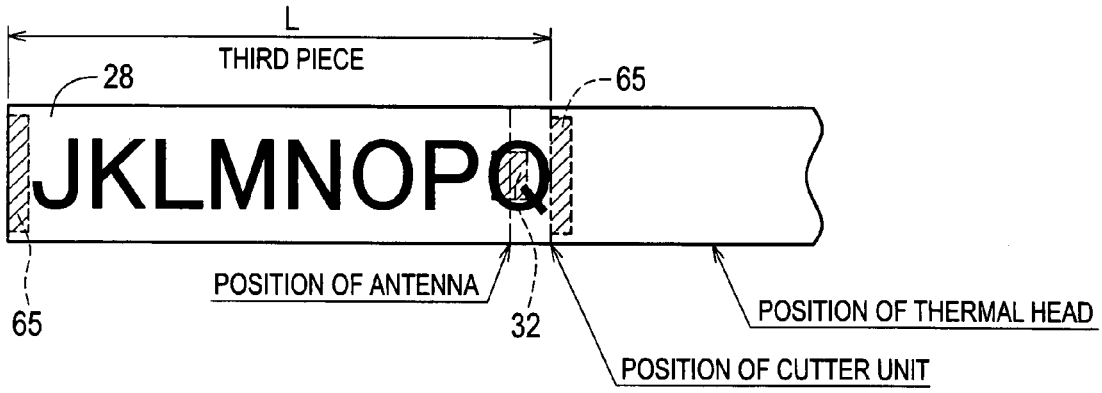
FIG. 39 is a view showing a state of the printed label tape at the time of cutting the rear end side thereof at the end of printing the third sheet, following the state in FIG. 38.

For example, as shown in FIG. 39, when three pieces of printed label tapes are required, if the tape transferred amount achieved since the rear end side in the transfer direction of the second piece of the printed label tape 28 has been cut has reached (L−l2), the print data for the third piece is printed onto the third piece of the label tape 28 as "JKLMNOPQ". After that, the label tape 28 is transferred with the thermal head 9 stopped. Then, if the tape transferred amount achieved since the rear end side in the transfer direction of the second piece of the printed label tape 28 has been cut has reached the length L of the "pitch length L of IC chip", the tape feed motor 92 is stopped, the wireless tag circuit element 32 of the third piece of printed label tape 28 opposes the antenna 33, and predetermined article information such as the price of article is written into this wireless tag circuit element 32 via the read/write module 93. Then, the cutting motor 96 is driven to cut the rear end side in the transfer direction of the third piece of the printed label tape 28, that is, along the top edge portion in the transfer direction of the sensor mark 65. Then, the third piece of the printed label tape 28 is discharged from the label discharging port 16, and then, the processing ends.

Here, the tape feed motor 92, the tape driving roller shaft 14, the cam part 76, the tape feed roller 63, and the tape sub-roller 11 together constitute tape transfer device. Further, the thermal head 9 and platen roller 10 together constitute printing device. The antenna 68 serves as an IC circuit-side antenna. The wireless tag circuit element 32 serves as a wireless information circuit element. The antenna 33 serves as a device side antenna. The read/write module 93 serves as a read/write device. The cutter unit 30 serves as a cutting device. The reflective sensor 35 serves as a detector sensor.

The CPU 81, the ROM 83, the flash memory 84 and the RAM 85 constitute a first drive control device and a second drive control device.

As explained above in detail, in the tape printer 1 according to Embodiment 1, the antenna 33 is located downstream of the tape transferring direction of the tape discharging port 27 through which the printed label tape 28 of the tape cassette 21 mounted to the cassette housing part 8 is discharged. The reflective sensor 35 that detects the sensor marks 65 provided on the back surface of the printed label tape 28 is arranged at the opposite side of the antenna 33 interposing the printed label tape 28. At the upstream of the antenna 33 and the reflective sensor 35 in the tape transferring direction, the cutter unit 30 for cutting the printed label tape 28 discharged through the tape discharging port 27 of the tape cassette 21 at a predetermined interval is arranged. On the double-sided adhesive tape 53 to be adhered to the printed film tape 51, each wireless tag circuit element 32 is located at a position equal to the distance l1 from each sensor mark 65 to the antenna 33 and the reflective sensor 35 in the tape discharging direction (a direction indicated by an arrow A1). Further, the read/write module 93 is provided so as to read information stored in the memory part 125 of the wireless tag circuit element 32 on the printed label tape 28 via the antenna 33 or to write the predetermined information into the memory part 125.

As described above, the tape printer 1 of Embodiment is structured such that the antenna 33 is provided downstream of the tape transferring direction of the tape discharging port 27 through which the printed label tape 28 of the tape cassette 21 is discharged. Owing to the structure, when the wireless information circuit elements 32 to be adhered to the printed label tape 28 are arranged on the double-sided adhesive tape 53 at a predetermined pitch L in the tape cassette 21, it becomes possible to miniaturize the tape cassette 21, thereby achieving miniaturization of the tape printer 1. In addition, since predetermined information can be directly read or written from or into the wireless tag circuit element 32 of the printed label tape 28 discharged through the tape discharging port 27 of the tape cassette 21 via the antenna 32, a mechanism for transferring the tape to the antenna 33 after cutting by a predetermined length is not required. Therefore, the tape printer 1 can be miniaturized easily.

Further, the antenna 33 is located at the distance l1 downstream of the tape transferring direction of the cutter unit 30 for cutting the printed label tape 28 discharged through the tape discharging port 27. Due to this arrangement, upon reading or writing predetermined information via the antenna 33 from or into the wireless tag circuit element 32 adhered to the printed label tape 28, the printed label tape 28 can be cut without shifting its position. Since the margin of the printed label tape 28 can be adequately cut, users do not need to cut the margin after creating the printed label tape 28 provided with the wireless tag circuit element, thereby improving work efficiency.

Further, the reflective sensor 35 detects the sensor mark 65 on the printed label tape 28 discharged through the tape discharging port 27, so that a relative position of the wireless tag circuit element 32 adhered to the printed label tape 28 with respect to the reflective sensor 35 can be detected accurately. Therefore, a relative positional relation of the wireless tag circuit element 32 and the antenna in the tape transferring direction can be detected accurately.

Further, since the reflective sensor 35 is located at the opposite side of the antenna 33 interposing the printed label tape 28, the distance from the reflective sensor 35 to the antenna 33 in the tape transferring direction can be minimized. This contributes to saving of a space for arranging the reflective sensor 35 and the antenna 33 with ease, thereby achieving further miniaturization of the tape printer 1.

Further, the wireless tag circuit elements 32 are located at a predetermined pitch respectively at positions equal to the distance l1 from the sensor marks 65 in the tape discharging direction. Thus, the CPU 81 can read or write predetermined information from or into the wireless tag circuit element 32 via the read/write module 93, by transferring the printed label tape 28 by a predetermined pitch L after input of detection information that the sensor mark 65 has been detected. Accordingly, the wireless tag circuit element 32 can be transferred so as to be opposed to the antenna 33 accurately, by transferring the printed tape 28 by a distance (L−l1) of subtraction of the distance l1 from the predetermined pitch L after detection of the sensor mark 65. This contributes to improvement in reliability of data transmission and reception. At the same time, an output power of the read/write module 93 of the tape printer 1 can be made small so that power consumption of the read/write module 93 can be lowered.

Further, the CPU 81 carries out drive control of the thermal head 9 and the tape feed motor 92 in order that printing is started after the sensor mark 65 is detected via the reflective sensor 35. Accordingly, by transferring the tape by the distance (L−(l1+l2)) after printing is started, the wireless tag circuit element 32 can be located opposed to the antenna 33 and at the same time, the cutter unit 30 and the top edge portion of the next sensor mark 65 can be assuredly opposed to each other.

Embodiment 2

Next, a tape cassette and a tape printer according to Embodiment 2 will be described based on FIGS. 40 to 50. In the following description, the reference numerals identical to those of the constituent elements of the tape cassette 21 and the tape printer 1 according to Embodiment 1 illustrated in FIGS. 1 to 39 denote the same or equivalent constituent elements of the tape cassette 21 and the tape printer 1 according to Embodiment 1.

The schematic structures of the tape cassette and tape printer according to Embodiment 2 are substantially the same as the structures of the tape cassette 21 and the tape printer 1 according to Embodiment 1. Further, the control processings executed by the printer are substantially the same control processings executed by the printer 1 according to Embodiment 1.

However, the relative positional relationship between the individual sensor marks 65 provided at a predetermined pitch in the length L of the "pitch length L of IC chip" on the double-sided adhesive tape 53 accommodated in the tape cassette 21 and the individual wireless tag circuit elements 32 differs from the structure of the double-sided adhesive tape 53 accommodated in the tape cassette 21 according to Embodiment 1. Therefore, the printing control processing for creating the printed label tape executed in the tape printer according to Embodiment 2 differs from the printing control processing (S11 to S18) for creating the printed label tape 28 executed in the tape printer 1 according to Embodiment 1.

First of all, a relative positional relationship between the sensor marks 65 printed on the back surface of the release paper 53D of the double-sided adhesive tape 53 accommodated in the tape cassette 21 according to Embodiment 2 and the wireless tag circuit elements 32 will be described based on FIG. 40.

Figure 40:
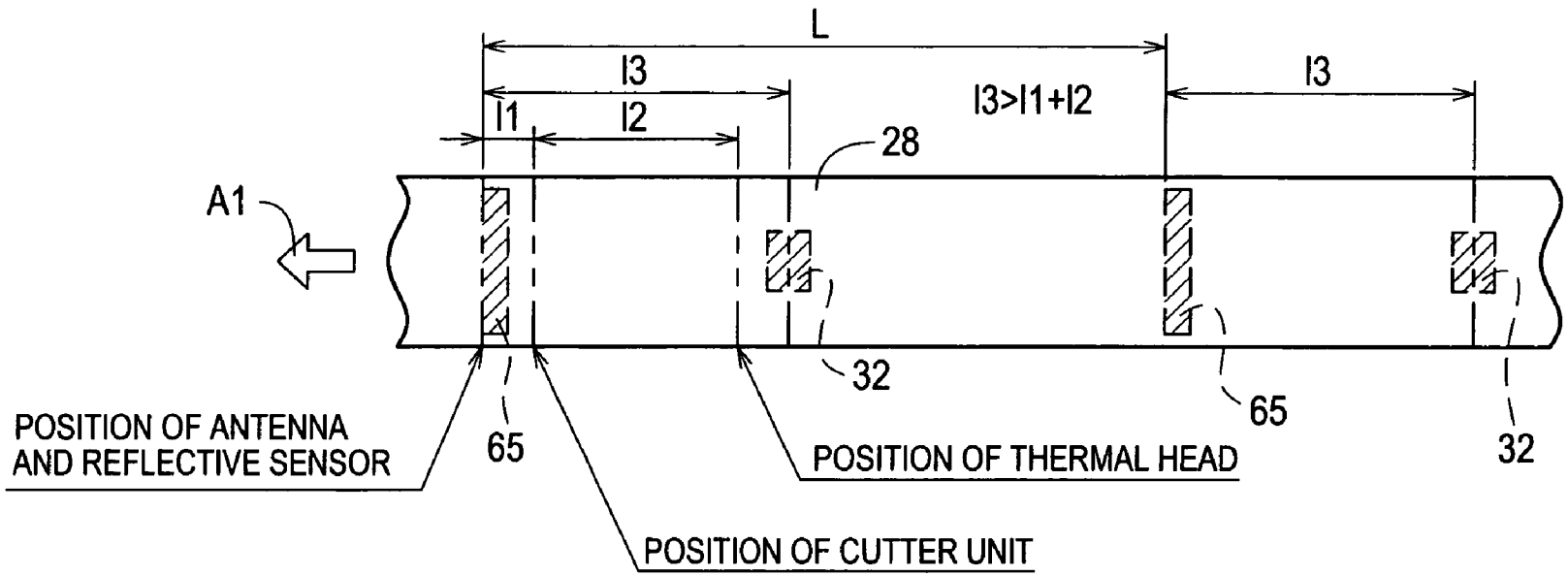
FIG. 40 is a schematic diagram showing relative positional relationship between a sensor mark, which is printed on the back surface of a base member tape of a double-sided adhesive tape of a tape cassette according to Embodiment 2, and a wireless tag circuit element, which is contained in the base member tape.

As shown in FIG. 40, the sensor marks 65 each in the shape of vertically elongated rectangle long in the width direction when viewed from the front are printed at a predetermined pitch L on the back surface of the release paper of the double-sided adhesive tape 53 beforehand along the tape feed direction so as to be vertical and symmetric with respect to the center line in the tape width direction. On the double-sided adhesive tape 53, each wireless tag circuit elements 32 is disposed between the sensor marks 65 on the center line in the tape width direction, at the opposite side to the sensor mark 65 in the tape discharge direction (the direction along the arrow A1), that is, at the position equal to a distance l3 upstream in the tape transfer direction. In this manner, the wireless tag circuit elements 32 are mounted beforehand on the double-sided adhesive tape 53 at a predetermined pitch L along the tape transfer direction on the center line in the tape width direction.

Further, an antenna 33 and a reflective sensor 35 are located apart from a cutter unit 30 by a distance l1 in the tape transfer direction. The cutter unit 30 is located apart from a thermal head 9 by a distance l2 in the tape transfer direction. The distance l3 between each sensor mark 65 and each wireless tag circuit element 32 is set to be larger than the sum (l1+l2) of the distance l1 and the distance l2.

Therefore, when the sensor mark 65 of the printed label tape 28 has reached the position opposed to the antenna 33 and the reflective sensor 35, the cutter unit 30 results in facing the position apart from the sensor mark 65 by the tape length l1 at the side of the tape cassette 21. Further, the thermal head 9 is located at the side of the tape cassette 21 from the sensor mark 65 facing to the antenna 33 and the reflective sensor 35, that is, at the position apart by the tape length (l1+l2) upstream in the tape transfer direction, and results in facing the film tape 51 overlapped with the ink ribbon 52. When the sensor mark 65 on the printed label tape 28 is transferred by the distance (l1+l2) from the position facing the antenna 33 and the reflective sensor 35, the wireless tag circuit element 32 is disposed at the position at the side of the thermal head 9 apart from the cutter unit 30 by the tape length (l3−(l1+l2)).

Next, a printing control processing for creating a printed label tape 28 will be described based on FIGS. 41 to 50.

Figure 41:
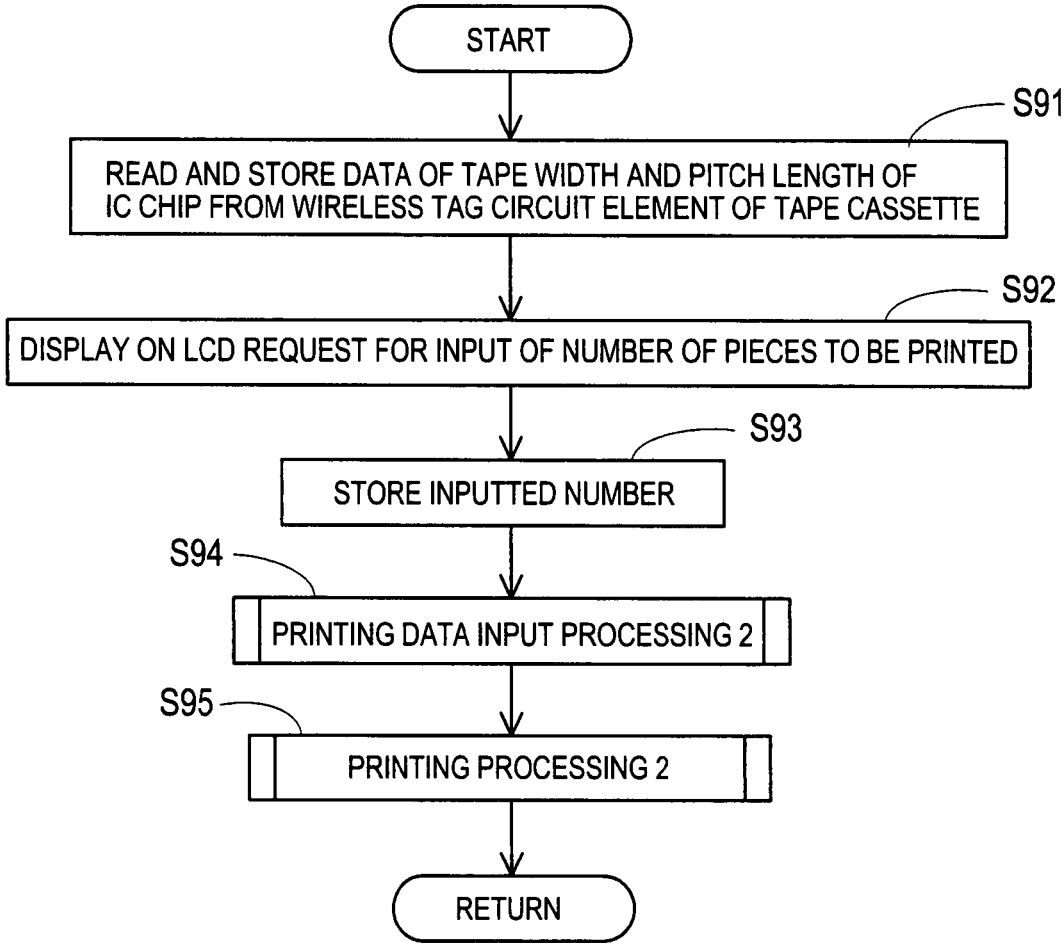
FIG. 41 is a main flowchart of a printing control processing for creating a printed label tape of the tape printer according to Embodiment 2.

As shown in FIG. 41, first of all, in S91, a CPU 81 of the tape printer 1 reads cassette information related to the kind of the film tape 51 and the like accommodated in this tape cassette 21 stored on the cassette information table 132 stored in the memory part 125 of the wireless tag circuit element 25 of the tape cassette 21 via a read/write module 93, and controls the RAM 85 to store the read cassette information.

The cassette information table 132 stored in the memory part 125 of the wireless tag circuit element 32 stores data of "distance between the sensor mark and the IC chip" indicative of the distance l3 between the sensor mark 65 and the wireless tag circuit element 32, on top of the data of "tape width", "tape type", "tape length", "pitch length L of IC chip", "ink ribbon type", and "ink ribbon color" described above.

For example, the CPU 81 reads from the wireless tag circuit element 25 via the read/write module 93, "6 mm" as data of "tape width", "laminate tape" as data of "tape kind", "8 m" as data of "tape length", "50 mm" as data of "pitch length L of IC chip", "30 mm" as data of "distance between the sensor mark and the IC chip" indicative of the distance 13 between the sensor mark 65 and the wireless tag circuit element 32, "for lamination" as data of "ink ribbon type", and "black" as data of "ink ribbon color". Then, the CPU 81 controls a RAM 85 to store these data.

Then, in S92, the CPU 81 controls a liquid crystal display 7 to display a request for inputting the required number of pieces of printed label tapes, that is, the number of pieces to be printed of the printed label tapes 28 each having the wireless tag circuit element 32. Then, the CPU 81 waits until the required number of pieces to be printed is inputted with the keyboard 6.

For example, the CPU 81 controls the liquid crystal display 7 to display "input the number of pieces to be printed" in its upper portion, whereas to display "how many pieces?" in the lower portion thereof. Then, the CPU 81 waits until the number is inputted with the keyboard 6.

Subsequently, in S93, if the number of pieces to be printed is inputted with the keyboard 6, the CPU 81 controls the liquid crystal display 7 to display the input required number of pieces to be printed, and controls the RAM 85 to store it. Then, in S94, the CPU 81 executes a sub-processing of the "print data inputting processing 2". After that, in S95, the CPU 81 executes the sub-processing of the "print processing 2", and after the execution, the CPU 81 terminates this processing.

Next, the sub-processing of the "print data inputting processing 2" of S94 will be described based on FIG. 42.

Figure 42:
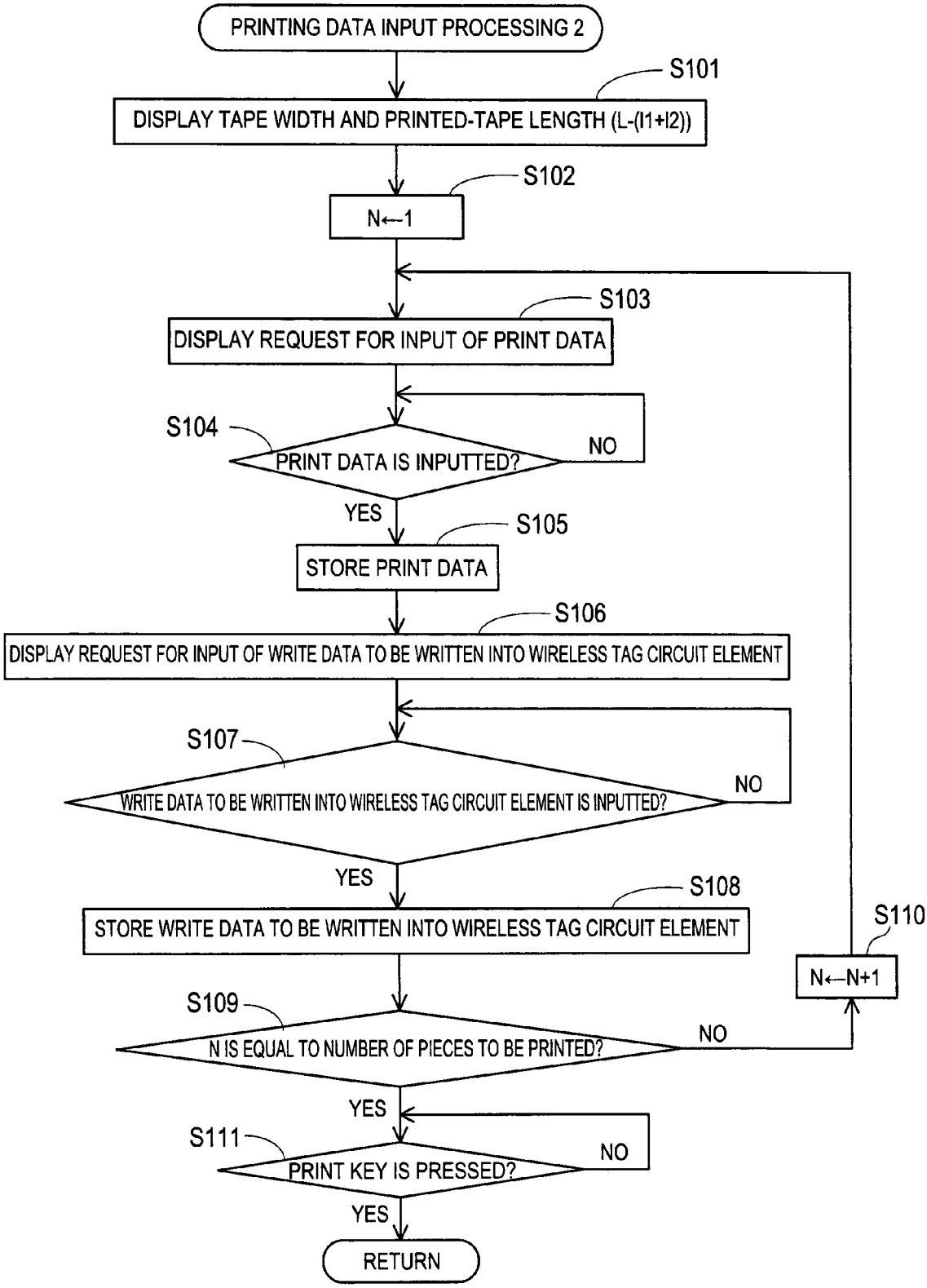
FIG. 42 is a sub flowchart explaining a print data input processing 2 executed at the time when creating the printed label tape of the tape printer according to Embodiment 2.

As shown in FIG. 42, in S101, first of all, the CPU 81 reads from the ROM 83 the distance l1 in the transfer direction extending from the antenna 33 and the reflective sensor 35 to the cutter unit 30, and the distance l2 in the transfer direction extending from the cutter unit 30 to the thermal head 9, and controls the RAM 85 to store the sum (l1+l2) of the distance l1 in the transfer direction and the distance l2 in the transfer direction. Then, the CPU 81 reads the data of "pitch length L of IC chip" from the cassette information related to the tape cassette 21 that stored in the RAM 85, and controls the RAM 85 to store the value obtained by deducting the sum (l1+l2) from this pitch length L as a printed tape length (L−(l1+l2)). Subsequently, the CPU 81 reads the printed tape length (L−(l1+l2)) from the RAM 85 and the data of "tape width" of the film tape 51 from the cassette information related to this tape cassette 21, and controls the liquid crystal display 7 to display these data.

Then, in S102, the CPU 81 reads an algebra N denoting the number of pieces of print data from the RAM 85. The CPU 81 substitutes "1" into this algebra N, and again controls the RAM 85 to store the resultant value.

Further, in S103, the CPU 81 controls the liquid crystal display 7 to display a request for inputting the print data of the first piece.

Subsequently, in S104, the CPU 81 waits until the print data is inputted with the keyboard 6 (S104: No). If the print data is inputted with the keyboard 6 (S104: Yes), in S105, the CPU 81 stores this print data into the editing input area 85B as the print data of the Nth label tape, that is, the first label tape.

Then, in S106, the CPU 81 controls the liquid crystal display 7 to display a request for inputting write data to be written into the wireless tag circuit element 32 on the first label tape. Examples of the write data include data such as price, consume-by date, produced date, name of manufacturing plant of an article which the user directly inputs with the keyboard 6, file data related to article information which is inputted from an external computer via the communication interface 87 and is stored in the RAM 85 beforehand, and the like.

Then, in S107, the CPU 81 waits until the write data to be written into the wireless tag circuit element 32 is inputted (S107: No). If data such as a price of an article, and a file name related to article information are inputted with the keyboard 6 (S107: Yes), in S108, the CPU 81 controls the RAM 85 to store the data such as a price of the article inputted with the keyboard 6, and the file data related to the article information as write data to be stored in the memory part 125 of the wireless tag circuit element 32 of the first piece of the label tape.

Subsequently, in S109, the CPU 81 reads the algebra N from the RAM 85, and executes a determination processing for determining whether or not the algebra N is equal to the number of pieces to be printed. If the CPU 81 determines that the algebra N is smaller than the number of pieces to be printed (S109: No), in S110, the CPU 81 adds "1" to the algebra N, and controls the RAM 85 to store this resultant value. Then, the CPU 81 again executes the processing of S103 and thereafter.

On the other hand, if the algebra N is equal to the number of pieces to be printed (S109: Yes), in S111, the CPU 81 waits until the print key 3 is pressed (S111: No). If the print key 3 is pressed (S111: Yes), the CPU 81 terminates this sub-processing, and returns to the main flow chart.

Next, a sub-processing of the "printing processing 2" in S95 will be described based on FIGS. 43 to 50.

Figure 43:
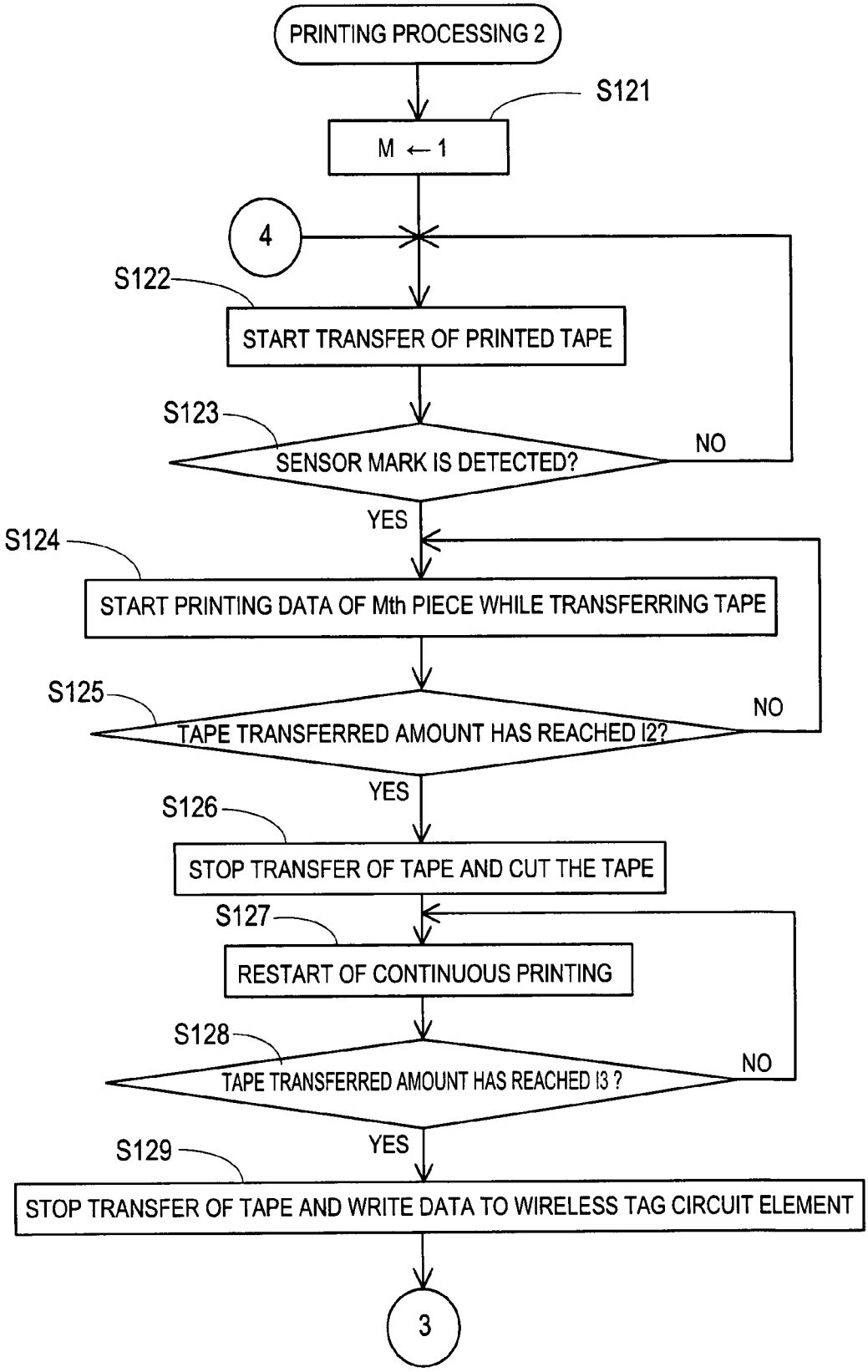
FIG. 43 is a sub flowchart explaining a printing processing executed at the time when creating the printed label tape of the tape printer according to Embodiment 2.
Figure 44:
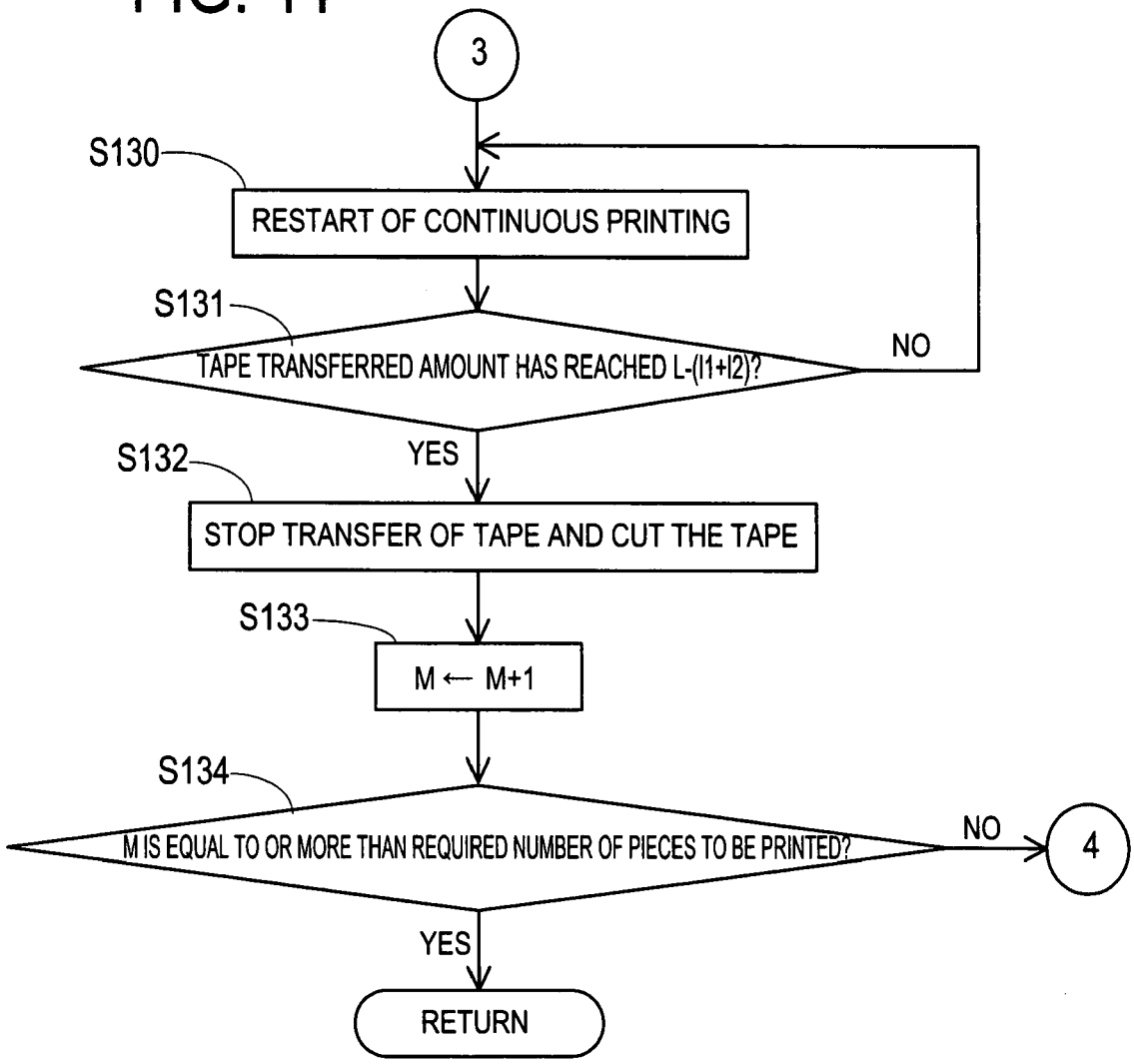
FIG. 44 is the sub flowchart explaining the printing processing executed at the time when creating the printed label tape of the tape printer according to Embodiment 2.
Figure 45:
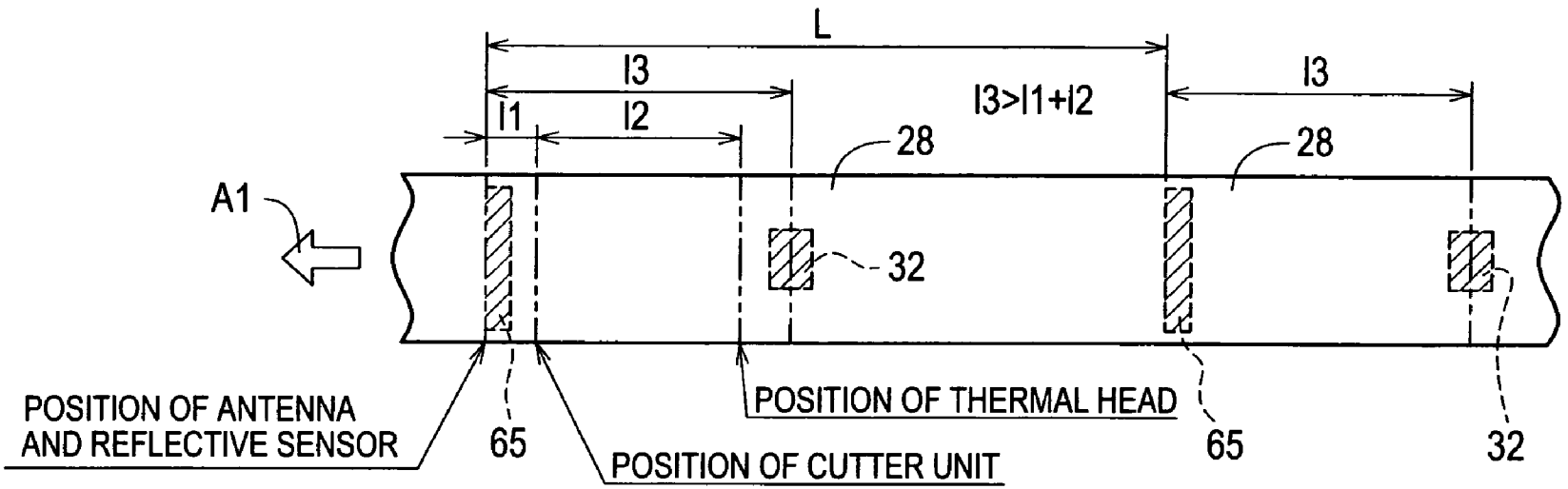
FIG. 45 is a schematic explanatory view of one example of the printed label tape of the tape printer according to Embodiment 2, the view schematically showing relative positional relationship between the sensor mark and the wireless tag circuit element.

As shown in FIGS. 43 and 44, in S121, first of all, the CPU 81 reads an algebra M denoting the number of pieces of printed label tapes 28 from the RAM 85. Then, the CPU 81 substitutes "1" into this algebra M, and controls the RAM 85 to again store the resultant value.

Then, in S122, first of all, the CPU 81 drives the tape feed motor 92 to rotate the tape feed roller 63, so as to start the transfer of the printed label tape 28 by this tape feed roller 63 and the tape sub-roller 11.

Then, in S123, the CPU 81 executes a determination processing for determining whether or not the sensor mark 65 printed on the back surface of the printed label tape 28 has been detected via the reflective sensor 35. If no sensor mark 65 has been detected via the reflective sensor 35 (S123: No), the CPU 81 again executes the processing of S122 and thereafter.

On the other hand, if the CPU 81 has detected the top end portion in the transfer direction of the sensor mark 65 via the reflective sensor 35 (S123: Yes), in S124, the CPU 81 reads an algebra M denoting the number of pieces of the printed label tapes 28 from the RAM 85, and again drives the tape feed motor 92 to feed the film tape 51 while starts to print the print data of Mth piece of the tape, that is, the first piece of the tape with the thermal head 9.

Figure 46:
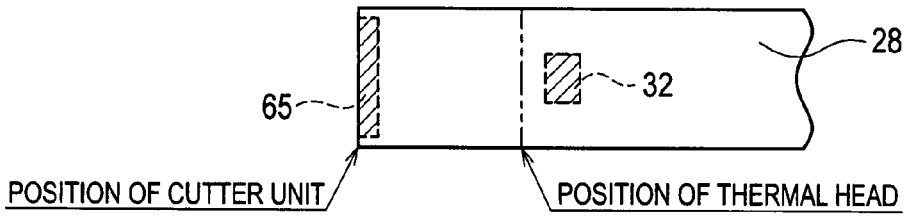
FIG. 46 is a schematic explanatory view of one example of creating one sheet of printed label tape of the tape printer according to Embodiment 2, the view showing a state of the printed label tape in a stand-by state.
Figure 47:
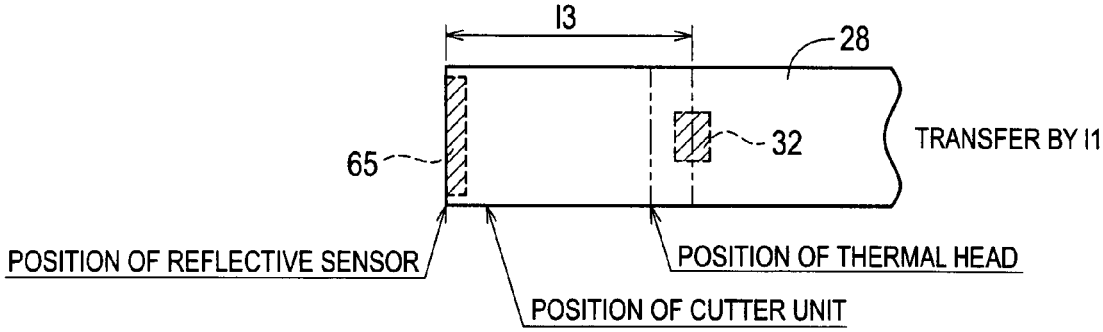
FIG. 47 is a view showing a state of the printed label tape at the start of printing, following the state in FIG. 46 and after the tape is transferred.

For example, as shown in FIGS. 46 to 47, when the print key 3 is pressed, if the top end portion in the transfer direction of the sensor mark 65 is opposed to the cutter unit 30, the CPU 81 drives the tape feed motor 92 to rotate the tape feed roller 63, and starts to feed the printed label tape 28 by this tape feed roller 63 and the tape sub-roller 11. If the transferred amount of the printed label tape 28 has reached the distance l1 in the transfer direction extending from the antenna 33 and the reflective sensor 35 to the cutter unit 30, the top end portion in the transfer direction of the sensor mark 65 is detected by the reflective sensor 35. Then, printing of print data is started with the thermal head 9.

Then, in S125, the CPU 81 reads from the RAM 85 the distance l2 in the transfer direction, and executes a determination processing for determining whether or not the tape transferred amount achieved since the top end portion in the transfer direction of the sensor mark 65 has been detected via the reflective sensor 35 has reached the distance l2 in the transfer direction. If the tape transferred amount achieved since the top end portion in the transfer direction of the sensor mark 65 has been detected has not reached the distance l2 in the transfer direction (S125: No), the CPU 81 again executes the processing of S124 and thereafter.

On the other hand, if the tape transferred amount achieved since the top end portion in the transfer direction of the sensor mark 65 has been detected has reached the distance l2 in the transfer direction (S125: Yes), in S126, the CPU 81 stops the tape feed motor 92 to stop the transfer of the printed label tape 28, and at the same time, stops the thermal head 9. After that, the CPU 81 drives the cutting motor 96 to cut the top end side in the transfer direction of the printed label tape 28. As a result, the margin at the top end portion in the transfer direction of the printed label tape 28 which corresponds to the distance in the transfer direction (l1+l2) from the antenna 33 and the reflective sensor 35 to the thermal head 9 can be automatically cut. Thus, after the creation of the printed label tape 28, there is no need for the user to cut the margin at the top end portion in the transfer direction. As a result, the operation efficiency can be enhanced.

Figure 48:
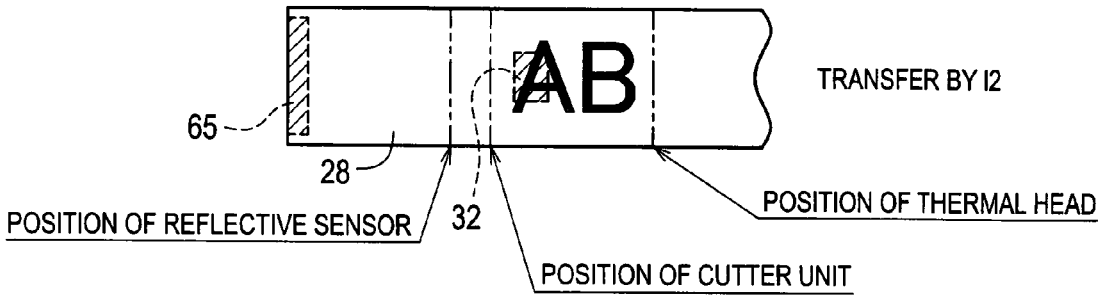
FIG. 48 is a view showing a state of the printed label tape in cutting the top end portion thereof, following the state in FIG. 47 and after the tape is transferred by the distance l2 from the printing start position.

For example, as shown in FIG. 48, in the case where the printing is started to print letters "AB" onto the film tape 51 with the thermal head 9 and the transferred amount of the film tape 51, that is, the transferred amount of the printed label tape 28 has reached the distance l2 between the cutter unit 30 and the thermal head 9 from the printing start position, the CPU 81 stops the tape feed motor 92 and then stops the thermal head 9. After that, the CPU 81 drives the cutting motor 96 to cut the margin at the top end portion in the transfer direction of the printed label tape 28.

Subsequently, in S127, after cutting the top end side in the transfer direction of the printed label tape 28, the CPU 81 again starts to drive the tape feed motor 92 and also continues to print the print data with the thermal head 9.

Further, in S128, the CPU 81 reads from the RAM 85 the data of "a distance between the sensor mark and the IC chip" denoting the distance l3 between the sensor mark 65 and the wireless tag circuit element 32, and executes a determination processing for determining whether or not the tape transferred amount achieved since the top end portion in the transfer direction of the sensor mark 65 has been detected via the reflective sensor 35 has reached the distance l3 denoting the "distance between the sensor mark and the IC chip". If the tape transferred amount achieved since the top end portion in the transfer direction of the sensor mark 65 has been detected has not reached the distance l3 (S128: No), the CPU 81 again executes the processing of S127 and thereafter.

On the other hand, if the tape transferred amount achieved since the top end portion in the transfer direction of the sensor mark 65 has been detected has reached the distance l3 (S128: Yes), in S129, the CPU 81 stops the tape feed motor 92 to stop the transfer of the printed label tape 28. Then, the CPU 81 reads the write data from the RAM 85, and controls the memory part 125 of the wireless tag circuit element 32 to store this write data via the read/write module 93.

Figure 49:
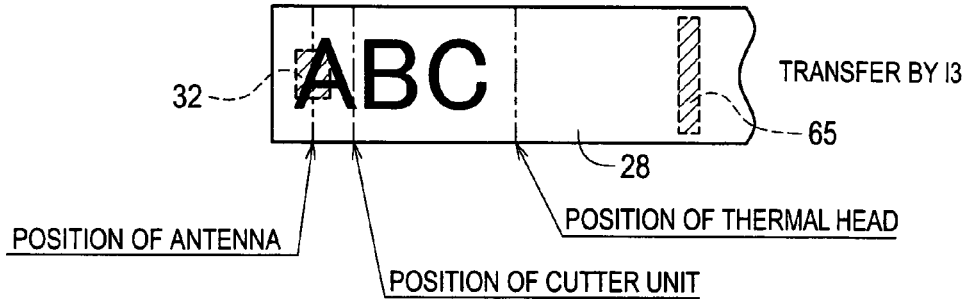
FIG. 49 is a view showing a state of the printed label tape in writing information into the wireless tag circuit element, following the state in FIG. 48.

For example, as shown in FIG. 49, if the tape transferred amount achieved since the top end portion in the transfer direction of the sensor mark 65 has been detected by the reflective sensor 35 has reached l3 (for example, 30 mm), the CPU 81 stops the tape feed motor 92. Then, the CPU 81 reads the write data from the RAM 85, and controls the memory part 125 of the wireless tag circuit element 32 to store this write data via the read/write module 93. In this case, the antenna 33 and the wireless tag circuit element 32 are opposed to each other via the space 49.

Subsequently, in S130, the CPU 81 again starts to drive the tape feed motor 92, and also continues to print the print data with the thermal head 9.

Further, in S131, the CPU 81 reads from the RAM 85 the distance l1 in the transfer direction and the distance l2 in the transfer direction and executes a determination processing for determining whether or not the tape transferred amount achieved since the margin at the top end portion in the transfer direction of the printed label tape 28 has been cut has reached (L−(l1+l2)). If the tape transferred amount achieved since the margin at the top end portion in the transfer direction of the printed label tape 28 has been cut has not reached (L−(l1+l2)) (S131: No), the CPU 81 again executes the processing of S130 and thereafter.

On the other hand, if the tape transferred amount achieved since the margin at the top end portion in the transfer direction of the printed label tape 28 has been cut has reached (L−(l1+l2)) (S131: Yes), in S132, the CPU 81 stops the tape feed motor 92 to stop the transfer of the printed label tape 28, and drives the cutting motor 96 to cut the rear end side in the transfer direction of the printed label tape 28.

Figure 50:
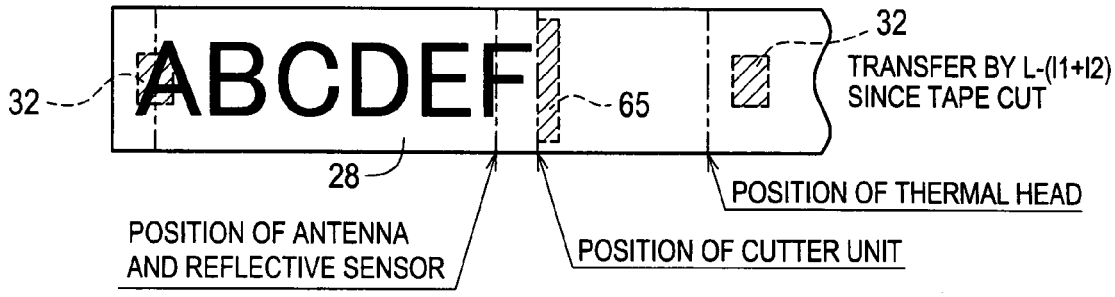
FIG. 50 is a view showing a state of the printed label tape in cutting the rear end side thereof, following the state in FIG. 49.

For example, as shown in FIG. 50, if the tape transferred amount achieved since the margin at the top end portion in the transfer direction of the printed label tape 28 has been cut has reached (L−(l1+l2)), the CPU 81 stops the tape feed motor 92. After that, the CPU 81 drives the cutting motor 96 to cut the rear end side in the transfer direction of the printed label tape 28, that is, along the top edge portion in the transfer direction of the sensor mark 65. Then, the printed label tape 28 is discharged through the label discharging port 16.

Then, in S133, the CPU 81 reads the algebra M from the RAM 85, and adds "1" to this algebra M and controls the RAM 85 to again store the resultant value.

After that, in S134, the CPU 81 reads the algebra M from the RAM 85, and executes a determination processing for determining whether or not this algebra M is equal to the required number of pieces to be printed. If the CPU 81 determines that the algebra M is smaller than the required number of pieces to be printed (S134: No), the CPU 81 again executes the processing of S122 and thereafter.

On the other hand, if the CPU 81 determines that the algebra M is equal to or more than the required number of pieces to be printed (S134: Yes), the CPU 81 terminates this sub-processing and returns to the main flow chart. In this manner, label tapes 28 each storing data such as a price of article in its wireless tag circuit element 32 are created in the number of print pieces inputted in the processing of S93.

Therefore, in the tape cassette 21 according to Embodiment 2, the sensor marks 65 are printed beforehand on the back surface on the double-sided adhesive tape 53 at a predetermined pitch L on the center line in the tape width direction. The wireless tag circuit element 32 is disposed between sensor marks 65 at the opposite side of each sensor mark 65 in the tape discharge direction (the direction shown by the arrow A1), that is, at a position equal to the distance 13 upstream of the tape transfer direction. Further, the antenna 33 and the reflective sensor 35 are disposed apart from the cutter unit 30 by the distance l1. The cutter unit 30 is disposed apart from the thermal head 9 by the distance 12. Then, the distance l3 between each sensor mark 65 and each wireless tag circuit element 32 is set to be larger than the sum (l1+l2) of the distance l1 and the distance l2. In this manner, after the top end portion in the transfer direction of the sensor mark 65 has been detected by the reflective sensor 35, when the tape transferred amount has reached the distance l2, the cutter unit 30 cuts the margin at the top end side of the printed label tape 28. After the cutting, when the tape transferred amount has reached the distance (L−(l1+l2)), the rear end side of the printed label tape 28 is cut. In this manner, a trouble that the wireless tag circuit element 32 is erroneously contained in the margin portion to be cut can be assuredly prevented, and the wireless tag circuit element 32 can be contained in the printed label tape 28 assuredly.

Further, in the tape printer 1 according to Embodiment 2, by merely inputting the number of pieces to be printed, the print data of each printed label tape 28, and the data to be written into each wireless tag circuit element 32, it is possible to create the number of pieces of the label tapes 28 equal to each other in the length (L−(l1+l2)) and each containing the wireless tag circuit element 32, based on the information stored in the wireless tag circuit element 25 of the tape cassette 21. Further, information such as a price of article and the like can be accurately written into each wireless tag circuit element 32 via the read/write module 93.

Further, by transferring the printed tape 28 by the distance l3 after detection of the sensor mark 65, it is possible to transfer the wireless tag circuit element 32 so as to be opposed to the antenna 33 accurately. This contributes to improvement in reliability of data transmission and reception. At the same time, an output power of the read/write module 93 of the tape printer 1 can be made small so that power consumption of the read/write module 93 can be lowered.

Further, the CPU 81 carries out drive control of the thermal head 9 and the tape feed motor 92 in order that printing is started after the sensor mark 65 is detected via the reflective sensor 35. Accordingly, by transferring the tape by the distance (L−(l1+l2)) after printing is started, the cutter unit 30 and the edge of the next sensor mark 65 can be assuredly opposed to each other.

Embodiment 3

Next, a tape cassette and a tape printer according to Embodiment 3 will be described based on FIGS. 51 to 53. In the following description, the reference numerals identical to those of the constituent elements of the tape cassette 21 and the tape printer 1 according to Embodiment 1 illustrated in FIGS. 1 to 39 denote the same or equivalent constituent elements of the tape cassette 21 and the tape printer 1 according to Embodiment 1.

The schematic structures of the tape cassette and tape printer according to Embodiment 3 are substantially the same as the structures of the tape cassette 21 and the tape printer 1 according to Embodiment 1. Further, the control processings executed by the tape printer are substantially the same control processings executed by the tape printer 1 according to Embodiment 1.

However, the structure of the parameter table stored in the wireless tag circuit element 25 disposed on the outer peripheral side wall surface 24 of the tape cassette 21 differs from the structure of the parameter table 131 stored in the wireless tag circuit element 25 of the tape cassette 21 according to Embodiment 1. Therefore, the tape printer according to Embodiment 3 differs from the control processing (S1 to S9) for setting the print control parameters and the like for the tape printer 1 according to Embodiment 1 on the point that the tape printer according to Embodiment 3 executes control processing for automatically setting print control parameters and the like when the tape printer is turned on.

First of all, an example of a parameter table and a cassette information table to be stored in the memory part 125 of the wireless tag circuit element 25 in the tape cassette 21 according to Embodiment 3 will be described based on FIGS. 51 and 52.

As shown in FIG. 51, the memory part 125 of the wireless tag circuit element 25 provided in the tape cassette stores a parameter table 135 storing print control information for executing printing on the film tape 51 accommodated in the tape cassette 21 for each of the models A to C of the tape printer 1.

The parameter table 135 includes "model names" indicative of individual models of the tape printer 1, and "print control parameters" corresponding to individual "model names".

The "model names" respectively include "Model A", "Model B", and "Model C". "Parameter A10" is stored as a "print control parameter" for "Model A". "Parameter B10" is stored as a "print control parameter" for "Model B". "Parameter C10" is stored as a "print control parameter" for "Model C".

"Parameter A10" includes "Parameter A1" which is a print control parameter for the case where the drive power supply of the parameter table 131 is "dry battery", "Parameter B1" which is a print control parameter for the case where the drive power supply is "AC adaptor", and "Parameter C1" which is a print control parameter for the case where the drive power supply is "AC power supply".

Further, "Parameter B10" includes "Parameter A2" which is a print control parameter for the case where the drive power supply of the parameter table 131 is "dry battery", "Parameter B2" which is a print control parameter for the case where the drive power supply is "AC adaptor", and "Parameter C2" which is a print control parameter for the case where the drive power supply is "AC power supply".

Further, "Parameter C10" includes "Parameter A3" which is a print control parameter for the case where the drive power supply of the parameter table 131 is "dry battery", "Parameter B3" which is a print control parameter for the case where the drive power supply is "AC adaptor", and "Parameter C3" which is a print control parameter for the case where the drive power supply is "AC power supply".

Further, as shown in FIG. 52, the memory part 125 of the wireless tag circuit element 25 provided in the tape cassette 21 stores cassette information table 136 that stores cassette information related to the kind of the film tape 51 accommodated in the tape cassette 21 and the like. The structure of the cassette information table 136 is the same as the structure of the cassette information table 132 according to Embodiment 1.

The cassette information table 136 stores, as an example, "6 mm" as the "tape width", "laminate tape" as the "tape type", "8 m" as the "tape length", "50 mm" as the "pitch length L of IC chip", "for lamination" as the "ink ribbon type", and "black" as the "ink ribbon color".

Next, a control processing for setting print control parameters executed at the time when thus-structured tape printer 1 is turned on will be described based on FIG. 53.

Figure 53:
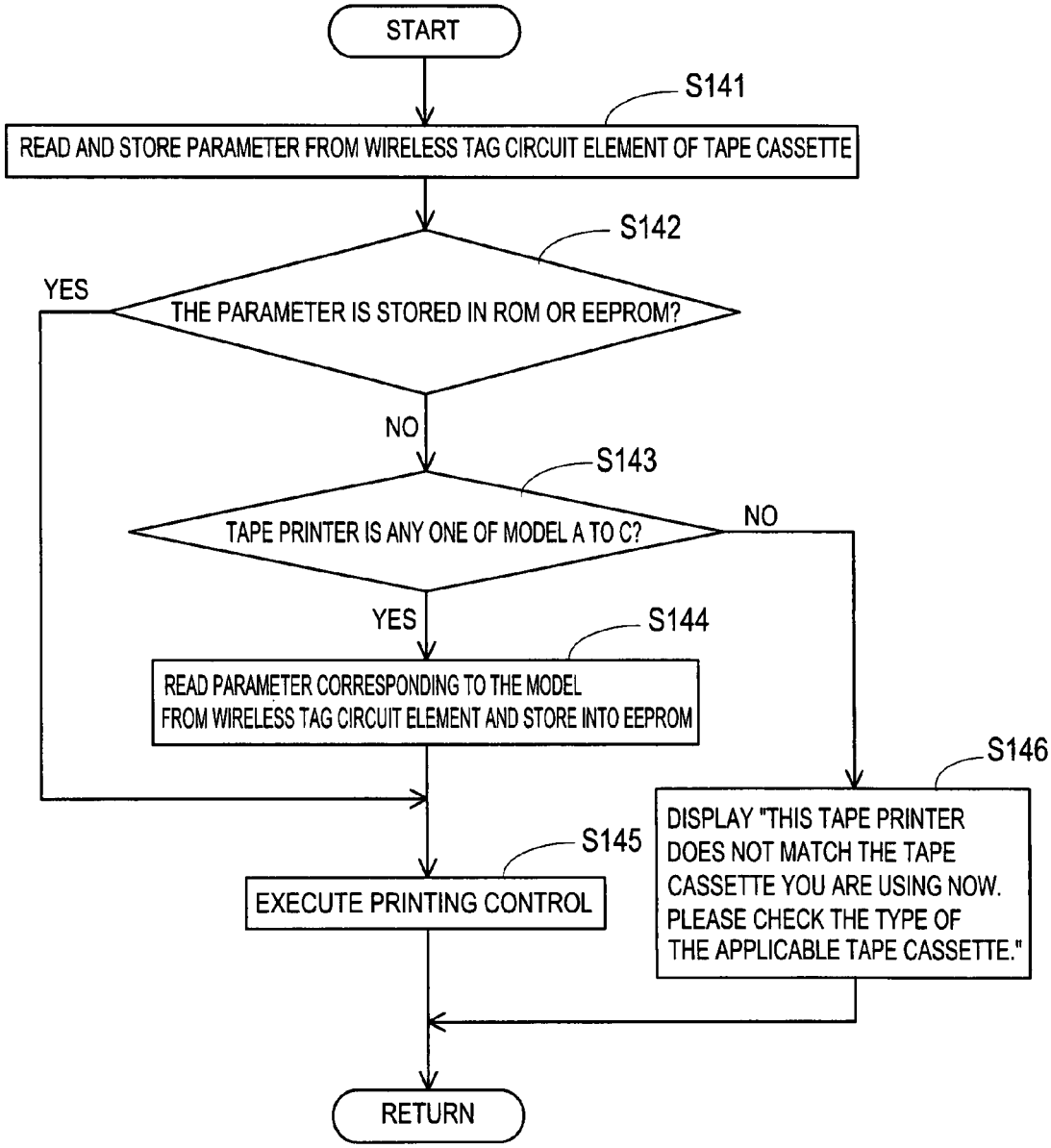

As shown in FIG. 53, first of all, in S141, when the tape printer 1 is turned on, the CPU 81 of the tape printer 1 reads print control information such as the "model name" from the parameter table 135 stored in the memory part 125 of the wireless tag circuit element 25 provided to the tape cassette via the read/write module 93, and stores the read information into the RAM 85.

Then, in S142, the CPU 81 again reads print control information of the parameter table 135 from the RAM 85, and executes determination processing for determining whether or not this print control parameter corresponding to the print control information is stored in the ROM 83 or the flash memory 84.

If the print control parameter corresponding to the print control information read from the RAM 85 is stored neither ROM 83 nor flash memory 84 (S142:No), in S143, the CPU 81 executes a determination processing for determining the "model name" of the tape printer 1 is either one of "Model A", "Model B", and "Model C".

Subsequently, if the "model name" of the tape printer 1 is either one of "Model A", "Model B", or "Model C" (S143: Yes), in S144, the CPU 81 reads the print control parameter corresponding to the "model name" of the tape printer 1 from the memory part 125 of the wireless tag circuit element 25 of the tape cassette 21 via the read/write module 93, and stores it into the flush memory 84 as a print control parameter for the tape cassette 21. For example, if the "model name" of the tape printer 1 is "Model A", the CPU 81 reads "Parameter A10" from the memory part 125 of the wireless tag circuit element 25 of the tape cassette 21 as a print control parameter, and stores it into the flash memory 84 as a print control parameter of the tape cassette 21.

After that, in S145, the CPU 81 reads the print control parameter of the tape cassette 21 from the ROM 83 or the flash memory 84, and executes printing control. After the execution, the CPU 81 terminates this processing.

On the other hand, in S142, if the print control parameter corresponding to the print control information read from the RAM 85 is stored in the ROM 83 or the flash memory 84 (S142: Yes), in S145, the CPU 81 reads the print control parameter of the tape cassette 21 from the ROM 83 or the flash memory 84, and executes printing control. After the execution, the CPU 81 terminates this processing.

On the other hand, in S143, if the "model name" of the tape printer 1 is neither "Model A", "Model B", nor "Model C" (for example, if the tape printer 1 is "Model D" and the tape cassette 21 is a type capable of accommodating a tape width of 6 mm up to 12 mm but the width of the tape of the tape cassette 21 mounted to the cassette housing part 8 is 18 mm) (S143: No), in S146, the CPU 81 controls the liquid crystal display 7 to display a message "This tape printer does not match the tape cassette you are using now. Please check the type of the applicable tape cassette". Then, the CPU 81 terminates this processing.

As described above, in the tape cassette 21 of Embodiment 3, since the print control parameter corresponding to each tape type such as the film tape 51 to be accommodated in this tape cassette 21 is stored in the wireless tag circuit element 25 for each type of the tape printer 1. Thus, it is possible to employ a new type of tape cassette 21 having a specification different from conventional cassettes and manufactured after various types of tape printers have been sold.

Further, in the tape printer 1 of Embodiment 3, even if the print control parameter corresponding to the tape cassette 21 mounted to the cassette housing part 8 is stored neither the ROM 83 nor the flash memory 84, as far as the print control parameter corresponding to the "model name" of the tape printer 1 is stored in this wireless tag circuit element 25, the CPU 81 automatically reads the corresponding print control parameter from the wireless tag circuit element 25 of the tape cassette 21 via the read/write module 93, and can execute printing control even if a new type of tape cassette 21 having a specification different from a conventional one is mounted. Further, when a new tape cassette 21 is mounted, the CPU 81 automatically reads the corresponding print control parameter from the wireless tag circuit element 25 of the tape cassette 21 via the read/write module 93. Thus, there is no need of inputting control conditions of the tape printer 1 such as "a model name", "a drive power supply", and the like. As a result, the tape printer 1 can be used more conveniently and the operation efficiency is enhanced.

Embodiment 4

Next, a tape cassette and a tape printer according to Embodiment 4 will be described based on FIGS. 54 to 57. In the following description, the reference numerals identical to those of the constituent elements of the tape cassette 21 and the tape printer 1 according to Embodiment 1 illustrated in FIGS. 1 to 39 denote the same or equivalent constituent elements of the tape cassette 21 and the tape printer 1 according to Embodiment 1.

The schematic structures of the tape cassette and the tape printer according to Embodiment 4 are substantially the same as the structures of the tape cassette 21 and the tape printer 1 according to Embodiment 1. Further, the control processings executed by the tape printer are substantially the same control processings executed by the tape printer 1 according to Embodiment 1.

However, the structure of attaching the wireless tag circuit element 25 provided to the tape cassette differs from the structure of attaching the wireless tag circuit element 25 provided to the tape cassette 21 according to Embodiment 1. Further, the structure of mounting the tape cassette to the cassette housing part 8 differs from the structure of mounting the tape cassette 21 to the cassette housing part 8.

First of all, the structure of the tape cassette and the cassette housing part 8 according to Embodiment 4 will be described based on FIGS. 54 to 56.

Figure 54:
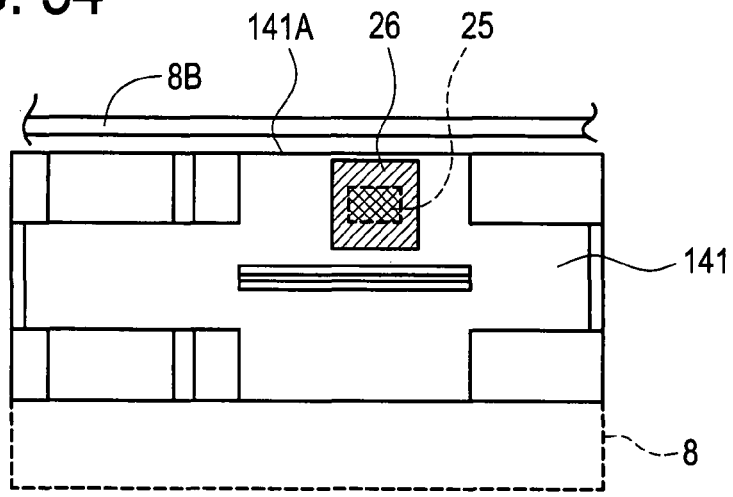
FIG. 54 is a side view showing relative positional relationship between a wireless tag circuit element and an antenna when a tape cassette is mounted to a cassette housing part of a tape printer according to Embodiment 4.
Figure 55:
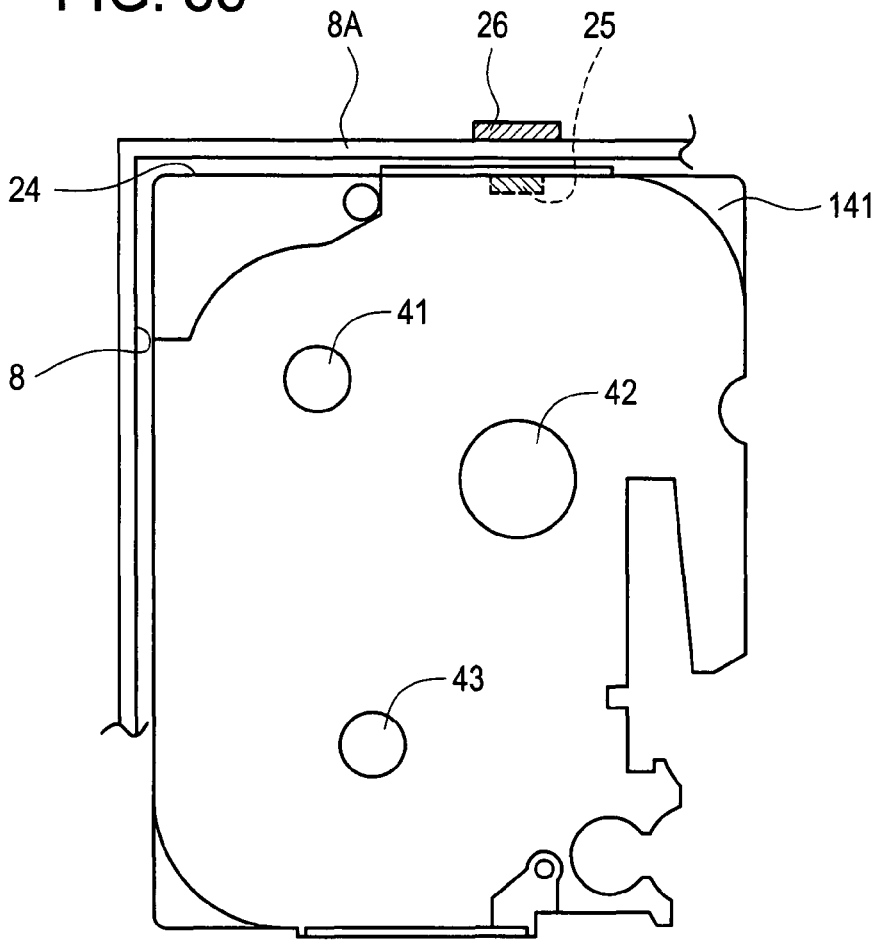
FIG. 55 is a plain view showing relative positional relationship between the wireless tag circuit element and the antenna when the tape cassette is mounted to the cassette housing part of the tape printer according to Embodiment 4.
Figure 56:
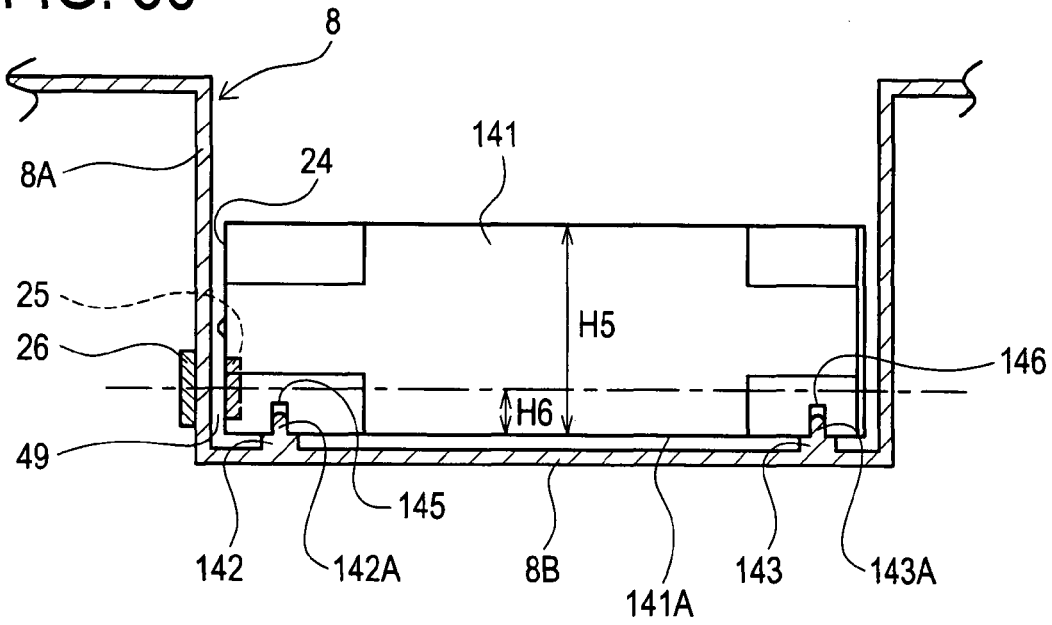
FIG. 56 is a sectional side view showing relative positional relationship between the wireless tag circuit element and the antenna when the tape cassette is mounted to the cassette housing part of the tape printer according to Embodiment 4.

As shown in FIGS. 54 to 56, reception parts 142, 143 are provided on the bottom surface 8B of the cassette housing part 8 at the same height to which the bottom surface of the tape cassette 141 is brought into contact (for example, in the height of 0.2 to 3 mm, and preferably, 0.5 to 1 mm). On the upper end surface of the individual reception parts 142, 143, there are provided location projections 142A, 143A having predetermined heights (for example, height of 0.3 mm to 2 mm) to be inserted and fitted into location holes 145, 146 formed on the bottom surface 141A of the tape cassette 141. In this manner, the tape cassette 141 is properly positioned within the cassette housing part 8 by inserting and fitting the individual location holes 145, 146 formed on the bottom surface 141A thereof into the individual location projections 142A, 143A and bringing the bottom surface 141A into contact with the upper end surfaces of the reception parts 142, 143.

Next, a relative positional relationship between the wireless tag circuit element 25 and the antenna 26 in the case where the tape cassette 141 is mounted to the cassette housing part 8 will be described based on FIGS. 54 to 57.

As shown in FIGS. 54 to 56, the wireless tag circuit element 25 is disposed at the height H6 from the bottom surface 141A (for example, at the height of 2.5 mm to 6 mm) on the outer peripheral side wall surface 24 of the tape cassette 141 having a height of H5 (for example, a height of 15 mm). On the other hand, the antenna 26 provided on the side wall part 8A of the cassette housing part 8 is disposed at a position distanced by H6 in the height direction from the upper end surfaces of the individual reception parts 142, 143 and opposed to the wireless tag circuit element 25. When the tape cassette 141 is mounted to the cassette housing part 8, a space 49 having a narrow gap (for example, a gap of about 0.3 to 3 mm) is created between the outer peripheral side wall surface 24 of the tape cassette 141 and the side wall part 8A of the cassette housing part 8. In this gap, there is no conductive plate member and the like which will obstruct signal transmission and reception between the antenna 26 and the wireless tag circuit element 25 disposed to oppose to each other. In this manner, excellent signal transmission and reception can be achieved between the antenna 26 and the wireless tag circuit element 25.

Figure 57:
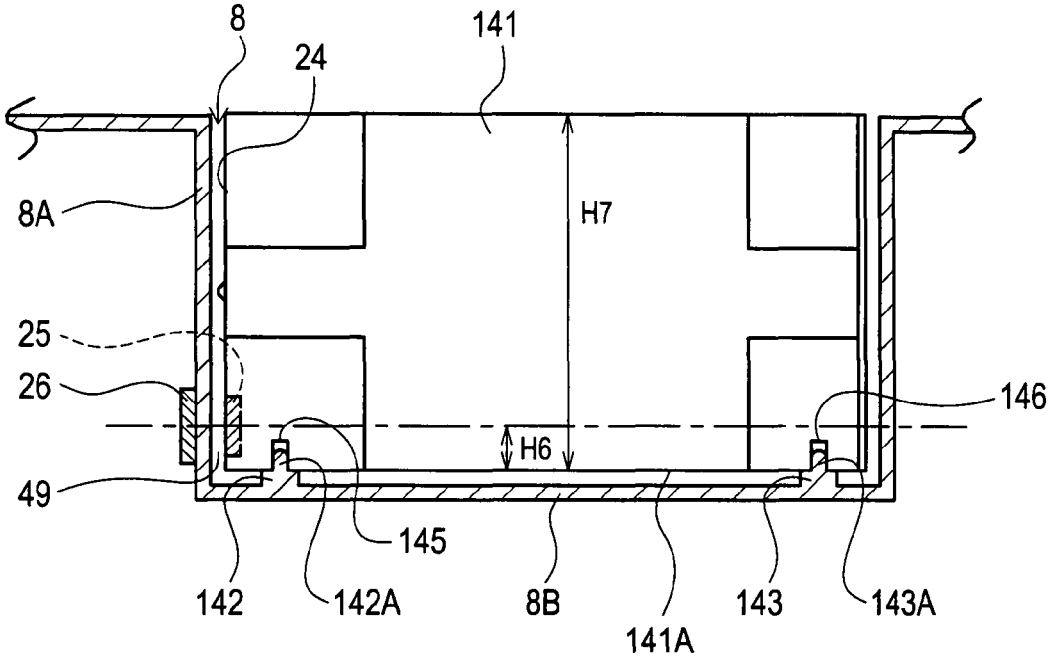
FIG. 57 is a sectional side view showing relative positional relationship between the wireless tag circuit element and the antenna when another tape cassette having a wider tape width is mounted to the cassette housing part of the tape printer according to Embodiment 4.

Further, as shown in FIG. 57, as is the case of the tape cassette 141 shown in FIG. 56 (for example, having the tape width of 12 mm), the tape cassette 141 having a different tape width (for example a tape width of 24 mm) is also formed with the wireless tag circuit element 25 on the outer peripheral side wall surface 24 of the tape cassette 141 having a height of H7 (for example, a height of 35 mm) at a position of the height of H6 (for example, the height of 2.5 to 6 mm) from the bottom surface 141A and at the position opposed to the antenna 26. In this manner, even if the tape cassette 141 having a different tape width (for example, a tape width of 24 mm) is mounted to the cassette housing part 8, a space 49 having a narrow gap (for example, a gap of about 0.3 mm to 3 mm) is created between the outer peripheral side wall surface 24 of the tape cassette 141 and the side wall part 8A of the cassette housing part 8. In this gap, there is no conductive plate member and the like which will obstruct signal transmission and reception between the antenna 26 and the wireless tag circuit element 25 disposed to oppose to each other. In this manner, excellent signal transmission and reception can be achieved between the antenna 26 and the wireless tag circuit element 25.

As described above, in the tape cassette 141 according to Embodiment 4, the tape cassette 141 is mounted to the cassette housing part 8 while the individual location holes 145, 146 formed on the bottom surface 141A thereof are inserted and fitted to the individual location projections 142A, 143A, and the bottom surface 141A is brought into contact with the upper end surfaces of the reception parts 142, 143. In this manner, the relative positional relationship between the wireless tag circuit element 25 in the height direction of the tape cassette 141 and the upper end surfaces of the individual reception parts 142, 143 of the cassette housing part 8 is always constant forming the height H6. As a result, the height of the wireless tag circuit element 25 and the antenna 26 from the upper end surfaces of the individual reception parts 142, 143 becomes H6. In this manner, the wireless tag circuit element 25 can be assuredly located at a position opposed to the antenna 26.

Further, in the tape printer 1 according to Embodiment 4, the wireless tag circuit element 25 is provided on the outer peripheral side wall surface 24 located at the height H6 from the bottom surface 141A of the tape cassette 141, and this bottom surface 141A is brought into contact with the upper end surfaces of the individual reception parts 142, 143. Further, the antenna 26 is located on the side wall part 8A located at the height H6 from the upper end surfaces of the reception parts 142, 143. Due to this structure, the relative positional relationship in the height direction between the antenna 26 and the wireless tag circuit element 25 is always kept at constant. As a result, the antenna 26 can be assuredly located at a position opposed to the wireless tag circuit element 25, and the information related to the tape cassette 141 stored in this wireless tag circuit element 25 can be assuredly transmitted and received.

Alternatively, it is possible to employ a structure where the height dimension of the individual reception parts 142, 143 may be set to "0", that is, the individual location projections 142A, 143A are provided on the bottom surface 8B of the cassette housing part 8, and the bottom surface 141A of the tape cassette 141 is brought into contact with the inner side surface of the bottom part 8B. In this manner, the thickness of the tape printer 1 can be reduced.

Embodiment 5

Next, a tape cassette and a tape printer according to Embodiment 5 will be described based on FIGS. 58 to 63. In the following description, the reference numerals identical to those of the constituent elements of the tape cassette 21 and the tape printer 1 according to Embodiment 1 illustrated in FIGS. 1 to 39 denote the same or equivalent constituent elements of the tape cassette 21 and the tape printer 1 according to Embodiment 1.

The schematic structures of the tape cassette and tape printer according to Embodiment 5 are substantially the same as the structures of the tape cassette 21 and the tape printer 1 according to Embodiment 1. Further, the control processings executed by the tape printer are substantially the same control processings executed by the printer 1 according to Embodiment 1.

However, the structure of the tape cassette of Embodiment 5 differs from the structure of the tape cassette 21 of Embodiment 1 on the point that a heat-sensitive tape and a double-sided adhesive tape are accommodated whereas no ink ribbon is accommodated in the tape cassette of Embodiment 5.

First of all, the structure of the tape cassette will be described based on FIGS. 58 and 59.

Figure 58:
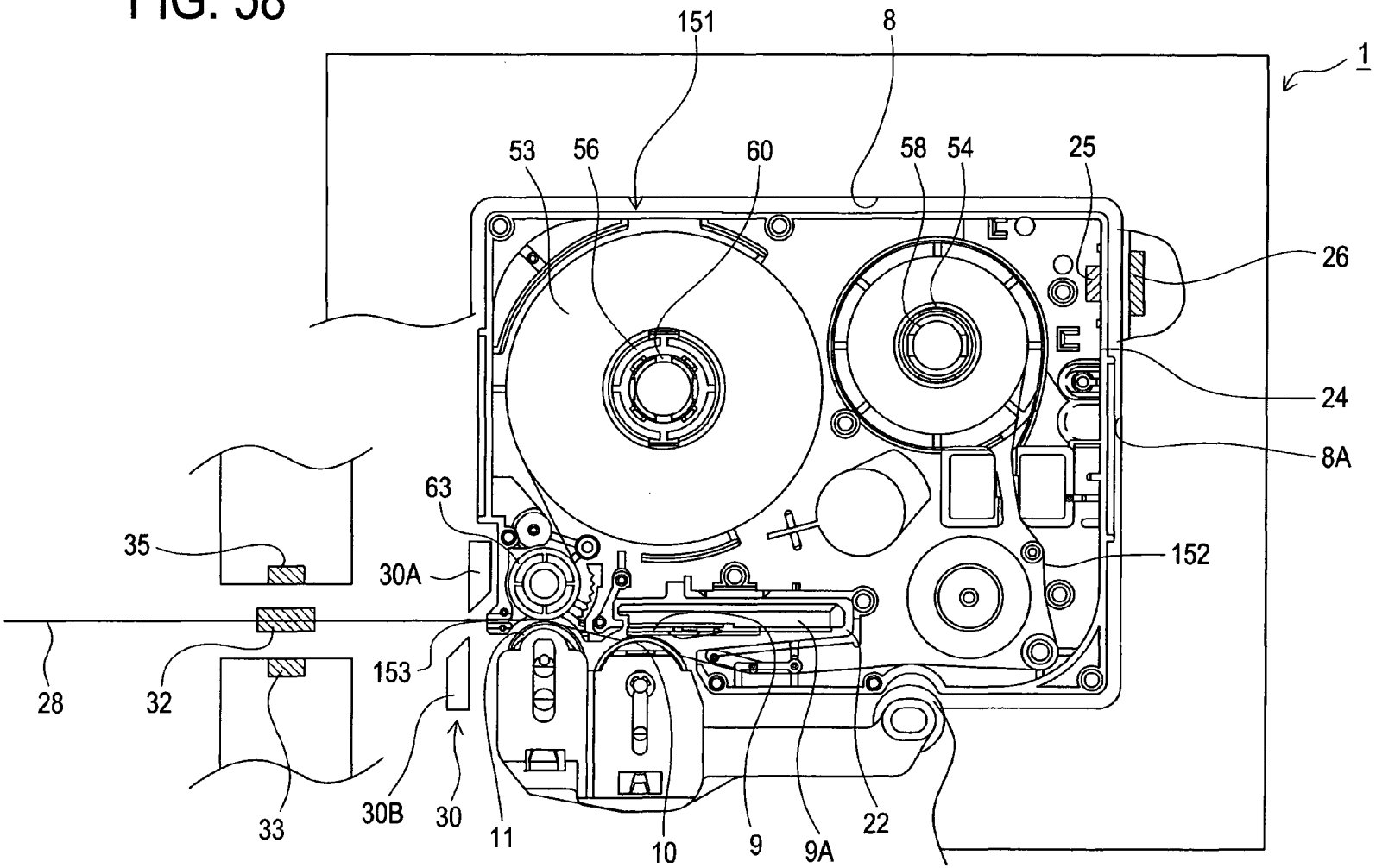
FIG. 58 is a partial enlarged plain view of a tape printer according to Embodiment 5 and a tape cassette mounted to a cassette housing part of the tape printer when an upper case of the tape cassette is removed.
Figure 59:
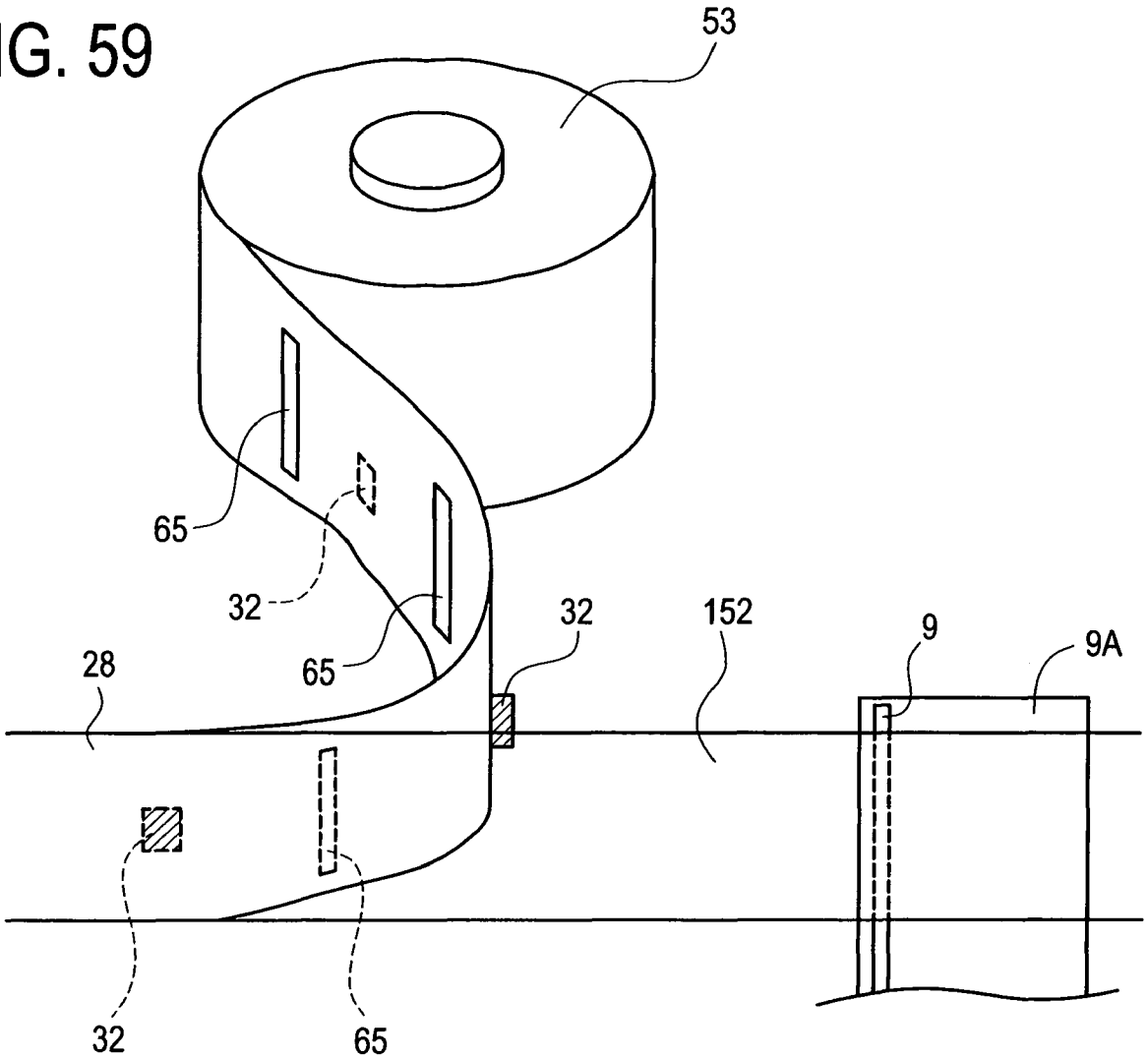
FIG. 59 is a schematic diagram showing a state where a double-sided adhesive tape is pressed and adhered to a printed thermal tape of the tape cassette according to Embodiment 5.

As shown in FIGS. 58 and 59, a tape cassette 151 to be mounted to the cassette housing part 8 from above is substantially in the same structure as of the tape cassette 21, except that the tape cassette 151 does not include an ink ribbon 52, a ribbon spool 55 around which the ink ribbon 52 is wound, and an ink ribbon take-up spool 61 for drawing out the ink ribbon 52 from the ribbon spool 55 and taking it up therearound. Further, a heat-sensitive tape 152 is wound around the tape spool 54 as a printing tape, and the tape spool 54 is rotatably supported by a supporting hole 41. Further, in the tape cassette 151, sensor marks 65 are printed on a release paper 53D at a predetermined pitch on its back surface, and a double-sided adhesive tape 53 including the wireless tag circuit elements 32 provided beforehand at a predetermined pitch L in its base film 53B is wound around the tape spool 56 in such a manner that the release paper 53D is located outward, and the tape spool 56 is rotatably supported by a supporting hole 43.

The heat-sensitive tape 152 wound around the tape spool 54 is drawn out from the tape spool 54 and passes through an opening 22 into which a thermal head 9 of the tape cassette 151 is inserted. After that, the printed heat-sensitive tape 152 passes between a tape feed roller 63 which is rotatably provided on a lower portion at one side of the tape cassette 151 (at a lower-left portion in FIG. 58) and is driven by the tape feed motor 92 to rotate, and a tape sub-roller 11 located at a position opposed to the tape feed roller 63, and is sent out of the tape cassette 151 through a tape discharging port 153, and then, is discharged from a label discharging port 16 of the tape printer 1 via the cutter unit 30, the antenna 33, and the reflective sensor 35. In this case, the double-sided adhesive tape 53 is pressed and adhered against the heat-sensitive tape 152 by the tape feed roller 63 and the tape sub-roller 11.

Next, a structure of a tape discharging port 153 of the tape cassette 151 will be described based on FIGS. 60 to 63.

Figure 60:
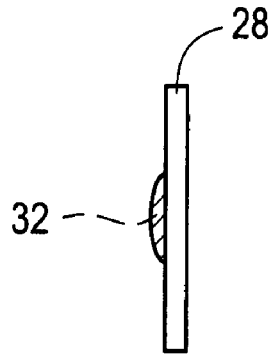
FIG. 60 is a side view of a printed label tape according to Embodiment 5.

As shown in FIG. 60, if the thickness of the heat-sensitive tape 152 accommodated in the tape cassette 151 is large and the release paper 53D is made of a thin film tape and the like, the portion of the printed label tape 28 where the wireless tag circuit element 32 is located projects toward the double-sided adhesive tape 53 (in the left direction in FIG. 60).

Figure 61:
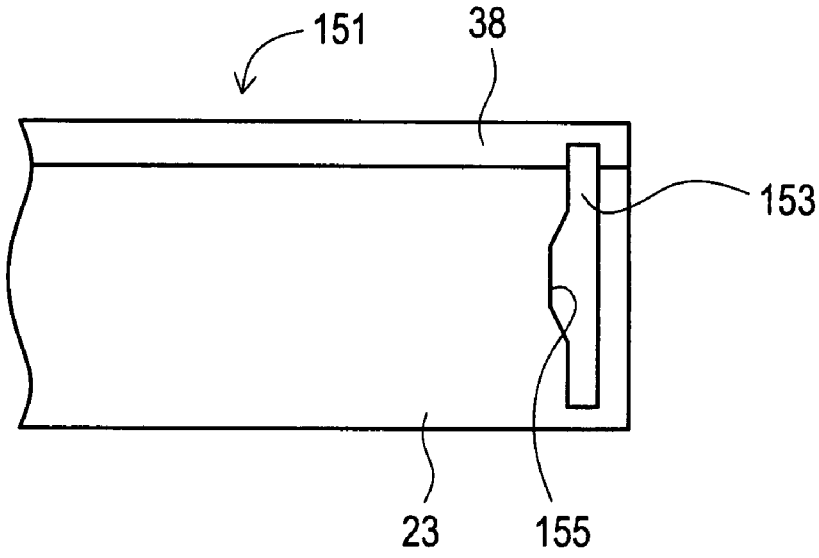
FIG. 61 is a partial enlarged front view of a tape discharging port of the tape cassette according to Embodiment 5.

Further, as shown in FIG. 61, the tape discharging port 153 through which the printed label tape 28 is discharged out of the tape cassette 151 is formed into a vertically elongated slit shape when seen from the front through which the printed label tape 28 passes. At the same time, the opposite edge part at the side of the double-sided adhesive tape 53 (in the left side in FIG. 61) opposing to the center portion in the tape width direction are cut away outwardly into a predetermined width dimension in the height direction (vertically in FIG. 61) to form a recessed part 155.

In this manner, even if the portion of the printed label tape 28 where the wireless tag circuit element 32 is to be disposed projects toward the side of the double-sided adhesive tape 53, the printed label tape 28 is never caught with the tape discharging port 153 when the printed label tape 28 is discharged out of the tape cassette 151. Thus, the slit width can be easily narrowed and the printed label tape 28 can be discharged smoothly.

Figure 62:
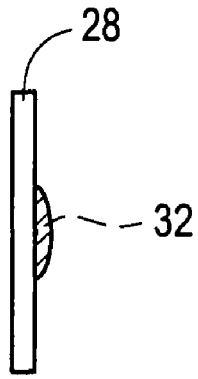
FIG. 62 is a side view of another printed label tape according to Embodiment 5.

Contrarily, as shown in FIG. 62, if the thickness of the heat-sensitive tape 152 accommodated in the tape cassette 151 is small and the release paper 53D is made of a thick film tape and the like, the portion of the printed label tape 28 where the wireless tag circuit element 32 is located projects toward the heat-sensitive tape 152 (in the right direction in FIG. 62).

Figure 63:
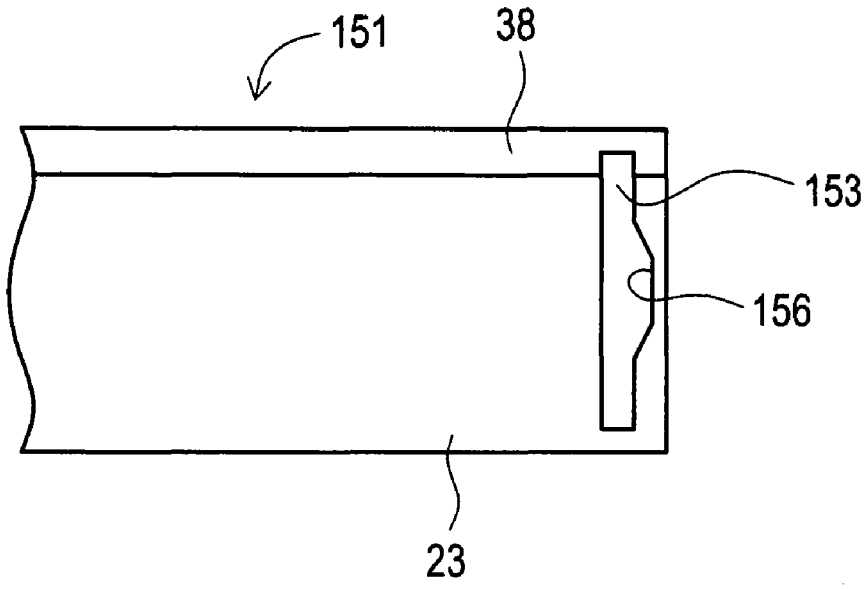
FIG. 63 is a partial enlarged front view of a tape discharging port of another tape cassette according to Embodiment 5.

Further, as shown in FIG. 63, the tape discharging port 153 through which the printed label tape 28 is discharged out of the tape cassette 151 is formed into a vertically elongated slit shape when seen from the front through which the printed label tape 28 passes. At the same time, the opposite edge part at the side of the heat-sensitive tape 152 (in the right side in FIG. 63) opposing to the center portion in the tape width direction are cut away outwardly into a predetermined width dimension in the height direction (vertically in FIG. 63) to form a recessed part 156.

In this manner, even if the portion of the printed label tape 28 where the wireless tag circuit element 32 is to be disposed projects toward the heat-sensitive tape 152, the printed label tape 28 is never caught with the tape discharging port 153 when the printed label tape 28 is discharged out of the tape cassette 151. Thus, the slit width can be easily narrowed and the printed label tape 28 can be discharged smoothly.

The tape cassette 151 accommodates the heat-sensitive tape 152 including no ink ribbon 52. However, it is a matter of course that, as is the case described above, the structure of this embodiment is applicable to the case where the film tape 51 including the ink ribbon 52 is accommodated and the portion of the printed label tape 28 where the wireless tag circuit element 32 is provided projects toward either one of the directions toward the film tape 51 and toward the double-sided adhesive tape 53.

Embodiment 6

Next, a tape feed roller to be mounted to the tape cassette 21 according to Embodiment 6 will be described based on FIGS. 64 and 65. In the following description, the reference numerals identical to those of the constituent elements of the tape cassette 21 and the tape printer 1 according to Embodiment 1 illustrated in FIGS. 1 to 39 denote the same or equivalent constituent elements of the tape cassette 21 and the tape printer 1 according to Embodiment 1.

Figure 64:
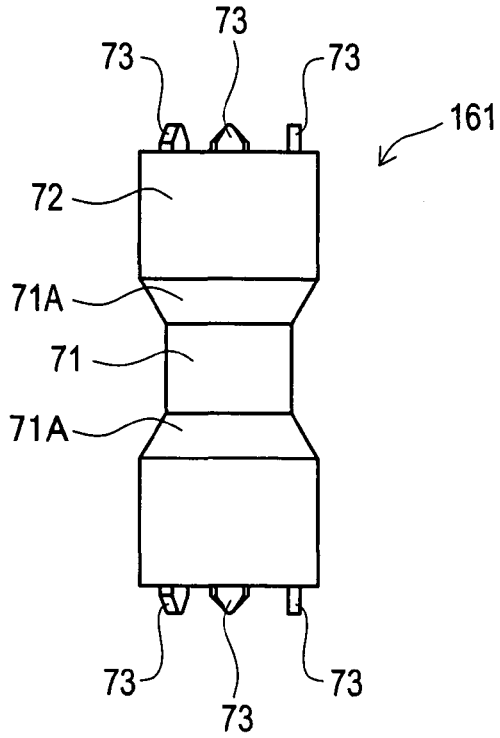
FIG. 64 is a front view of a tape feed roller of a tape cassette according to Embodiment 6.

As shown in FIG. 64, the structure of a tape feed roller 161 made of a conductive plastic material is substantially the same as the structure of the tape feed roller 63 according to Embodiment 1. However, the tape feed roller 161 differs from the tape feed roller 63 on the point that a covering part 74 made of conductive elastic member such as a conductive sponge and conductive rubber is not wound around the outer peripheral portion of the stepwise part 71 and the tapered part 71A.

Figure 65:
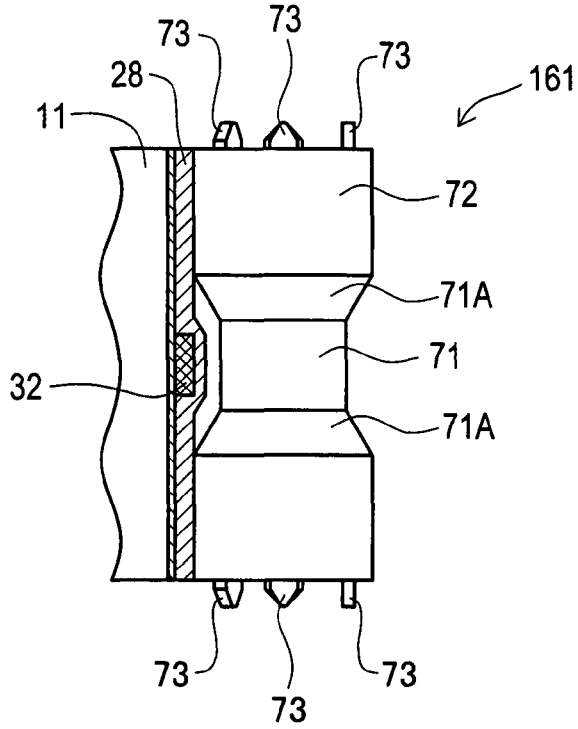
FIG. 65 is a partial cutaway front view of the tape feed roller of the tape cassette according to Embodiment 6, the view schematically showing the tape feed roller when a tape sub roller is pressed thereto.

In this structure, as shown in FIG. 65, the tape feed roller 161 adheres the double-sided adhesive tape 53 to the printed film tape 51 in cooperation with the tape sub-roller 11 to create the printed label tape 28, and at the same time, feeds the printed label tape 28 out of the tape cassette 21 from the tape discharging port 27. Further, the tape feed roller 161 is formed with, at its center in the axial direction, the stepwise part 71 formed with the tapered parts 71A at the opposite edge parts in the axial direction. When the portion of the printed label tape 28 where the wireless tag circuit element 32 is to be formed is brought into contact with the tape sub-roller 11, a gap (for example, a gap of 0.2 mm to 1 mm) is created between the portion of the printed label tape 28 where the wireless tag circuit element 32 is provided and the stepwise part 71 to prevent the wireless tag circuit element 32 from breakdown. At the same time, the cylindrical part 72 cooperates with the tape sub-roller 11 to press the printed label tape 28 to achieve adhesion. Further, the tape feed roller 161 is made of a conductive plastic material, and the tape feed roller 161 is engaged with the metallic tape driving roller shaft 14, and the chassis made of metal or conductive resin of the tape printer 1 main body is connected to the tape driving roller shaft 14. The chassis is connected with the ground of the power supply substrate. Due to this arrangement, generation of static electricity is prevented in the tape feed roller 161, so that breakdown of the wireless tag circuit element 32 can be assuredly prevented.

Embodiment 7

Next, a tape feed roller to be mounted to the tape cassette 21 according to Embodiment 7 will be described based on FIG. 66. In the following description, the reference numerals identical to those of the constituent elements of the tape cassette 21 and the tape printer 1 according to Embodiment 1 illustrated in FIGS. 1 to 39 denote the same or equivalent constituent elements of the tape cassette 21 and the tape printer 1 according to Embodiment 1.

Figure 66:
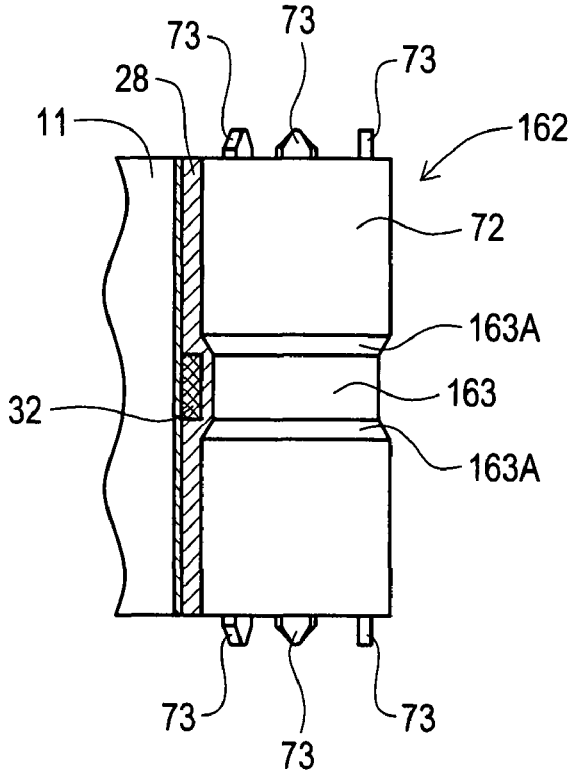
FIG. 66 is a front view of a tape feed roller of a tape cassette according to Embodiment 7.

As shown in FIG. 66, the structure of a tape feed roller 162 made of a conductive plastic material is substantially the same as the structure of the tape feed roller 63 according to Embodiment 1. However, instead of the stepwise part 71, at a center part in the axial direction of the cylindrical part 72, a stepwise part 163 is formed into a width dimension substantially equal to the dimension in the tape width direction of the wireless tag circuit element 32 and into a shape slightly narrowed for enabling the back surface of the printed label tape 28 where the wireless tag circuit element 32 is provided to be in contact therewith. At the opposite edge parts in the axial direction of the stepwise part 163, a tapered part 163A formed into the tapered shape is formed. Around the outer peripheral portion of the stepwise part 163 and the tapered parts 163A, a covering part 74 made of a conductive elastic member such as conductive sponge and conductive rubber is not wound.

In this structure, the tape feed roller 162 adheres the double-sided adhesive tape 53 to the printed film tape 51 in cooperation with the tape sub-roller 11 to create the printed label tape 28, and at the same time, feeds the printed label tape 28 out of the tape cassette 21 from the tape discharging port 27. Further, the tape feed roller 162 is formed with, at its center in the axial direction, the stepwise part 163 formed with the tapered parts 163A at the opposite edge parts in the axial direction. When the portion of the printed label tape 28 where the wireless tag circuit element 32 is formed is brought into contact with the tape sub-roller 11, the outer peripheral portion of the stepwise part 163 recessed inwardly is brought into contact with the portion of the printed label tape 28 where the wireless tag circuit element 32 is provided. In this manner, breakdown of this wireless tag circuit element 32 can be prevented. At the same time, the cylindrical part 72 cooperates with the tape sub-roller 11 to press the entire surface of the printed label tape 28 to achieve ensured adhesion. Further, the tape feed roller 162 is made of a conductive plastic material, the tape feed roller 162 is engaged with the metallic tape driving roller shaft 14, and the chassis made of metal or conductive resin of the tape printer 1 main body is connected to the tape driving roller shaft 14. The chassis is connected with the ground of the power supply substrate. Due to this arrangement, generation of static electricity is prevented in the tape feed roller 162, so that breakdown of the wireless tag circuit element 32 can be assuredly prevented.

Embodiment 8

Next, a tape feed roller to be mounted to the tape cassette 21 according to Embodiment 8 will be described based on FIG. 67. In the following description, the reference numerals identical to those of the constituent elements of the tape cassette 21 and the tape printer 1 according to Embodiment 1 illustrated in FIGS. 1 to 39 denote the same or equivalent constituent elements of the tape cassette 21 and the tape printer 1 according to Embodiment 1.

Figure 67:
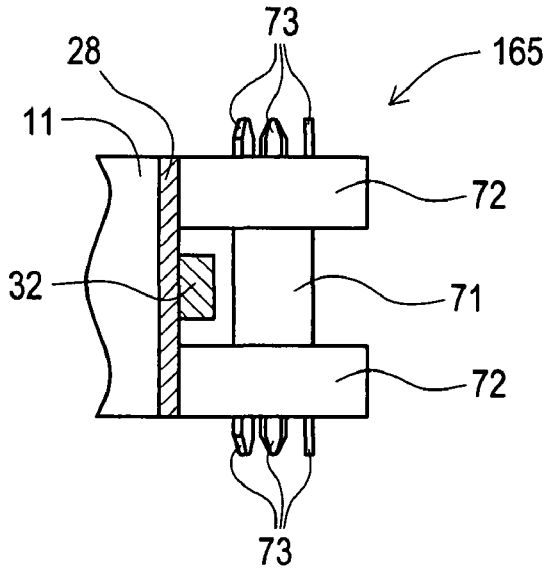
FIG. 67 is a partial cutaway front view of a tape feed roller of a tape cassette according to Embodiment 8, the view schematically showing the tape feed roller when a tape sub roller is pressed thereto.

As shown in FIG. 67, the structure of a tape feed roller 165 made of a conductive plastic material is substantially the same as the structure of the tape feed roller 161 according to Embodiment 6. However, the tapered part 71A is not formed at the opposite edge parts in the axial direction of the stepwise part 71.

In this structure, the tape feed roller 165 adheres the double-sided adhesive tape 53 to the printed film tape 51 in cooperation with the tape sub-roller 11 to create the printed label tape 28, and at the same time, feeds the printed label tape 28 out of the tape cassette 21 from the tape discharging port 27. Further, each cylindrical part 72 can be extended inwardly in the axial direction by the height in the axial direction of each tapered part 71A, and at the same time, the cylindrical part 72 cooperates with the tape sub-roller 11 to press the printed label tape 28 to achieve ensured adhesion. Further, the tape feed roller 165 is formed with, at its center in the axial direction, the stepwise part 71. Thus, when the portion of the printed label tape 28 where the wireless tag circuit element 32 is to be formed is brought into contact with the tape sub-roller 11, a gap (for example, a gap of 0.2 mm to 1 mm) is created between the portion of the printed label tape 28 where the wireless tag circuit element 32 is provided and the stepwise part 71. As a result, damage to the wireless tag circuit element 32 can be prevented. Further, the tape feed roller 165 is made of a conductive plastic material, the tape feed roller 165 is engaged with the metallic tape driving roller shaft 14, and the chassis made of metal or conductive resin of the tape printer 1 main body is connected to the tape driving roller shaft 14. The chassis is connected with the ground of the power supply substrate. Due to this arrangement, generation of static electricity is prevented in the tape feed roller 165, so that breakdown of the wireless tag circuit element 32 can be assuredly prevented.

Embodiment 9

Next, a tape feed roller to be mounted to the tape cassette 21 according to Embodiment 9 of the disclosure will be described based on FIG. 68. In the following description, the reference numerals identical to those of the constituent elements of the tape cassette 21 and the tape printer 1 according to Embodiment 1 illustrated in FIGS. 1 to 39 denote the same or equivalent constituent elements of the tape cassette 21 and the tape printer 1 according to Embodiment 1.

Figure 68:
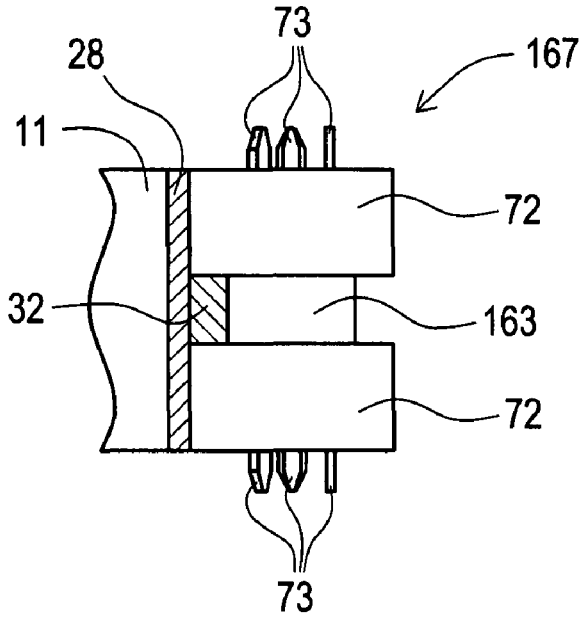
FIG. 68 is a partial cutaway front view of a tape feed roller of a tape cassette according to Embodiment 9, the view schematically showing the tape feed roller when a tape sub roller is pressed thereto.

As shown in FIG. 68, the structure of a tape feed roller 167 made of a conductive plastic material is substantially the same as the structure of the tape feed roller 162 according to Embodiment 7. However, the tapered part 163A is not formed at the opposite edge parts in the axial direction of the stepwise part 163.

In this structure, the tape feed roller 167 adheres the double-sided adhesive tape 53 to the printed film tape 51 in cooperation with the tape sub-roller 11 to create the printed label tape 28, and at the same time, feeds the printed label tape 28 out of the tape cassette 21 from the tape discharging port 27. Further, each cylindrical part 72 can be extended inwardly in the axial direction by the height in the axial direction of each tapered part 163A (see FIG. 66). Thus, the cylindrical part 72 cooperates with the tape sub-roller 11 to press the entire surface of the printed label tape 28 to achieve ensured adhesion. Further, the tape feed roller 167 is formed with, at its center in the axial direction, the stepwise part 163. Thus, when the portion of the printed label tape 28 where the wireless tag circuit element 32 is formed is brought into contact with the tape sub-roller 11, the outer peripheral part of the inwardly recessed stepwise part 163 is brought into contact with the portion of the printed label tape 28 where the wireless tag circuit element 32 is provided, so that breakdown of the wireless tag circuit element 32 can be prevented. At the same time, the cylindrical part 72 cooperates with the tape sub-roller 11 to press the entire surface of the printed label tape 28 to achieve ensured adhesion. Further, since the tape feed roller 167 is made of a conductive plastic material, and the metallic tape driving roller shaft 14 engaged with the tape feed roller 167, and the chassis made of metal or conductive resin of the tape printer 1 main body is connected to the tape driving roller shaft 14, the chassis is connected with the ground of the power supply substrate. Due to this arrangement, generation of static electricity is prevented in the tape feed roller 167, so that breakdown of the wireless tag circuit element 32 can be assuredly prevented.

Embodiment 10

Next, a tape feed roller to be mounted to the tape cassette 21 according to Embodiment 10 of the disclosure will be described based on FIG. 69. In the following description, the reference numerals identical to those of the constituent elements of the tape cassette 21 and the tape printer 1 according to Embodiment 1 illustrated in FIGS. 1 to 39 denote the same or equivalent constituent elements of the tape cassette 21 and the tape printer 1 according to Embodiment 1.

Figure 69:
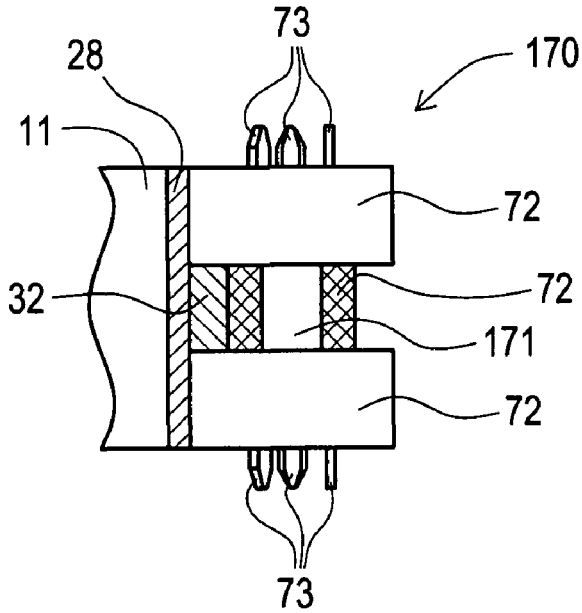
FIG. 69 is a partial cutaway view of a tape feed roller of a tape cassette according to Embodiment 10, the view schematically showing the tape feed roller when a tape sub roller is pressed thereto.

As shown in FIG. 69, the structure of a tape feed roller 170 made of a conductive plastic material is substantially the same as the structure of the tape feed roller 167 according to Embodiment 9. However, a stepwise part 171 thinner than the stepwise part 163 is formed. In addition, a covering part 172 made of conductive elastic member such as a substantially ring-shaped conductive sponge and conductive rubber, and having an outer peripheral diameter substantially equal to the outer peripheral diameter of the stepwise part 163 is wound around the stepwise part 171.

In this structure, the tape feed roller 170 adheres the double-sided adhesive tape 53 to the printed film tape 51 in cooperation with the tape sub-roller 11 to create the printed label tape 28, and at the same time, feeds the printed label tape 28 out of the tape cassette 21 from the tape discharging port 27. Further, the tape feed roller 170 is formed with, at its center in the axial direction, the stepwise part 171 wound by a covering part 172 made of an elastic member. Thus, when the portion of the printed label tape 28 where the wireless tag circuit element 32 is formed is brought into contact with the tape sub-roller 11, the outer peripheral part of the covering part 172 where the portion formed with the wireless tag circuit element 32 is brought into contact inwardly recesses, so that breakdown of the wireless tag circuit element 32 can be prevented. At the same time, the cylindrical part 72 and the covering part 172 cooperates with the tape sub-roller 11 to press the entire surface of the printed label tape 28 to achieve assured adhesion. Further, since the tape feed roller 170 is made of a conductive plastic material and the covering part 172 is made of conductive elastic material, and the tape feed roller 170 and the covering part 172 are connected to the metallic tape driving roller shaft 14 engaged with the tape feed roller 170, and the chassis made of metal or conductive resin of the tape printer 1 main body is connected to the tape driving roller shaft 14. The chassis is connected with the ground of the power supply substrate. Due to this arrangement, generation of static electricity is prevented in the tape feed roller 170 and the covering part 172, so that breakdown of the wireless tag circuit element 32 can be assuredly prevented.

Embodiment 11

Next, a tape feed roller to be mounted to the tape cassette 21 according to Embodiment 11 of the disclosure will be described based on FIGS. 70 and 71. In the following description, the reference numerals identical to those of the constituent elements of the tape cassette 21 and the tape printer 1 according to Embodiment 1 illustrated in FIGS. 1 to 39 denote the same or equivalent constituent elements of the tape cassette 21 and the tape printer 1 according to Embodiment 1.

Figure 70:
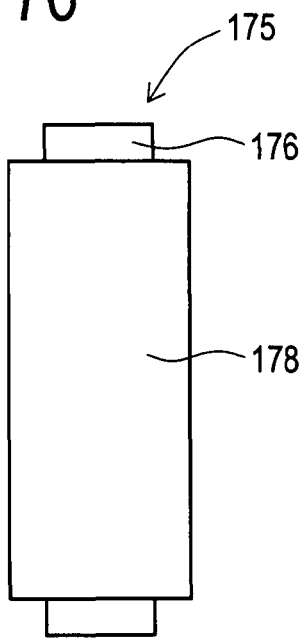
FIG. 70 is a front view of a tape feed roller of a tape cassette according to Embodiment 11.
Figure 71:
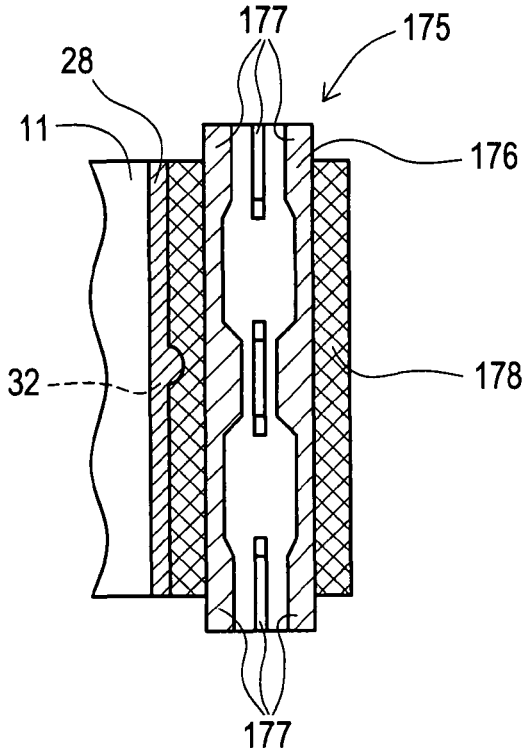
FIG. 71 is a schematic cross-sectional view of the tape feed roller of the tape cassette according to Embodiment 11 showing the tape feed roller when a tape sub roller is pressed thereto.

As shown in FIGS. 70 and 71, a tape feed roller 175 is made of a conductive plastic material includes a cylindrical part 176 in a substantially cylindrical shape, a plurality of drive ribs 177 formed to extend radially from the inner wall of the cylindrical part 176 toward the center thereof, and a covering part 178 wound around an outer peripheral portion of the cylindrical part 176 and made of conductive elastic member such as a substantially cylindrical conductive sponge and conductive rubber in a substantially cylindrical shape. The covering part 178 is formed to have an outer peripheral diameter substantially equal to the outer peripheral diameter of the tape feed roller 63 according to Embodiment 1. Further, the covering part 178 is formed to have a height dimension in the axial direction substantially equal to the distance between the outer end surfaces in the axial direction of the cylindrical part 72 of the tape feed roller 63 according to Embodiment 1.

Here, the plurality of the drive ribs 177 is formed in such a manner that they are vertically symmetrical to each other with respect to the center position in the vertical direction of the cylindrical part 176. Further, each drive rib 177 is engaged with a cam member 76 (see FIG. 3) of a tape driving roller shaft 14 provided in the cassette housing part 8 of the tape printer 1. The tape feed roller 175 is rotated caused by the cooperation between the cam member 76 and each drive rib 177 as the tape driving roller shaft 14 rotates.

In this structure, the tape feed roller 175 adheres the double-sided adhesive tape 53 to the printed film tape 51 in cooperation with the tape sub-roller 11 to create the printed label tape 28, and at the same time, feeds the printed label tape 28 out of the tape cassette 21 from the tape discharging port 27. Further, the outer peripheral portion of the cylindrical part 176 of the tape feed roller 175 is wound by the covering part 178 made of an elastic member. Thus, when the portion of the printed label tape 28 where the wireless tag circuit element 32 is formed is brought into contact with the tape sub-roller 11, the outer peripheral portion of the covering part 178 to which the portion formed with the wireless tag circuit element 32 is brought into contact inwardly recesses, so that breakdown of the wireless tag circuit element 32 can be assuredly prevented. At the same time, the covering part 178 cooperates with the tape sub-roller 11 to press the entire surface of the printed label tape 28 to achieve assured adhesion. Further, the tape feed roller 175 is made of a conductive plastic material and the covering part 178 is made of a conductive elastic member. The tape feed roller 175 and the covering part 178 are connected to the metallic tape driving roller shaft 14 engaged with the tape feed roller 175, and the chassis made of metal or conductive resin of the tape printer 1 main body is connected to the tape driving roller shaft 14. The chassis is connected with the ground of the power supply substrate. Due to this arrangement, generation of static electricity is prevented in the tape feed roller 175 and the covering part 178, so that breakdown of the wireless tag circuit element 32 can be assuredly prevented.

Embodiment 12

Next, a tape cassette and a tape printer according to Embodiment 12 will be described based on FIGS. 72 and 73. In the following description, the reference numerals identical to those of the constituent elements of the tape cassette 21 and the tape printer 1 according to Embodiment 1 illustrated in FIGS. 1 to 39 denote the same or equivalent constituent elements of the tape cassette 21 and the tape printer 1 according to Embodiment 1.

The schematic structures of the tape cassette and the tape printer according to Embodiment 12 are substantially the same as the structures of the tape cassette 21 and the tape printer 1 according to Embodiment 1. Further, the control processings executed by the tape printer are substantially the same control processings executed by the printer 1 according to Embodiment 1.

However, the tape cassette and the tape printer according to Embodiment 12 differ from those of Embodiment 1 on the point that, instead of the parameter table 131 according to Embodiment 1, a program table is stored in the wireless tag circuit element 25 disposed on the outer peripheral side wall surface 24 of the tape cassette 21. Therefore, the tape printer according to Embodiment 12 differs from the tape printer 1 according to Embodiment 1 on the point that the tape printer executes a control processing for setting print control programs when the tape printer is turned on.

First of all, an example of a program table to be stored in the memory part 125 of the wireless tag circuit element 25 provided in the tape cassette 21 according to Embodiment 12 will be described based on FIG. 72.

As shown in FIG. 72, the memory part 125 of the wireless tag circuit element 25 provided in the tape cassette 21 stores a program table 181 storing print control program for executing printing on the film tape 51 accommodated in the tape cassette 21 for each of the models A to C of the tape printer 1.

The program table 181 includes "model names" indicative of individual models of the tape printer 1, "drive power supplies" corresponding to individual "model names", and "print control programs" corresponding to individual "drive power supply".

Further, the "model names" respectively include "Model A", "Model B", and "Model C". The "drive power supplies" of "Model A" to "Model C" store "dry battery", "AC adaptor", and "AC power supply", respectively.

As printing control programs for "dry battery", "AC adaptor" and "AC power supply" of "Model A", "Program A21", "Program B21" and "Program C21" are stored, respectively. As printing control programs for "dry battery", "AC adaptor" and "AC power supply" of "Model B", "Program A22", "Program B22" and "Program C22" are stored, respectively. As printing control programs for "dry battery", "AC adaptor" and "AC power supply" of "Model C", "Program A23", "Program B23" and "Program C23" are stored, respectively.

In programs "Program A21" to "Program C21" corresponding to "Model A", "Parameter A1" to "Parameter C1", which are print control parameters for the case where the drive power supply of the parameter table 131 is "dry battery" to "AC power supply" respectively, are included and at the same time, print control program for the tape printer 1 of "Model A" to print on the film tape 51 and the like of the tape cassette 21 by the respective Parameter A1 to Parameter C1 is included. Further, in "Program A22" to "Program C22" respectively corresponding to "Model B", "Parameter A2" to "Parameter C2" which are print control parameters for the case where the drive power supply of the parameter table 131 is "dry battery" to "AC power supply" respectively are included, and at the same time, print control program for the tape printer 1 of "Model B" to print on the film tape 51 and the like of the tape cassette 21 by the Parameters A2 to C2 is included. Further, in "Program A23" to "Program C23" respectively corresponding to "Model C", "Parameter A3" to "Parameter C3" which are print control parameters for the case where the drive power supply of the parameter table 131 is "dry battery" to "AC power supply" respectively are included, and at the same time, print control program for the tape printer 1 of "Model C" to print on the film tape 51 and the like of the tape cassette 21 by the respective Parameter A3 to Parameter C3 is included.

Next, a control processing for setting printing control program executed at the time when the tape printer 1 according to Embodiment 12 is turned on will be described based on FIG. 73.

Figure 73:
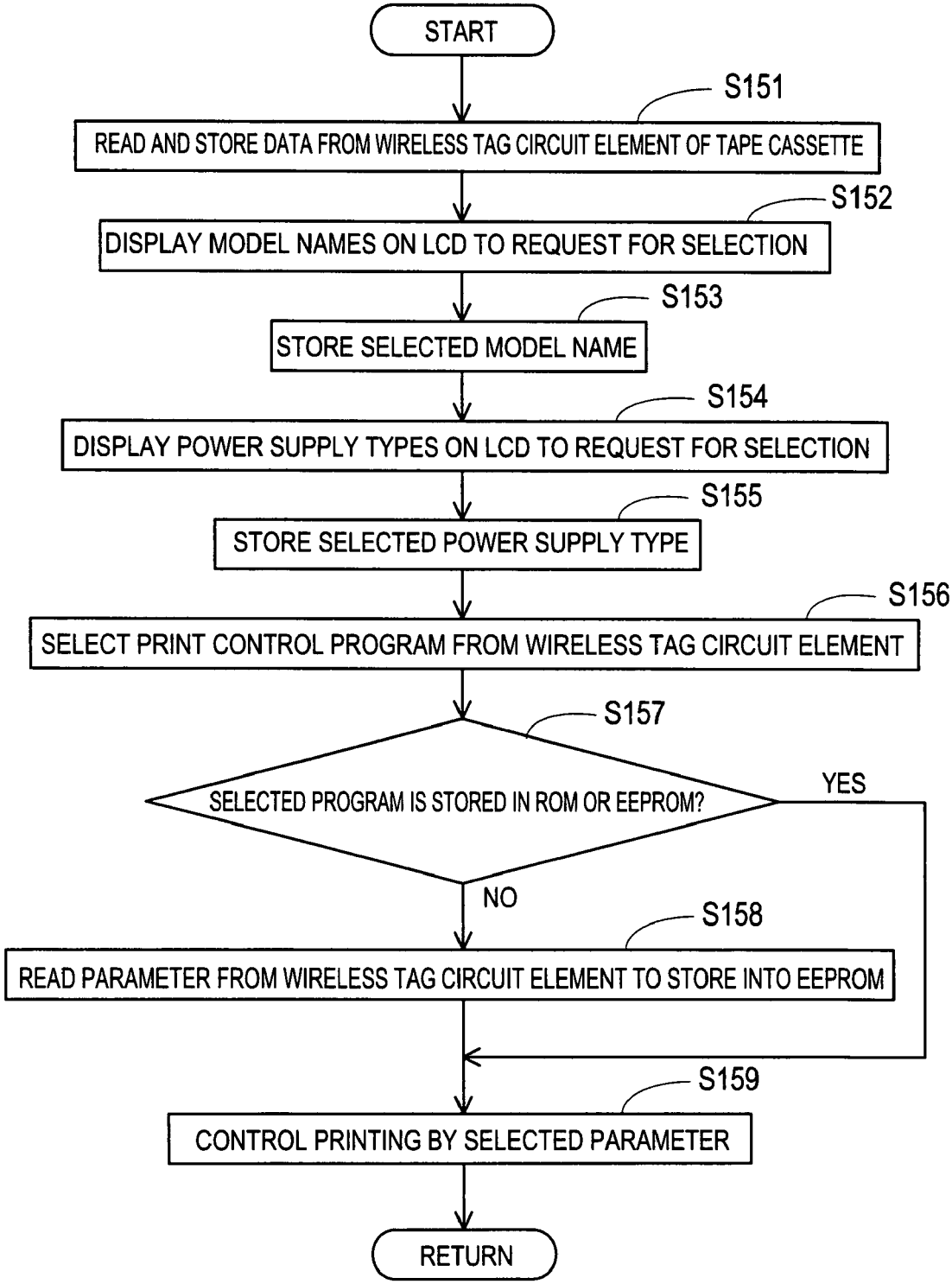

As shown in FIG. 73, first of all, in S151, when the tape printer 1 is turned on, the CPU 81 of the tape printer 1 reads the "model name" and the type of "drive power supply" corresponding to each "model name" of the program table 181 stored in the memory part 125 of the wireless tag circuit element 25 from the wireless tag circuit element 25 provided to the tape cassette 21 via the read/write module 93, and stores the read model names and the power supply types corresponding to each model name into the RAM 85.

Then, in S152, the CPU 81 controls the liquid crystal display 7 to display a prompt for selecting the model name of this tape printer 1. At the same time, the CPU 81 reads out the plurality of "model name" from the program table 181 stored in the RAM 85 and displays the model name on the liquid crystal display 7, and then waits until the model name is selected.

For example, as shown in FIG. 24, the CPU 81 controls the liquid crystal display 7 to display "select the model name you use" in its upper portion. At the same time, the CPU 81 controls the liquid crystal display 7 to display the number "1." followed by "Model A", the number "2." followed by "Model B", and the number "3." followed by "Model C" in its lower portion. Then, the CPU 81 waits until any one of the number keys 1 to 3 is pressed with the keyboard 6.

Subsequently, in S153, when the model name is selected with the keyboard 6, the CPU 81 stores the selected model name into the RAM 85.

Then, in S154, the CPU 81 controls the liquid crystal display 7 to display a prompt for selecting the type of drive power supply of this tape printer 1. At the same time, the CPU 81 again reads the model name stored in S153 from the RAM 85, and then, reads the type of the "drive power supply" corresponding to the "model name" from the RAM 85. Then, the CPU 81 controls the liquid crystal display 7 to display the read drive power supply type and waits until the drive power supply is selected.

For example, as shown in FIG. 25, when "Model A" is selected, the CPU 81 controls the liquid crystal display 7 to display "select the power supply you use" in its upper portion. At the same time, the CPU 81 controls the liquid crystal display 7 to display the number "1." followed by "AC power supply", the number "2." followed by "dedicated AC adaptor", and the number "3." followed by "dry battery" in its lower portion. Then, the CPU 81 waits until any one of the number keys 1 to 3 is pressed with the keyboard 6.

Then, in S155, when the drive power supply is selected with the keyboard 6, the CPU 81 stores the selected power supply into the RAM 85.

Subsequently, in S156, the CPU 81 reads the model name and the type of drive power supply stored in the RAM 85. Then, the CPU 81 reads a printing control program corresponding to the model name and the type of drive power supply from the print control information on the program table 181 stored in the memory part 125 of the wireless tag circuit element 25 via the read/write module 93. Then, the CPU 81 stores the read program as a printing control program of the tape cassette 21 corresponding to the drive conditions into the RAM 85.

For example, when the model name and the type of drive power supply stored in the RAM 85 are respectively "Model A" and "dry battery", the CPU 81 reads "Program A21" from the print control information on the program table 181 stored in the memory part 125 of the wireless tag circuit element 25, and stores it as a printing control program of the tape cassette 21 into the RAM 85. When the model name and the type of drive power supply stored in the RAM 85 are respectively "Model B" and "AC adaptor", the CPU 81 reads "Program B22" from the print control information on the program table 181 stored in the memory part 125 of the wireless tag circuit element 25, and stores it as a printing control program of the tape cassette 21 into the RAM 85.

Then, in S157, the CPU 81 reads a printing control program of the tape cassette 21 corresponding to the drive conditions from the RAM 85, and executes determination processing for determining whether or not the printing control program is stored in the ROM 83 or the flash memory 84.

If the printing control program of the tape cassette 21 read from the RAM 85 is stored neither ROM 83 nor flash memory 84 (S157:No), in S158, the CPU 81 reads the program data of the printing control program from the program table 181 stored in the memory part 125 of the wireless tag circuit element 25 via the read/write module 93, stores it as program data of the printing control program of the tape cassette 21 into the flash memory 84.

On the other hand, if the printing control program of the tape cassette 21 read from the RAM 85 is stored in the ROM 83 or the flash memory 84 (S157: Yes), the CPU 81 determines that the printing control program has already been stored in the ROM 83 or the flash memory 84.

After that, in S159, the CPU 81 reads program data of the printing control program of the tape cassette 21 from the ROM 83 or the flash memory 84, and executes printing control. After the execution, the CPU 81 terminates the processing.

As described above, in the tape cassette 21 according to Embodiment 12, since the print control program corresponding to each tape type such as the film tape 51 to be accommodated in the tape cassette 21 is stored in the wireless tag circuit element 25 for each type of the tape printer 1 and each type of the drive power supply. Thus, it is possible to employ a new type of tape cassette 21 which may be manufactured after the tape printers 1 of various types are sold, even if such a new cassette has a specification different from the conventional cassettes.

Further, in the tape printer 1 of Embodiment 12, even if the print control program corresponding to the tape cassette 21 mounted to the cassette housing part 8 is stored neither in the ROM 83 nor the flash memory 84, as far as the printing control program corresponding to the "model name" and the "drive power supply" of the tape printer 1 is stored in this wireless tag circuit element 25, the CPU 81 reads the print control program from the wireless tag circuit element 25 of the tape cassette 21 via the read/write module 93 and stores into the flash memory 84, so that it becomes possible to create a printed label tape 28 by inputting control conditions such as the "model name" and the "drive power supply" of the tape printer 1 when the tape printer 1 is turned on. As a result, the CPU 81 can execute printing control even if the tape cassette 21 of new type having a specification different from a conventional one is mounted.

Embodiment 13

Next, a tape cassette and a tape printer according to Embodiment 13 will be described based on FIGS. 74 and 75. In the following description, the reference numerals identical to those of the constituent elements of the tape cassette 21 and the tape printer 1 according to Embodiment 1 illustrated in FIGS. 1 to 39 denote the same or equivalent constituent elements of the tape cassette 21 and the tape printer 1 according to Embodiment 1.

The schematic structures of the tape cassette and the tape printer according to Embodiment 13 are substantially the same as the structures of the tape cassette 21 and the tape printer 1 according to Embodiment 1. Further, the control processings executed by the tape printer are substantially the same control processings executed by the printer 1 according to Embodiment 1.

However, the tape cassette and the tape printer according to Embodiment 13 differ from those of Embodiment 1 on the point that, in stead of the parameter table 131, a program table 182 is stored in the wireless tag circuit element 25 disposed on the outer peripheral side wall surface 24 of the tape cassette 21. Therefore, the tape printer according to Embodiment 13 differs from the control processing (S1 to S9) for setting the print control parameters and the like for the printer 1 according to Embodiment 1 on the point that the tape printer according to Embodiment 13 executes control processing for automatically setting print control programs and the like when the tape printer is turned on.

First of all, an example of a program table to be stored in the memory part 125 of the wireless tag circuit element 25 provided in the tape cassette 21 will be described based on FIG. 74.

As shown in FIG. 74, the memory part 125 of the wireless tag circuit element 25 provided in the tape cassette 21 stores a program table 182 storing print control program for executing printing on the film tape 51 accommodated in the tape cassette 21 for each of the models A to C of the tape printer 1.

The program table 182 includes "model names" indicative of individual models of the tape printer 1, "print control program" corresponding to individual "model names".

The "model names" respectively include "Model A", "Model B", and "Model C". "Program A31" is stored as a "print control program" for "Model A". "Program B31" is stored as a "print control program" for "Model B". "Program C31" is stored as a "print control program" for "Model C".

"Program A31" includes "Parameter A1" which is a print control parameter for the case where the drive power supply of the parameter table 131 is "dry, battery", "Parameter B1" which is a print control parameter for the case where the drive power supply is "AC adaptor", and "Parameter C1" which is a print control parameter for the case where the drive power supply is "AC power supply". Further, "Program A31" also includes a print control program for executing printing on the film tape 51 of the tape cassette 21 by the respective Parameters A1, B1, C1.

Further, "Program B31" includes "Parameter A2" which is a print control parameter for the case where the drive power supply of the parameter table 131 is "dry battery", "Parameter B2" which is a print control parameter for the case where the drive power supply is "AC adaptor", and "Parameter C2" which is a print control parameter for the case where the drive power supply is "AC power supply". Further, "Program B31" also includes a print control program for executing printing on the film 51 tape of the tape cassette 21 by the respective Parameters A2, B2, C2.

Further, "Program C31" includes "Parameter A3" which is a print control parameter for the case where the drive power supply of the parameter table 131 is "dry battery", "Parameter B3" which is a print control parameter for the case where the drive power supply is "AC adaptor", and "Parameter C3" which is a print control parameter for the case where the drive power supply is "AC power supply". Further, "Program C31" also includes a print control program for executing printing on the film tape 51 of the tape cassette 21 by the respective Parameters A3, B3, C3.

Next, a control processing for setting printing control programs executed at the time when thus-structured tape printer 1 is turned on will be described based on FIG. 75.

Figure 75:
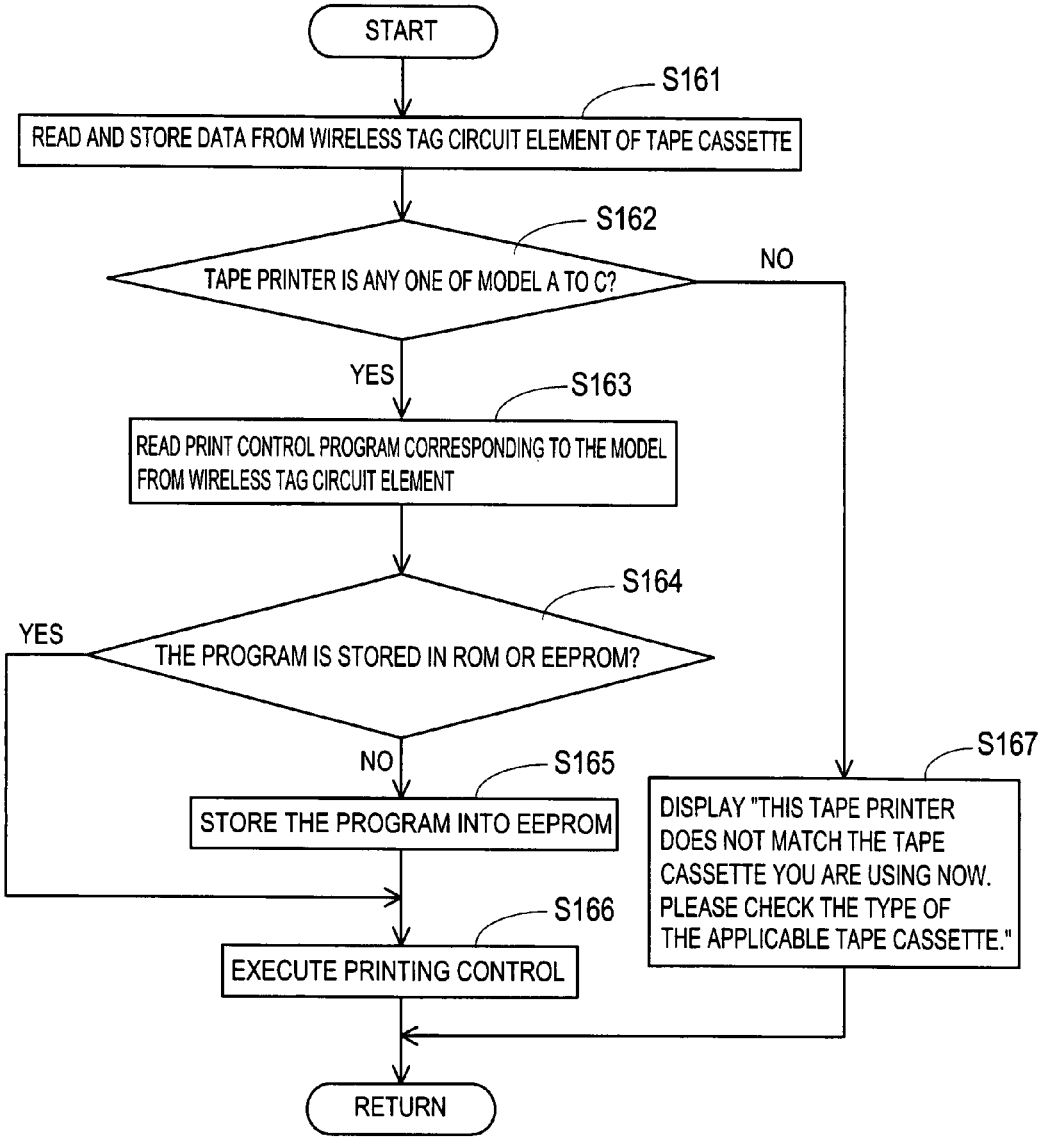
Figure 76:
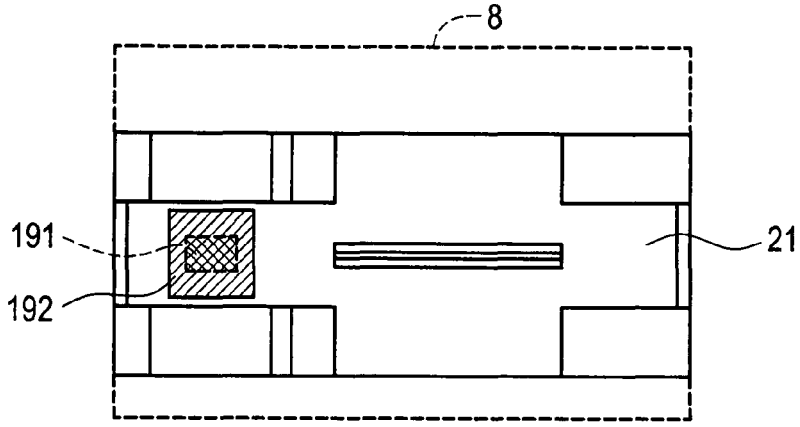
FIG. 76 is a side view showing relative positional relationship between a wired tag circuit element and a connection connector when a tape cassette is mounted to a cassette housing part of a tape printer according to Embodiment 14.

As shown in FIG. 75, first of all, in S161, when the tape printer 1 is turned on, the CPU 81 of the tape printer 1 reads data such as the "model names" from the program table 182 stored in the memory part 125 of the wireless tag circuit element 25 provided to the tape cassette 21 via the read/write module 93, and stores the read data into the RAM 85.

Then, in S162, the CPU 81 reads the data of the "model name" stored in the RAM 85, and executes determination processing for determining whether or not the model name of the tape printer 1 is included, that is, whether or not the "model name" of this tape printer 1 is one of "Model A", "Model B", and "Model C".

Subsequently, if the "model name" of the tape printer 1 is either one of "Model A", "Model B", and "Model C" (S162: Yes), in S163, the CPU 81 reads the print control program corresponding to the "model name" of the tape printer 1 from the print control information on the program table 182 stored in the memory part 125 of the wireless tag circuit element 25 via the read/write module 93, and stores it into the RAM 85 as a print control program for the tape cassette 21.

For example, if the "model name" of the tape printer 1 is "Model A", the CPU 81 reads "Program A31" from the print control information on the program table 182 stored in the memory part 125 of the wireless tag circuit element 25, and stores it into the RAM 85 as a print control program of the tape cassette 21.

Then, in S164, the CPU 81 again reads the print control program of the tape cassette 21 from the RAM 85, and executes determination processing for determining whether or not this printing control program is stored in the ROM 83 or the flash memory 84.

If the printing control program of the tape cassette 21 read from the RAM 85 is stored neither in the ROM 83 nor the flash memory 84 (S164: No), in S165, the CPU 81 reads the program data of the printing control program from the program table 182 stored in the memory part 125 of the wireless tag circuit element 25 via the read/write module 93, and stores it into the flash memory 84 as program data of the printing control program of the tape cassette 21.

After that, in S166, the CPU 81 reads program data of the printing control program of the tape cassette 21 from the ROM 83 or the flash memory 84, and executes printing control. After the execution, the CPU 81 terminates the processing.

On the other hand, if the printing control program of the tape cassette 21 read from the RAM 85 is stored in the ROM 83 or the flash memory 84 (S164: Yes), in S166, the CPU 81 reads the program data of the print control program of the tape cassette 21 from the ROM 83 or the flash memory 84, and executes printing control. After the execution, the CPU 81 terminates this processing.

On the other hand, in S162, if the "model name" of the tape printer 1 is neither "Model A", "Model B", nor "Model C" (for example, if the tape printer 1 is "Model D" and the tape cassette 21 is a type capable of accommodating a tape width of 6 mm up to 12 mm but the width of the tape of the tape cassette 21 mounted to the cassette housing part 8 is 18 mm) (S162: No), in S167, the CPU 81 controls the liquid crystal display 7 to display a message "This tape printer does not match the tape cassette you are using now. Please check the type of the applicable tape cassette". Then, the CPU 81 terminates this processing.

As described above, in the tape cassette 21 of Embodiment 13, since the print control program corresponding to each tape type such as the film tape 51 to be accommodated in this tape cassette 21 is stored in the wireless tag circuit element 25 for each type of the tape printer 1. Thus, it is possible to employ a new type of tape cassette 21 having a specification different from conventional cassettes and manufactured after the tape printers of various types have been sold.

Further, in the tape printer 1 of Embodiment 13, even if the print control program corresponding to the tape cassette 21 mounted to the cassette housing part 8 is stored neither in the ROM 83 nor in the flash memory 84, as far as the print control program corresponding to the "model name" of the tape printer 1 is stored in this wireless tag circuit element 25, the CPU 81 automatically reads the corresponding print control program from the wireless tag circuit element 25 of the tape cassette 21 via the read/write module 93, and can execute printing control even if the tape cassette 21 of a new type having a specification different from conventional cassettes is mounted. Further, when a new tape cassette 21 is mounted, the CPU 81 automatically reads the corresponding print control program from the wireless tag circuit element 25 of the tape cassette 21 via the read/write module 93. Thus, there is no need of inputting control conditions of the tape printer 1 such as "a model name", "a drive power supply", and the like. As a result, the tape printer 1 can be used more conveniently and the operation efficiency is enhanced.

Embodiment 14

Next, a tape cassette and a tape printer according to Embodiment 14 will be described based on FIGS. 76 to 79. In the following description, the reference numerals identical to those of the constituent elements of the tape cassette 21 and the tape printer 1 according to Embodiment 1 illustrated in FIGS. 1 to 39 denote the same or equivalent constituent elements of the tape cassette 21 and the tape printer 1 according to Embodiment 1.

The schematic structures of the tape cassette and tape printer according to Embodiment 14 are substantially the same as the structures of the tape cassette 21 and the tape printer 1 according to Embodiment 1. Further, the control processings executed by the tape printer are substantially the same control processings executed by the printer 1 according to Embodiment 1.

However, as shown in FIGS. 76 to 79, the tape cassette and the tape printer according to Embodiment 14 differ from the tape cassette 21 and the tape printer 1 according to Embodiment 1 on the point that, instead of the wireless tag circuit element 25 according to Embodiment 1, a wired tag circuit element 191 is provided, and instead of the antenna 26 according to Embodiment 1, a connection connector 192 is provided.

The connection connector 192 includes on its cassette housing part 8A side four connector terminals 192A to 192D each made of elastic metal plated with nickel and gold, in a substantially arcuate shape when seen from its side and arranged in a horizontal direction (in a lateral direction in FIG. 77) at a predetermined interval. Further, the individual connector terminals 192A to 192D are provided in contact with the surface of the wired tag circuit element 191 of the tape cassette 21 mounted to this cassette housing part 8. The connection connector 192 is electrically connected to, instead of the antenna 26 of the read/write module 93, to an unillustrated input/output interface of this read/write module 93.

Figure 77:
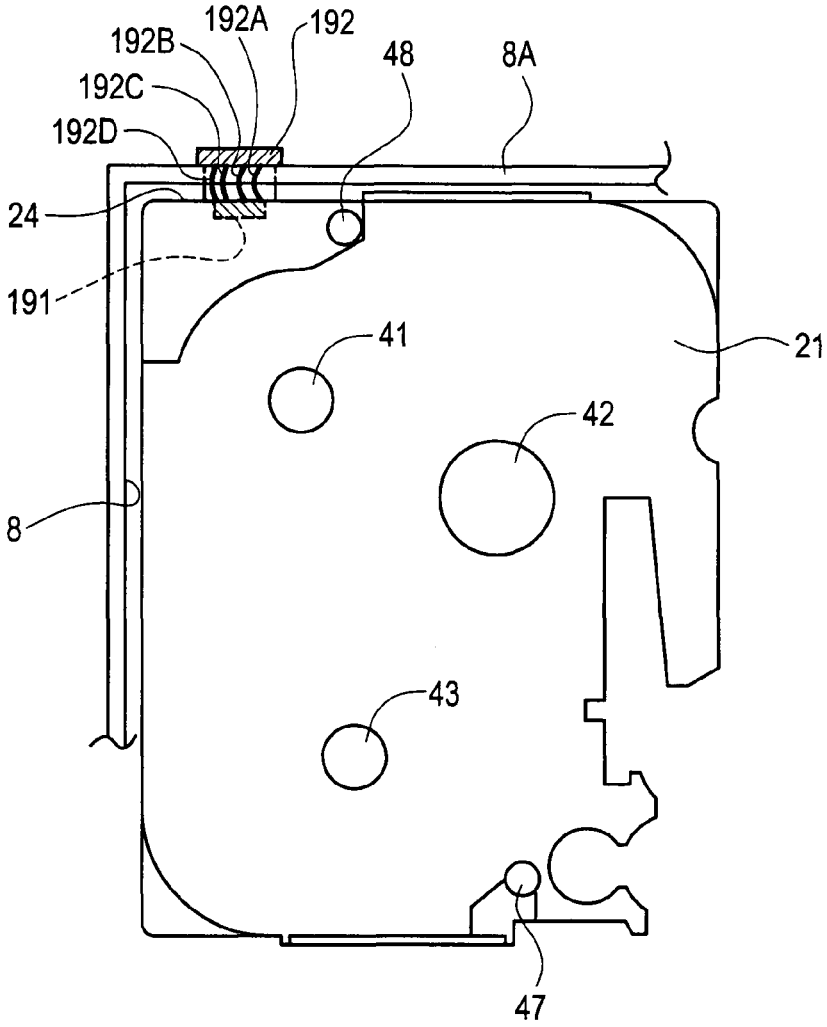
FIG. 77 is a plain view showing relative positional relationship between the wired tag circuit element and the connection connector when the tape cassette is mounted to the cassette housing part of the tape printer according to Embodiment 14.
Figure 78:
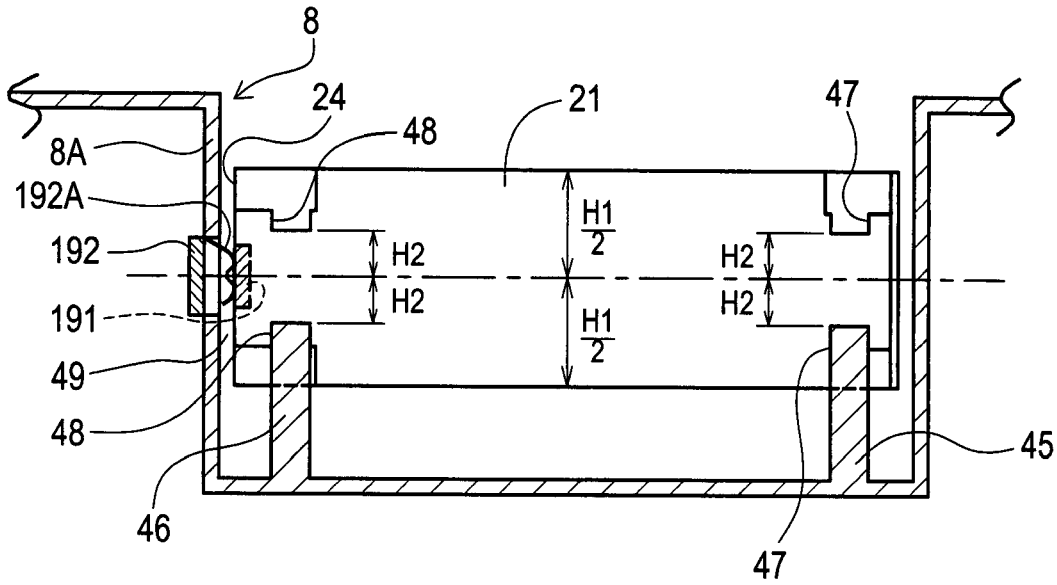
FIG. 78 is a sectional side view showing relative positional relationship between the wired tag circuit element and the connection connector when the tape cassette is mounted to the cassette housing part of the tape printer according to Embodiment 14.
Figure 79:
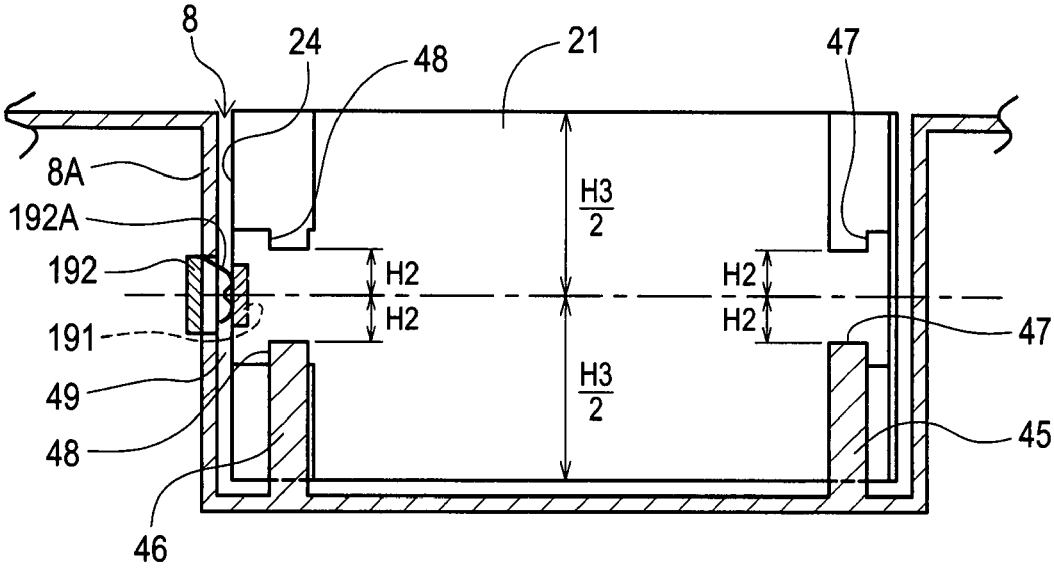
FIG. 79 is a sectional side view showing relative positional relationship between the wired tag circuit element and the connection connector when another tape cassette having a wider tape width is mounted to the cassette housing part of the tape printer according to Embodiment 14.

Further, the wired tag circuit element 191 includes the IC circuit part 67 and, instead of the antenna 68 according to Embodiment 1, four unillustrated electrodes 191A to 191D plated with nickel and gold and electrically connected to the IC circuit part 67 on the outer surface of the wired tag circuit element 191 at a predetermined interval in the horizontal direction (in the lateral direction in FIG. 77). Further, the wired tag circuit element 191 is structured in such a manner that, when the tape cassette 21 is mounted to the cassette housing part 8, the individual connector terminals 192A to 192D are brought into contact with the individual electrodes 191A to 191D and electrically connected thereto. Further, the memory part 125 of the wired tag circuit element 191 stores the parameter table 131 and the cassette information table 132 according to Embodiment 1.

As described above, in the tape cassette 21 of Embodiment 14, since the print control parameter corresponding to each tape type such as the film tape 51 to be accommodated in this tape cassette 21 is stored in the wired tag circuit element 191 for each type of the tape printer 1. Thus, it is possible to employ the tape cassette of a new type having a specification different from conventional cassettes and manufactured after the tape printers 1 of various types have been sold.

Further, in the tape printer 1 of Embodiment 14, the CPU 81 is structured to be capable of reading the information stored in the wired tag circuit element 191 of the tape cassette 21 by wired communication via the read/write module 93, and also capable of writing information into the memory part 125 of the wired tag circuit element 191. Due to this structure, even if the print control parameter corresponding to the tape cassette 21 mounted to the cassette housing part 8 is stored neither in the ROM 83 nor in the flash memory 84, as far as the print control parameter is stored in the memory part 125 of the wired tag circuit element 191, the CPU 81 reads the print control parameter from the wired tag circuit element 191 of the tape cassette 21 via the read/write module 93, and can execute printing control even if a new type of tape cassette having a specification different from conventional cassettes is mounted by inputting the "model name" and the type of "drive power supply" of the tape printer 1 with the keyboard 6. Further, since the read/write module 93 of the tape printer 1 is electrically connected with the wired tag circuit element 191 of the tape cassette 21 mounted to the cassette housing part 8 through the connection connector 192, the individual connector terminals 192A to 192D and the individual electrodes 191A to 191D, the reliability of data transmission and reception can be enhanced.

Embodiment 15

Next, a tape cassette and a tape printer according to Embodiment 15 will be described based on FIGS. 80 to 83. In the following description, the reference numerals identical to those of the constituent elements of the tape cassette 21 and the tape printer 1 according to Embodiment 1 illustrated in FIGS. 1 to 39 denote the same or equivalent constituent elements of the tape cassette 21 and the tape printer 1 according to Embodiment 1.

The schematic structures of the tape cassette and the tape printer according to Embodiment 15 are substantially the same as the structures of the tape cassette 21 and the tape printer 1 according to Embodiment 1. Further, the control processings executed by the tape printer are substantially the same control processings executed by the printer 1 according to Embodiment 1.

However, the structure of attaching the wireless tag circuit element 25 provided to the tape cassette differs from the structure of attaching the wireless tag circuit element 25 provided to the tape cassette 21 according to Embodiment 1. Further, the structure of mounting the tape cassette to the cassette housing part 8 differs from the structure of mounting the tape cassette 21 to the cassette housing part 8 according to Embodiment 1.

First of all, the structure of the tape cassette and the cassette housing part 8 according to Embodiment 15 will be described based on FIGS. 80 to 82.

Figure 80:
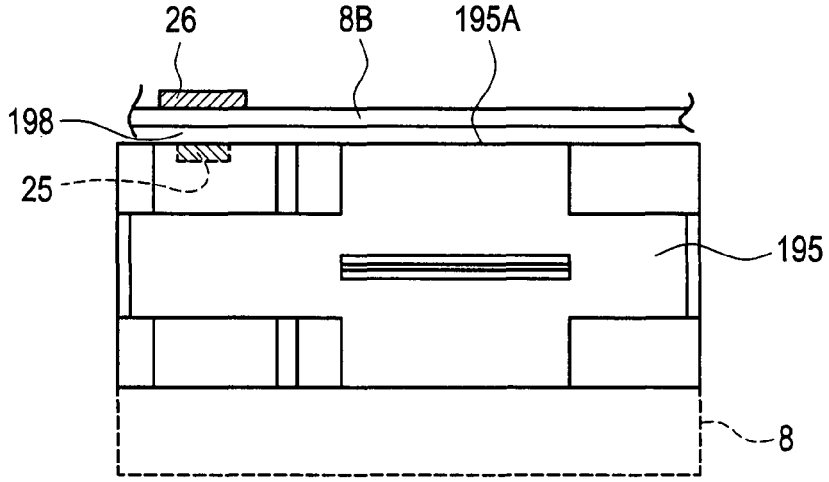
FIG. 80 is a side view showing relative positional relationship between a wireless tag circuit element and an antenna when a tape cassette is mounted to a cassette housing part of a tape printer according to Embodiment 15.
Figure 81:
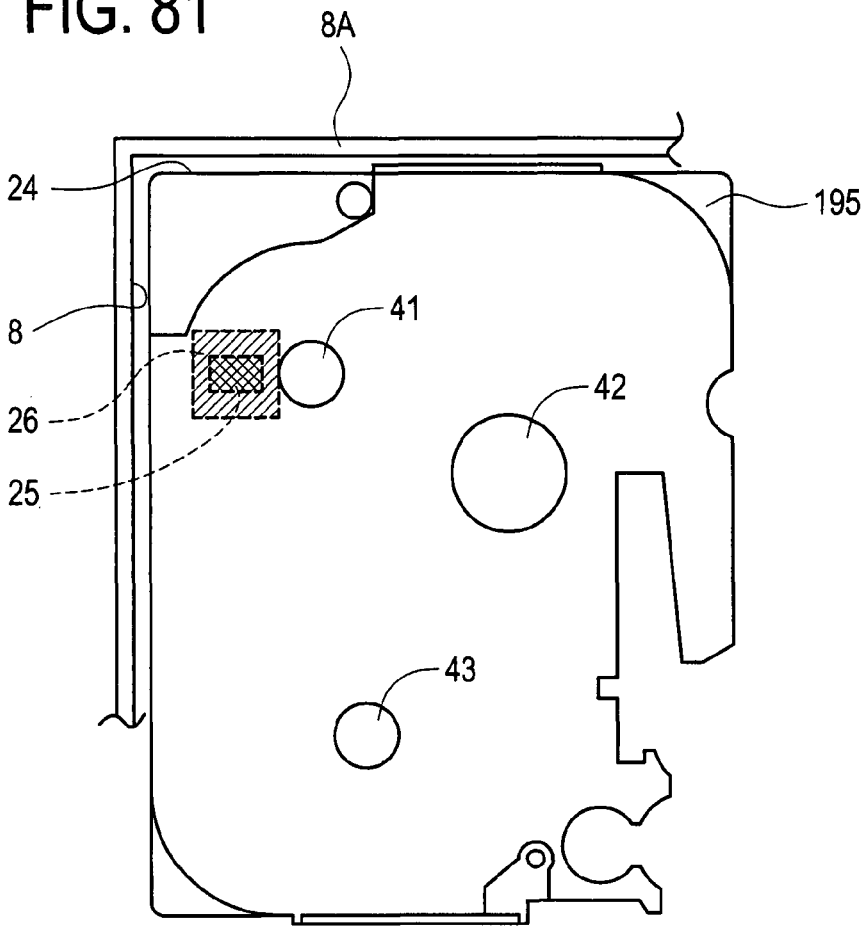
FIG. 81 is a plain view showing relative positional relationship between the wireless tag circuit element and the antenna when the tape cassette is mounted to the cassette housing part of the tape printer according to Embodiment 15.
Figure 82:
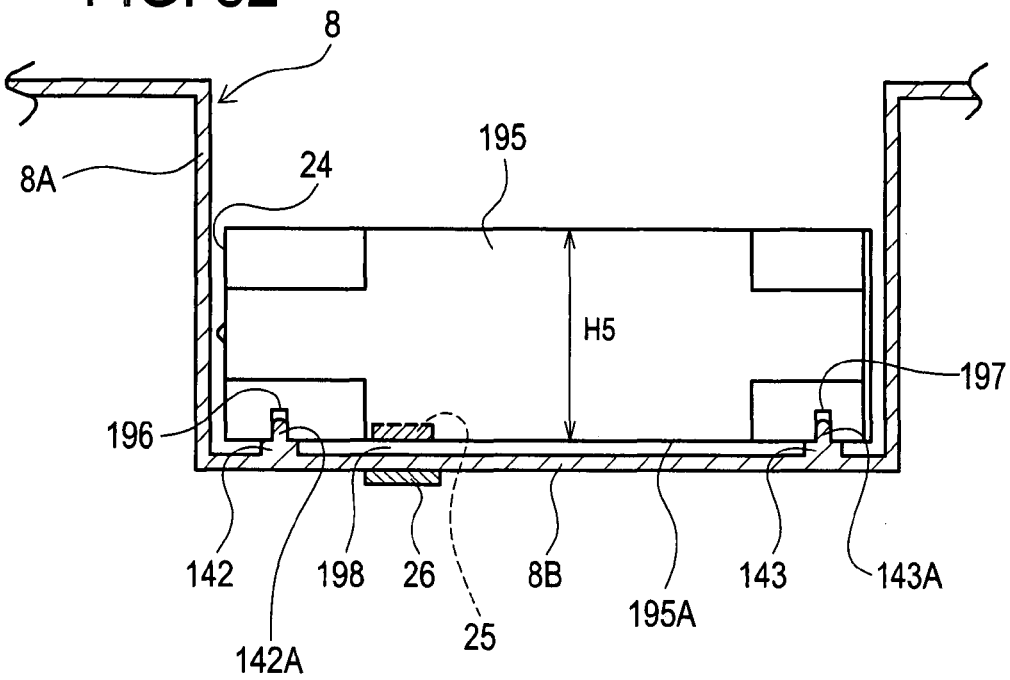
FIG. 82 is a sectional side view showing relative positional relationship between the wireless tag circuit element and the antenna when the tape cassette is mounted to the cassette housing part of the tape printer according to Embodiment 15.

As shown in FIGS. 80 to 82, reception parts 142, 143 with the same height (for example, with the height of 0.2 to 3 mm, and preferably, 0.5 to 1 mm) are provided on the bottom surface 8B of the cassette housing part 8 and the bottom surface of the tape cassette 195 is brought into contact with the reception parts. On the upper end surface of the individual reception parts 142, 143, there are provided location projections 142A, 143A having predetermined heights (for example, height of 0.3 mm to 2 mm) to be inserted and fitted into location holes 196, 197 formed on the bottom surface 195A of the tape cassette 195. In this manner, the tape cassette 195 is properly positioned within the cassette housing part 8 by inserting and fitting the individual location holes 196, 197 formed on the bottom surface 195A thereof into the individual location projections 142A, 143A and bringing the bottom surface 195A as the mounting reference plane into contact with the upper end surfaces of the reception parts 142, 143.

Next, a relative positional relationship between the wireless tag circuit element 25 and the antenna 26 in the case where the tape cassette 195 is mounted to the cassette housing part 8 will be described based on FIGS. 80 to 83.

As shown in FIGS. 80 to 82, at the bottom surface 195A such as the mounting reference plane of the tape cassette 195, the wireless tag circuit element 25 is disposed at a position adjacent to the side of a supporting hole 41 formed on the lower case 23. On the other hand, the antenna 26 provided on the bottom surface 8B of the cassette housing part 8 is disposed at a position opposed to the wireless tag circuit element 25. When the tape cassette 195 is mounted to the cassette housing part 8, a space 198 having a narrow gap (for example, a gap of about 0.3 to 3 mm) is created between the bottom surface 195A of the tape cassette 195 and the bottom surface 8B of the cassette housing part 8. In this gap, there is no conductive plate member and the like which will obstruct signal transmission and reception between the antenna 26 and the wireless tag circuit element disposed to oppose to each other. In this manner, excellent signal transmission and reception can be achieved between the antenna 26 and the wireless tag circuit element 25.

Figure 83:
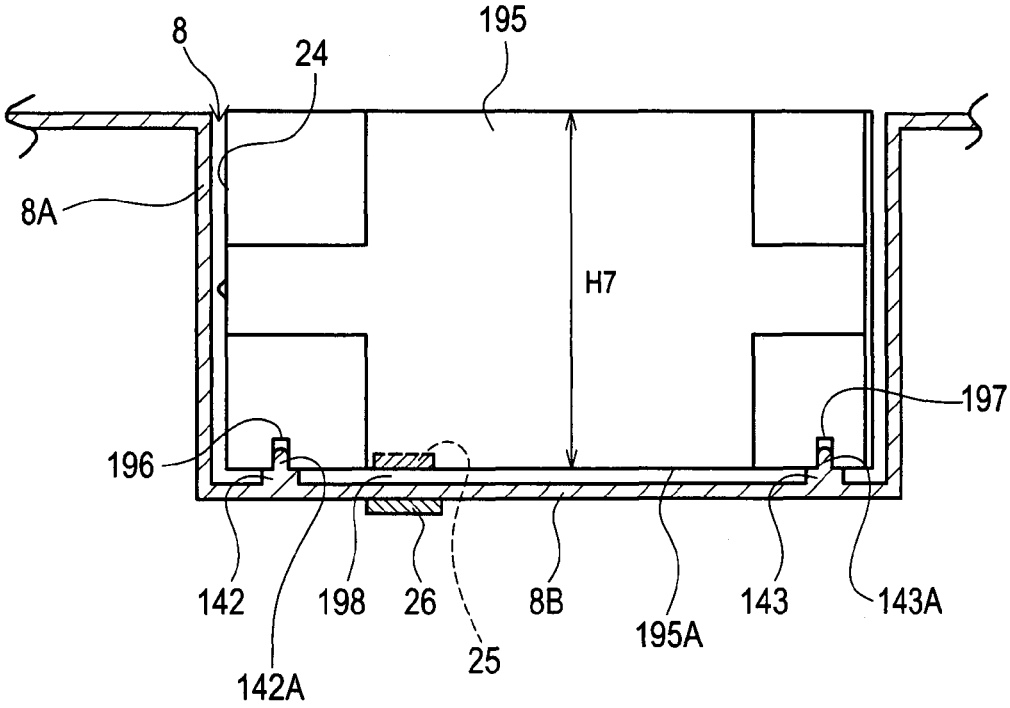
FIG. 83 is a sectional side view showing relative positional relationship between the wireless tag circuit element and the antenna when another tape cassette having a wider tape width is mounted to the cassette housing part of the tape printer according to Embodiment 15.

Further, as shown in FIG. 83, as is the case of the tape cassette 195 shown in FIG. 82 (for example, having the tape width of 12 mm), the tape cassette 195 having a different tape width (for example a tape width of 24 mm) is also formed with the wireless tag circuit element 25 on the bottom surface 195A of the tape cassette 195 at a position opposed to the antenna 26. In this manner, even if the tape cassette 195 having a different tape width (for example, a tape width of 24 mm) is mounted to the cassette housing part 8, a space 198 having a narrow gap (for example, a gap of about 0.3 mm to 3 mm) is created between the bottom surface 195A of the tape cassette 195 and the bottom surface 8B of the cassette housing part 8. In this gap, there is no conductive plate member and the like which will obstruct signal transmission and reception between the antenna 26 and the wireless tag circuit element 25 disposed to oppose to each other. In this manner, excellent signal transmission and reception can be achieved between the antenna 26 and the wireless tag circuit element 25.

As described above, the tape cassette 195 according to Embodiment 15 is mounted to the cassette housing part 8 while the individual location holes 196, 197 formed on the bottom surface 195A thereof are inserted and fitted to the individual location projections 142A, 143A, and the bottom surface 195A is brought into contact with the upper end surfaces of the reception parts 142, 143. In this manner, the wireless tag circuit element 25 provided on the bottom surface 195A of the tape cassette 195 is always positioned at a position opposed to the antenna 26 provided on the bottom surface 8B of the cassette housing part 8. In this manner, the wireless tag circuit element 25 can be assuredly located at a position opposed to the antenna 26.

Further, in the tape printer 1 according to Embodiment 15, the wireless tag circuit element 25 is provided on the bottom surface 195A of the tape cassette 195, and this bottom surface 195A is brought into contact with the upper end surface of the individual reception parts 142, 143. In addition, the antenna 26 is disposed on the bottom surface 8B of the cassette housing 8. Due to this structure, the relative positional relationship between the antenna 26 and the wireless tag circuit element 25 is always kept at constant. As a result, the antenna 26 can be assuredly located at a position opposed to the wireless tag circuit element 25, and the information related to the tape cassette 195 stored in this wireless tag circuit element 25 can be assuredly transmitted and received.

Alternatively, it is possible to employ a structure where the height dimension of the individual reception parts 142, 143 are set to "0", that is, the individual location projections 142A, 143A are provided on the bottom surface 8B of the cassette housing part 8, and the bottom surface 195A of the tape cassette 195 is brought into contact with the inner side surface of the bottom part 8B. In this manner, the thickness of the tape printer 1 can be reduced.

The disclosure is not limited to Embodiments 1 to 15 described above. It is a matter of course that various improvements and modifications may be made without departing from the scope of the disclosure.

The invention claimed is:

1. A tape printer in which a tape cassette is removably mounted, wherein the tape cassette accommodates tape and includes a tape discharging port through which a printed tape is discharged;

the tape printer comprising:

a tape transfer device that transfers a long length of the tape;

a printing device that prints on the tape, the printing device being fixed to the tape printer upstream of the tape discharging port in a tape transferring direction;

a cutting device that cuts the printed tape discharged from the tape discharging port;

a device side antenna that is located downstream of the tape discharging port in the tape transferring direction;

a read/write device that reads or writes predetermined information from or into a wireless information circuit element adhered to the printed tape printed by the printing device via the device side antenna by wireless communication, the wireless information circuit including an IC circuit part for storing the predetermined information and an IC circuit-side antenna connected to the IC circuit part to transmit and receive information;

a detector sensor that is arranged so as to be opposed to the device side antenna interposing the printed tape, the detector sensor detecting sensor marks arranged at a predetermined pitch on a back surface of the printed tape so as to have a predetermined relative positional relationship to the wireless information circuit element in the tape transferring direction;

a first drive control device that carries out drive control of the tape transfer device, the cutting device and the read/write device, after an input of detection information that the detector sensor has detected the sensor marks; and a second drive control device that carries out drive control of the printing device so that printing is executed by the printing device, after the input of the detection information that the detector sensor has detected the sensor marks;

wherein, while the printer is printing, the first control device, in sequence:

controls the tape transfer device to stop the printed tape, and controls the printing device to stop when the tape transfer device transfers the printed tape by a distance corresponding to a transfer distance from the cutting device to the printing device;

controls the cutting device to cut the printed tape so as to cut a margin at a top end portion from the printed tape;

controls the tape transfer device to continue transferring the printed tape, and printing also continues, along a predetermined length with reference to the predetermined relative positional relationship; and controls the read/write device to read or write the predetermined information from or into the wireless information circuit element.

* * * * *